US006696232B2

(12) United States Patent
Sowinski

(10) Patent No.: US 6,696,232 B2
(45) Date of Patent: Feb. 24, 2004

(54) COLOR NEGATIVE ELEMENT INTENDED FOR SCANNING

(75) Inventor: Allan F. Sowinski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 34 days.

(21) Appl. No.: 10/028,135

(22) Filed: Dec. 20, 2001

(65) Prior Publication Data

US 2004/0002023 A1 Jan. 1, 2004

(51) Int. Cl.[7] ..... G03C 1/46

(52) U.S. Cl. ..... 430/506; 430/505; 430/567; 430/544; 430/543

(58) Field of Search ..... 430/506, 505, 430/544, 567, 543

(56) References Cited

U.S. PATENT DOCUMENTS

| | | | | |
|---|---|---|---|---|
| 4,524,130 | A | | 6/1985 | Iwasa et al. |
| 4,777,102 | A | | 10/1988 | Levine |
| 4,830,954 | A | | 5/1989 | Matejec |
| 4,891,692 | A | | 1/1990 | Outa |
| 4,941,039 | A | | 7/1990 | E'Errico |
| 5,118,591 | A | | 6/1992 | Koboshi et al. |
| 5,183,727 | A | | 2/1993 | Schmittou et al. |
| 5,219,715 | A | | 6/1993 | Sowinski et al. |
| 5,254,441 | A | | 10/1993 | Pearce et al. |
| 5,267,030 | A | | 11/1993 | Giorgianni et al. |
| 5,273,870 | A | | 12/1993 | Matejec et al. |
| 5,298,376 | A | | 3/1994 | Szajewski et al. |
| 5,300,417 | A | | 4/1994 | Lushington et al. |
| 5,314,793 | A | | 5/1994 | Chang et al. |
| 5,314,794 | A | | 5/1994 | Sutton |
| 5,318,880 | A | | 6/1994 | English et al. |
| 5,322,766 | A | | 6/1994 | Sowinski et al. |
| 5,344,750 | A | | 9/1994 | Fujimoto et al. |
| 5,356,764 | A | | 10/1994 | Szajewski et al. |
| 5,360,703 | A | | 11/1994 | Chang et al. |
| 5,389,506 | A | | 2/1995 | Sutton |
| 5,422,231 | A | | 6/1995 | Nozawa |
| 5,455,146 | A | | 10/1995 | Nishikawa et al. |
| 5,466,560 | A | | 11/1995 | Sowinski et al. |
| 5,500,316 | A | | 3/1996 | Bogdanowicz et al. |
| 5,519,510 | A | | 5/1996 | Edgar |
| 5,674,665 | A | | 10/1997 | Sawyer et al. |
| 5,698,379 | A | | 12/1997 | Bohan et al. |
| 5,705,327 | A | | 1/1998 | Brewer et al. |
| 5,747,228 | A | | 5/1998 | Szajewski et al. |
| 5,753,424 | A | | 5/1998 | Ishikawa |
| 5,827,635 | A | | 10/1998 | Cole |
| 5,922,519 | A | | 7/1999 | Ishikawa et al. |
| 5,965,340 | A | | 10/1999 | Becher |
| 5,972,585 | A | | 10/1999 | Sowinski et al. |
| 6,021,277 | A | | 2/2000 | Sowinski et al. |
| 6,190,847 | B1 | | 2/2001 | Sowinski et al. |
| 6,210,870 | B1 | * | 4/2001 | Brockler et al. ..... 430/506 |
| 6,274,299 | B1 | * | 8/2001 | Buhr et al. ..... 430/359 |
| 6,296,994 | B1 | | 10/2001 | Sowinski et al. |

FOREIGN PATENT DOCUMENTS

| | | |
|---|---|---|
| EP | 0 413 204 | 2/1991 |
| EP | 0 488 310 | 6/1992 |
| EP | 0 852 287 | 7/1998 |
| EP | 0 905 561 | 3/1999 |
| EP | 0 969 318 | 1/2000 |
| JP | 2001-92088 | 4/2001 |

OTHER PUBLICATIONS

*The British Journal of Photography Annual* of 1988, pp. 196–198.

*Research Disclosure*, vol. 389, Sep. 1996, Item 38957, pp. 591–639.

* cited by examiner

*Primary Examiner*—Geraldine Letscher
(74) *Attorney, Agent, or Firm*—Sarah Meeks Roberts

(57) ABSTRACT

A color negative photographic film element for producing a color image suited for conversion to an electronic form and subsequent reconversion into a viewable form:

said element comprising a support and, coated on the support, a plurality of hydrophilic colloid layers, including radiation-sensitive silver halide emulsion layers, forming layer units for separately recording blue, green, and red exposures, each of the layer units containing dye image-forming coupler chosen to produce image dye having an absorption half-peak bandwidth lying in a different spectral region in each layer unit, WHEREIN the element comprises a development inhibitor releasing compound in at least one layer unit, at least one of the layer units contains two or more emulsion layers differing in sensitivity, the layer units each exhibit a dye image gamma of less than 1.0, the element exhibits an exposure latitude of at least 2.7 log E, where E is exposure measured in lux-seconds, and a light sensitivity of at least ISO 50, the gamma ratio of each of the red, green and blue light recording layer units is between about 0.80 and 1.30, and the average layer thickness is about 1.5 micrometers or less.

18 Claims, No Drawings

COLOR NEGATIVE ELEMENT INTENDED FOR SCANNING

FIELD OF THE INVENTION

The invention relates to an improved silver halide color negative photographic recording material and a method of chemical processing. The element is intended for scanning and digital image processing rather than optical printing. The element is especially suitable for an associated method of accelerated color development during color processing to reduce access time to image acquisition without sacrificing compatibility with conventional color development methods.

DEFINITION OF TERMS

The term "E" is used to indicate exposure in lux-seconds.

The term "Status M" density indicates density measurements obtained from a densitometer meeting photocell and filter specifications described in *SPSE Handbook of Photographic Science and Engineering*, W. Thomas, editor, John Wiley & Sons, New York, 1973, Section 15.4.2.6 Color Filters. The International Standard for Status M density is set out in "Photography—Density Measurements—Part 3: Spectral conditions", Ref. No. ISO 5/3-1984 (E).

The term "gamma" is employed to indicate the incremental increase in image density ($\Delta D$) produced by a corresponding incremental increase in log exposure ($\Delta \log E$) and indicates the maximum gamma measured over an exposure range extending between a first characteristic curve reference point lying at a density of about 0.15 above minimum density and a second characteristic curve reference point separated from the first reference point by about 0.9 log E.

The term "exposure latitude" indicates the exposure range of a characteristic curve segment over which instantaneous gamma ($\Delta D/\Delta \log E$) is at least about 70 percent of gamma, as defined above. The exposure latitude of a color element having multiple color recording units is the exposure range over which the characteristic curves of the red, green, and blue color recording units simultaneously fulfill the aforesaid definition.

In referring to blue, green and red recording dye image-forming layer units, the term "layer unit" indicates the hydrophilic colloid layer or sub-unit layers that contain radiation-sensitive silver halide grains to capture exposing radiation and dye image-forming couplers that react upon development of the grains. The grains and couplers are usually in the same layer, but can be in adjacent layers.

The term "dye image-forming coupler" indicates a compound that reacts with oxidized color developing agent to produce a dye chromophore capable of rendering an image.

The term "absorption half-peak bandwidth" indicates the spectral range over which a dye exhibits an absorption equal to at least half of its maximum absorption.

The term "colored masking coupler" indicates a coupler that is initially colored and that loses its initial color during development upon reaction with oxidized color developing agent.

The term "substantially free of colored masking coupler" indicates a total coating coverage of less than 0.05 millimole/$m^2$ of colored masking coupler.

The term "development inhibitor releasing compound" or "DIR" indicates a compound that cleaves to release a development inhibitor during color development. As defined DIR's include dye-forming couplers and other compounds that utilize anchimeric and timed releasing mechanisms.

The term "gamma ratio" when applied to a color recording layer unit refers to the ratio determined by dividing the gamma of a cited color layer unit after an imagewise color separation exposure and process that enables development of primarily that layer unit by the gamma of the same color layer unit after an imagewise white light exposure and process that enables development of all layer units. This term relates to the degree of color correction and color saturation available from that color layer unit generally provided by interlayer interimage effects directed towards conventional optical printing. Larger values of the gamma ratio indicate enhanced degrees of color saturation under optical printing conditions.

In referring to grains and emulsions containing two or more halides, the halides are named in order of ascending concentrations.

In referring to grains, "ECD" indicates mean equivalent circular diameter and, in describing tabular grains, "t" indicates mean tabular grain thickness.

The term "average aspect ratio" when used in reference to tabular emulsion grains, refers to the ratio of mean tabular grain equivalent circular diameter to mean tabular grain thickness.

The terms "blue spectral sensitizing dye", "green spectral sensitizing dye", and "red spectral sensitizing dye" refer to a dye or combination of dyes that absorb blue, green, or red light and sensitize silver halide grains by transferring the absorbed photon energy to silver halide grains when adsorbed to their surfaces and, when adsorbed, have their peak absorption in the blue, green and red regions of the spectrum, respectively.

The term "one-time-use camera" or "OTUC" is used to indicate a camera supplied to the user preloaded with a light sensitive silver halide photographic element and having a lens and shutter. The terms "single-use camera," "film-with-lens unit," "disposable camera" and the like are also employed in the art for cameras that are intended for one use, after which they are recycled, subsequent to removal of the film for development.

*Research Disclosure* is a publication of Kenneth Mason Publications Ltd., Dudley House, 12 North Street, Emsworth, Hampshire PO10 7DQ England (or Emsworth Design Inc., 121 West 19th Street, New York, N.Y. 10011).

BACKGROUND OF THE INVENTION

The basic image-forming process of color photography comprises the exposure of a silver halide photographic recording material such as a color film to visible electromagnetic radiation, which forms a latent image, and the chemical processing of the exposed recording material to provide a useful intermediary dye image for printing or a directly viewable dye image. Chemical processing involves two typical steps. The fundamental first step is the treatment of the exposed silver halide material with a developing agent wherein some of or all of the silver ion is reduced to metallic silver, and a dye image is formed by the reaction of oxidized color developer with a dye image-forming coupler. For color materials, the second usual step is the removal of silver metal and residual silver halide by one or more steps of bleaching and fixing so that only a dye image remains in the processed material. In the traditional color negative/positive print system, the chemically processed film is used as a mask in front of a lamp house in an optical printer to expose silver halide color paper to provide a printed image, after the latter's analogous processing. The complete procedure of development, clearing and optical printing is commonly referred to as film photofinishing. Historically, the color negative/positive print system has relied on the film color development step to provide color signal processing for both film and color paper by an elegant and delicate group of chemical technologies incorporated in the film. Colored masking couplers and development inhibitor-releasing (DIR) couplers are carefully placed in particular layer units at precise levels to imagewise adjust the formation of density in the other layer units and to correct thereby the unwanted absorptions of the image dyes. This sensitive step of chemical color correction is required to produce the accurate color reproduction and increased color saturation necessary to pleasing renditions of photographed scenes.

Digital minilab and wholesale laboratory photofinishing is beginning to spread rapidly in the market place, in part as a means to provide access to network imaging services by scanning color negative and reversal films, and also to fulfill the printing needs of the growing base of consumer digital still cameras. Film scanning creates an electronic record of the image dye record of photographed scene, and the image-bearing electronic signals are transformed and adjusted in a number of steps of electronic signal processing, before rendering them into a viewable output form such as paper print or a CRT or TFT monitor screen display. The electronic signal processing following film scanning makes chemical signal processing produced during color development unnecessary for system color correction and image enhancement, and it can also correct for color imbalance due to mismatched layer unit gammas. So it is possible to scan and electronically produce a viewable image from color negative film that lacks colored masking couplers, as in U.S. Pat. No. 5,698,379 to Bohan et al or in U.S. Pat. No. 5,972,585 to Sowinski et al and, U.S. Pat. No. 6,190,847 to Sowinski et al or from films further optimized for scan printing as in U.S. Pat. No. 6,021,277 to Sowinski et al, U.S. Pat. No. 5,965,340 to Becher, or in U.S. Pat. No. 6,296,994 to Sowinski et al, for example. In color negative films in which silver coating coverages are significantly reduced, it is in some instances difficult to obtain a desired level of image discrimination (D-max–D-min) when masking couplers are present. The following patents include examples of color negative films in which masking couplers have been omitted: Schmittou et al U.S. Pat. No. 5,183,727 (Element I), Sowinski et al U.S. Pat. Nos. 5,219,715 and 5,322,766 (Element III), English et al U.S. Pat. No. 5,318,880 (Sample 108), and Szajewski et al U.S. Pat. No. 5,298,376 (Samples 301 and 302). The examples disclosed in these patents, which have limited silver coating coverages, have not exhibited the degree of exposure latitude normally desired for color negative films.

Since scanning and electronic image processing can produce complete color correction, which allows a pleasing printed image captured from color films intended for scanning, it is desirable to accelerate the development step of film chemical processing to afford higher throughput and faster access to the recorded image of a photographed scene. Color developing compositions and processing conditions useful in rapid color development are disclosed for example in U.S. Pat. No. 5,118,591 to Koboshi et al, U.S. Pat. No. 5,344,750 to Fujimoto et al, U.S. Pat. No. 5,455,146 Nishikawa et al, U.S. Pat. No. 5,753,424 to Ishikawa et al, U.S. Pat. No. 5,827,635 to Cole, and U.S. Pat. No. 5,922,519 to Ishikawa et al. Accelerating the development step by employing forcing conditions of increased temperature, pH, higher developer concentration, or decreased halide content can however result in image quality losses due to increased fog, speed losses, or deviations from the specified gammas produced by the layer units, resulting in color balance mismatches. In particular, losses in red layer unit developability as a consequence of its position at the bottom of the coating structure often result in reduced red gamma and speed. In the optical printing system, a paradigm has been established to allow a neutral gray scale to print through correctly, and it is necessary to have matched gammas expressed in terms of reference printing densities to correctly expose silver halide color paper by shining light through the processed color negative film; Status M densities are a first approximation of printing densities. A gamma mismatch or color balance mismatch will result in white, gray or black objects being reproduced with a color bias, leading to overall degraded color reproduction. Films intended for scanning do not have to be specified in terms of Status M densities or reference printing densities relating to conventional color negative development conditions, e.g., the KODAK FLEXICOLOR™ Process also known as the C-41 Process, but it is exceedingly convenient and practical to do so. While electronic signal processing can correct color record imbalances resulting from accelerated processing relative to a conventional process specification, backwards compatibility of a color negative scan film and an accelerated process with its conventional processing result is a more effective solution to the problem and it is highly desirable. There is a need to produce rapid film development to accelerate data acquisition by hybrid digital film systems without significantly compromising conventional chemical processability in current digital minilabs and wholesale laboratory film processors based on current trade development processes.

SUMMARY OF THE INVENTION

This invention provides a color negative photographic film element suited for conversion to an electronic form and subsequent reconversion into a viewable form, said element comprising a support and, coated on the support, a plurality of hydrophilic colloid layers, including radiation-sensitive silver halide emulsion layers, forming layer units for separately recording blue, green, and red exposures, each of the layer units containing dye image-forming coupler chosen to produce image dye having an absorption half-peak bandwidth lying in a different spectral region in each layer unit, wherein the element comprises a development inhibitor releasing compound in at least one layer unit, at least one of the layer units contains two or more emulsion layers differing in sensitivity, the layer units each exhibit a dye image gamma of less than 1.0, the element exhibits an exposure latitude of at least 2.7 log E, where E is exposure measured in lux-seconds, a light sensitivity of at least ISO 50, the gamma ratio of each of the red, green and blue light recording layer units is between 0.80 and 1.30, and the average layer thickness is about 1.5 micrometers or less. This element is particularly useful with rapid processing methods.

It has been discovered quite unexpectedly that a color negative photographic element constructed as described above and processed using rapid processing methods produces excellent compatibility with the results of conventional color negative film development, unlike representative color negative films of the art.

DESCRIPTION OF PREFERRED EMBODIMENTS

The excellent rapid processing characteristics of the described element are obtained when the gamma ratio for each of the red, green, and blue color-recording units is less than about 1.3. These low values of the gamma ratio are indicative of low levels of interlayer interaction, also known as interlayer interimage effects, between the layer units that is responsible for chemical signal processing and are believed in part to account for the improved processability of the color negative film. The gamma ratios described are realized in part by limiting or excluding colored masking couplers from the elements of the invention; they are also realized by proper selection of DIR compounds and other chemicals that imagewise modify silver halide emulsion development. It is recognized that the gamma ratios may also be attained in other ways. In one concrete example, judicious choice and balancing of light sensitive emulsion halide content may be employed to minimize the gamma ratio by minimizing the interaction of individual color records during development. Emulsion iodide content may be particularly critical in this role. Proper selection of the quantity of the emulsion to be employed in each layer is important, not only for obtaining the required gamma ratios, but also for obtaining the required exposure latitude. Another feature important for obtaining the required exposure latitude is the use of multiple layers for each color-recording unit. Also critical to the achievement of the improved rapid processability of the element is the use of color recording unit layers with average layer thickness of not more than about 1.5 micrometers. Lower average layer thickness is facilitated in part by the achievement of low gamma ratios, and by providing a dye image gamma of less than about 1.0. In order to offset the requirements of good camera sensitivity associated with ISO speed of 50 or higher and useful exposure latitude, careful selection of other constituents of the photographic recording material is necessary, however. Hydrophilic colloid vehicle, such as gelatin, is necessarily minimized in the color recording unit sub-unit layers, and in interlayers, undercoat layers, and overcoat layers. But when the coating vehicle is so minimized, the wet and dry physical robustness of the element is unacceptably reduced unless other filler materials are also minimized. Thus it is also highly desirable to reduce the use of auxiliary high boiling oils or coupler solvents, which are commonly used to increase dye image-forming coupler photographic reactivity during development. The use of gamma ratios of about 0.8 to 1.30 and dye image gamma of less than about 1.0 while providing thin color recording unit layers and ancillary layers makes the color negative film element of the invention unsuitable to optical printing, and film scanning and electronic signal processing of the resultant image-bearing electronic signals are preferred methods for forming a viewable image from the recording material.

It has been discovered that the chemical development during photofinishing of a film intended for scanning can be accelerated by contacting the photographic recording material at elevated temperatures in very short times ranging from about 20–90 seconds with a developing solution that contains elevated color developer concentration, and among other conventional developer solution components, bromide ion, sulfite ion and pyrrolidone polymer in certain concentrations. Developed images of excellent quality and quite similar sensitometric performance are produced compared to those derived from conventional color development for 195 seconds.

A typical color negative film construction useful in the practice of the invention is illustrated by the following example:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective, or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. The element can contain additional layers, such as filter layers, interlayers, overcoat layers, subbing layers, antihalation layers and the like. Transparent and reflective support constructions, including subbing layers to enhance adhesion, are disclosed in *Research Disclosure*, Item 38957, cited above, XV. Supports. Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. Further, the support construction employing annealed polyethylene naphthalate such as described in Hatsumei Kyoukai Koukai Gihou No. 94-6023, published Mar. 15, 1994 (Patent Office of Japan and Library of Congress of Japan) is specifically contemplated.

Each of blue, green and red recording layer units BU, GU and RU is formed of one or more hydrophilic colloid layers and contain at least one radiation-sensitive silver halide emulsion and coupler, including at least one dye image-forming coupler. One or more of the layer units of the invention is preferably subdivided into at least two, and more preferably three, or more sub-unit layers. It is preferred that the green, and red recording units are subdivided into at least two recording layer sub-units to provide increased recording latitude and reduced image granularity. In more preferred embodiments, the green, and red recording units are subdivided into at least three recording layer sub-units to provide increased recording latitude and reduced image granularity. In yet more preferred embodiments, at least one of the green and red recording units is subdivided into at least four recording layer sub-units to provide increased recording latitude while judiciously managing the total coated laydown of layer constituents such as silver halide emulsion, coupler, DIR, high boiling oil coupler solvent, and gelatin in the color recording unit. When a choice is required between subdividing one of the green and red recording units into at least four recording layer sub-units, it is preferred to select the green recording unit due to its higher weighting in the human visual system responsivity. Overall it is more preferred to subdivide both the green and red recording layer units into four recording layer sub-units. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion-containing layer, the coupler-containing hydrophilic colloid layer is positioned to receive oxidized color developing agent from the emulsion during development. Usually the coupler-containing layer is the next adjacent hydrophilic colloid layer to the emulsion-containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure good high spatial frequency resolution of images exposed onto the element and the excellent rapid developability of the element, the total dry thickness of the layer units and ancillary layers applied to the support must be controlled. Generally, the total thickness of the sensitized layers, interlayers and protective layers coated on the exposure face of the support is less than 25 micrometers ($\mu$m). It is preferred that the total layer thickness be less than 23 $\mu$m, more preferred that the total layer thickness be less than 22 $\mu$m, and most preferred that the total layer thickness be less than 20 $\mu$m. Total coated dry layer thicknesses of between 15 and 18 micrometers are specifically contemplated. This constraint on total layer dry thickness is enabled by controlling the total number of coated layers, and by controlling the total quantity of vehicle and other components, such as light sensitive silver halide emulsion, image dye-forming couplers, DIR couplers, couplers releasing other photographically useful groups, permanent coupler solvent or high boiling oil, organic polymer, masking dye, exposure filter dye, silver halide emulsion stabilizer, coating aids such as surfactant and gelatin thickener, and other such ingredients in the layers. The total quantity of vehicle is generally less than 18 g/m$^2$, preferably less than 17 g/m$^2$, and more preferably less than 15.5 g/m$^2$, and still more preferably less than 14 g/m$^2$. Very low total vehicle quantities of between about 10 and 12 g/m$^2$ are specifically contemplated.

While any useful quantity of light sensitive silver halide emulsion can be employed in the elements useful in this invention, the total quantity of silver halide emulsions, expressed as silver, is generally less than 9 g/m$^2$. Preferably the total quantity of silver is less than 7 g/m$^2$, and more preferably less than 5 g/m$^2$. Conversely, a silver coating coverage of at least about 3 g of coated silver per m$^2$ of support surface area in the element is necessary to realize an exposure latitude of at least 2.7 log E, while maintaining an adequately low graininess position for pictures intended to be enlarged. The green light recording layer unit is preferred to have a coated silver coverage of at least 1.1 g/m$^2$; it is more preferred to have a quantity of about 2.2 g/m$^2$. It is preferred that the red and green units together have at least 2.2 g/m$^2$ of coated silver and even more preferred that the red and green color recording units have at least 4.0 g/m$^2$ of coated silver. Because of its less favored location for processing, it is generally preferred that the layer unit located, on average, closest to the support contain a silver coating coverage of at least 1.5 g/m$^2$ of coated silver. Typically, this is the red recording layer unit. For many photographic applications, optimum silver coverages are at least about 1.0 in the blue recording layer unit and at least 1.8 g/m$^2$ in the green and red recording layer units. Thin, high tabularity tabular grain emulsions are especially suited for use in thin color negative film color recording unit layers at reduced material laydowns, as taught in U.S. Pat. No. 5,322,766 to Sowinski et al.

Image dye-forming couplers, DIR couplers, bleach accelerator releasing couplers, electron transfer agent releasing couplers, oxidized developer scavenging compounds, exposure filtration dyes, masking dyes and other such coupling chemical compounds or light absorbing compounds generally comprise less than 4.5 g/m$^2$ total coated laydown; it preferred that the total quantity of such compounds is than about 3.5 g/m$^2$, and it is more preferred that the total quantity of light absorbing compounds and coated compounds reacting with oxidized developer molecules is less than about 2.5 g/m$^2$. High boiling organic oils used as permanent diluents or solvents for ballasted couplers or permanent dyes in the photographic aqueous gelatin dispersion making process are fillers contributing to total coated recording material dry thickness, which are attractive to minimize. The total quantity of permanent high boiling oil or coupler solvent is generally less than 3.0 g/m$^2$, preferably less than 2.2 g/m$^2$, and more preferably less than 1.5 g/m$^2$. It is most preferable for the photographic recording material to be substantially free of permanent coupler solvent, which functionally is less than about 0.3 g/m$^2$ of total solvent coverage. Water soluble chemicals, such as coating aids like surfactants, gelatin thickeners or other viscosity-building agents such as polymers bearing sulfonate groups, gelatin cross-linking compounds such as hardeners, metal ion sequestrants or chelating agents, and silver halide emulsion addenda chemicals such as soluble antifoggants, comprise another category of ingredients. The total quantity of soluble aqueous ingredients is generally less than 1.5 g/m$^2$, preferably less than 1.1 g/m$^2$, and more preferably less than 0.8 g/m$^2$.

The color negative film element of the invention is comprised of red, green, and blue light recording layer units generally further subdivided into individual layer sub-units comprised of two, three, four, or even five layers, and the element generally is additionally comprised of antihalation undercoat layers, interlayers, and surface overcoat layers. Additional layers can contribute usefully to realizing the objects of the invention, such as extending exposure latitude and reducing image granularity, but each individual layer also contributes some minimum thickness to the overall dry coated thickness of the element: typically from about 0.4 to about 2.0 micrometers per layer, depending on what it contains. While it is important to minimize the total coated dry thickness of the element, using more sub-unit layers in the color recording layer units, for example, that will inevitably increase the total thickness of the element, may still provide other useful benefits in accord with the object of the invention. Thus it is advantageous to account for this consequence of such advanced photographic recording material design by determining the average layer thickness, which is the total coated dry thickness of the photographic recording material applied to that one side of the support divided by the total number of coated layers, of which it is comprised. For the purposes of such accounting, support subbing layers, which add negligible material and which are applied to the support in preparatory stages preceding slide hopper multilayer coating, are not considered part of the total applied layer count. If an integral antihalation undercoat is present in the coated structure, then it would typically be the first layer, either followed by an interlayer separating that undercoat layer from the least sensitive red recording unit sublayer farthest from the surface of the coated film, or the next layer would be the least sensitive red recording sub-unit layer itself. The total number of coated layers for a color negative recording material of the invention is generally at least 10. Preferably, 13 layers are used. More preferably, 15 layers are employed to advantage in accord with the invention. Most preferably, 17 layers are used, and up to 20 layers are specifically contemplated. Generally the average layer thickness is about 1.5 micrometers; it is preferably about 1.4 micrometers. More preferably, the average layer thickness is about 1.3 micrometers, and a thickness of about 1.2 micrometers is even more preferred.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light. Preferably the emulsion is spectrally sensitized with two or more blue spectral sensitizing dyes to achieve the required absorption breadth of color matching function spectral sensitivity, which then mimics human visual sensitivity. Tabular emulsions are preferred for providing dyed blue spectral sensitivity. The emulsions in GU and RU are spectrally sensitized with green and red spectral sensitizing dyes, respectively, in all instances, since silver halide emulsions have no native sensitivity to green and/or red (minus blue) light.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. In their most widely used form tabular grain emulsions are high bromide {111} tabular grain emulsions. The major faces of the tabular grains can lie in either {111} or {100} crystal planes, however. The mean ECD of tabular grain emulsions rarely exceeds 10 micrometers and more typically is less than 5 micrometers. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; and 4,173,320; Daubendiek et al U.S. Pat. Nos. 4,414,310 and 4,914,014; Sowinski et al U.S. Pat. No. 4,656,122; Piggin et al U.S. Pat. Nos. 5,061,616 and 5,061,609; Tsaur et al U.S. Pat. Nos. 5,147,771; '772; '773; 5,171,659 and 5,252,453; Black et al U.S. Pat. Nos. 5,219,720 and 5,334,495; Delton U.S. Pat. Nos. 5,310,644; 5,372,927 and 5,460,934; Wen U.S. Pat. No. 5,470,698; Fenton et al U.S. Pat. No. 5,476,760; Eshelman et al U.S. Pat. Nos. 5,612,175 and 5,614,359; and Irving et al U.S. Pat. No. 5,667,954. Ultrathin high bromide {111} tabular grain emulsions, those with mean tabular grain thicknesses of less than 0.07 $\mu$m, are illustrated by Daubendiek et al U.S. Pat. Nos. 4,672,027; 4,693,964; 5,494,789; 5,503,971 and 5,576,168; Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot in U.S. Pat. Nos. 4,386,156 and 5,386,156. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). The green sensitive recording unit is preferably comprised of tabular grains with an aspect ratio of less than or equal to 15. The grains preferably form surface latent images so that they produce negative images when processed in a surface developer in color negative film forms of the invention. Particularly suitable tabular grain emulsions are disclosed in U.S. Pat. No. 5,164,292 to Johnson et al. Blended low and high aspect ratio emulsions are especially useful in blue light recording units, as shown in U.S. Pat. No. 4,865,964 to Newmiller. Useful arrangements of tabular grains in red, green, and blue light recording units according to specified grain dimensions are taught in U.S. Pat. No. 5,302,499 to Merrill et al, U.S. Pat. No. 5,275,929 to Buitano et al, and U.S. Pat. No. 5,795,706 to Ihama. The exposure of the silver halide grains may be usefully modified by the inclusion of soluble absorber dyes as shown in U.S. Pat. Nos. 5,395,744 and 5,466,560 to Sowinski et al, or by the inclusion of spatially fixed permanent absorber dyes as in U.S. Pat. No. 5,308,747 to Szajewski et al.

Additional illustrations of conventional radiation-sensitive silver halide emulsions are provided by *Research Disclosure*, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VI. Antifoggants and stabilizers. Additional antifoggants useful in the practice of the invention are disclosed in *Research Disclosure*, Item 24236, Fog-inhibiting compounds for use in silver halide photography, June 1984.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers.

It is desirable to employ organic compound incorporation methods that minimize the content of permanent high boiling oils in order to achieve one object of the invention, low average layer thickness. High boiling organic oils used as permanent diluents or coupler solvents for ballasted couplers or permanent dyes in the photographic aqueous gelatin dispersion making process are fillers contributing to total coated recording material dry thickness. Ballasted organic compounds can be dispersed using the oil-in-water method, by precipitation methods, as latex dispersions, or as solid particle dispersions. Conventional oil-in-water dispersions can be prepared using means well known in the art, wherein the ballasted compound is dissolved in a high vapor pressure organic solvent (for example, ethyl acetate), generally along with a low vapor pressure organic solvent (such as di-n-butyl phthalate or tricresyl phosphate, or more preferably, di-n-butyl sebacate), and then emulsified with an aqueous surfactant and gelatin solution. After emulsification, usually performed with a colloid mill, the high vapor pressure organic solvent is removed by evaporation or by washing, as is well known in the art. It is desirable to reduce or entirely omit the low vapor pressure, permanent coupler solvents, as taught for example in U.S. Pat. No. 5,585,230 to Zengerle et al, and in U.S. Pat. Nos. 5,726,003 and 5,834,175 to Zengerle et al, the disclosures of which are herein incorporated by reference. In other examples, U.S. Pat. No. 5,173,398 to Fukazawa et al and U.S. Pat. No. 5,770,352 to Chari disclose photographic elements with coupler-containing layers having substantially no high-boiling solvent, wherein the compounds are incorporated in the layer in the form of precipitated dispersions. Solid particle incorporation methods as illustrated by, for example, U.S. Pat. No. 5,468,598 to Miller et al and U.S. Pat. No. 5,657,931 to Nair et al, are also useful in the practice of the invention.

The color negative film intended for scanning is preferably comprised of little or no colored masking coupler as described in U.S. Pat. Nos. 5,698,379 and 5,840,470 to Bohan et al, and in U.S. Pat. No. 6,021,277 to Sowinski et al, the disclosures of which are herein incorporated by reference. Preferably the layer units are substantially free of colored masking coupler and contain less than 0.05 (most preferably less than 0.02) millimole/$m^2$ of masking coupler. In a preferred embodiment, contrary to conventional color negative film constructions, colored masking coupler is entirely absent from each of RU, GU and BU. Masking coupler is incorporated in a color negative intended for optical printing and performs a color correction step during chemical development. Elimination of the masking coupler provides improved signal-to-noise characteristics during chemical development and obviates the need to electronically counteract its effect. In like manner, the film preferably exhibits low levels of interlayer interimage effects overall, since electronic signal processing will be relied upon for color correction and image structure enhancement. Substantially free of colored masking coupler, the processed film may be better adapted for visual appearance and inspection, in addition for scanning, as described in U.S. Pat. No. 5,972,585 to Sowinski et al.

Development inhibitor releasing compound is incorporated in at least one and, preferably, two of the layer units in color negative film forms of the invention. When DIRs are used in two color recording layer units, it is preferred that the DIRs reside in the red and green recording units. More preferably, DIRs are employed judiciously in each of the red, green and blue recording layer units. DIR's are commonly employed to improve image sharpness and to tailor dye image characteristic curve shapes; DIR's can be helpful in achieving extended exposure latitude as well. The DIR's contemplated for incorporation in the color negative elements of the invention can release development inhibitor moieties directly or through intermediate linking or timing groups. The DIR's are contemplated to include those that employ anchimeric-releasing mechanisms. Illustrations of development inhibitor releasing couplers and other compounds useful in the color negative elements of this invention are provided by *Research Disclosure*, Item 38957, cited above, X. Dye image formers and modifiers, C. Image dye modifiers, particularly paragraphs (4) to (11). Preferred DIR's are disclosed in U.S. Pat. No. 6,190,847 to Sowinski et al, the disclosure of which is herein incorporated by reference.

It is common practice to coat one, two, three, or four separate emulsion sub-unit layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support. Triple coating, incorporating three separate emulsion layer sub-units within a layer unit, is a technique for facilitating extended exposure latitude, as illustrated by Chang et al in U.S. Pat. Nos. 5,314,793 and 5,360,703.

Oxidized developer scavenging compounds are most commonly employed in interlayers to prevent color contamination resulting from oxidized developer formed in one color-recording unit wandering into another unit and forming image dye falsely. Such scavenging compounds may also be usefully employed in the color recording units comprised of three or more sub-unit layers, as disclosed in U.S. Pat. Nos. 5,989,793 and 6,093,526 to Sowinski et al. Typically, oxidized developer scavengers reduce or eliminate oxidized developing agent without forming any permanent dyes that remain in the processed film and do not cause significant stains nor release fragments that have photographic activity. In addition, scavenging compounds are generally rendered substantially immobile by an anti-diffusion group (ballast) or by attachment to a polymer backbone to enable their incorporation into a particular layer within the photographic element while preventing their diffusion following application by coating and through the course of storage, exposure, processing, and drying. The scavenging compounds can be completely immobile or show limited mobility within the emulsion layer in which they are contained, but show insufficient mobility to permit any significant fraction of the scavenging compound to diffuse into adjacent layers prior to or during processing.

The most commonly employed scavengers are ballasted polyfunctionalized aromatic compounds containing multiple hydroxy, amino, and sulfonamido groups, and combinations thereof. Known scavengers include ballasted hydroquinone (1,4-dihydroxybenzene) compounds as described in U.S. Pat. Nos. 3,700,453 and 4,372,845; ballasted gallic acid (1,2,3-trihydroxybenzene) derivatives as described in U.S. Pat. No. 4,474,874, ballasted sulfonamidophenols as described in U.S. Pat. Nos. 4,205,987 and 4,447,523, ballasted resorcinol (1,3-dihydroxybenzene) described in U.S. Pat. No. 3,770,431, naptholic couplers which form a dye that is removed from the photographic recording material during color development and subsequent processing as described in Begley et al U.S. Pat. No. 5,932,407; and ballasted hydrazides as described in U.S. Pat. No. 4,923,787 and Harder et al U.S. Pat. No. 5,629,140. In addition, oxidized developing agent scavengers (antistain agents) suitable for the invention can be selected from among those disclosed by *Research Disclosure*, Item 38957, X. Dye image formers and modifiers, D. Hue modifiers/stabilization, paragraph (2).

The oxidized developer scavenging compound contemplated for incorporation in the color negative film of the invention are preferably ballasted hydrazides, ballasted sulfonamidophenols, or ballasted 1,4-dihydroxybenzene compounds. Useful forms of incorporation of oxidized developer scavenging compounds suitable for the invention as dispersed solid particles are described in Henzel et al U.S. Pat. No. 4,927,744, Brick et al U.S. Pat. No. 5,455,155; Brick et al U.S. Pat. No. 5,460,933, and Zengerle et al U.S. Pat. No. 5,360,702.

The photographic element may contain materials that accelerate or otherwise modify the tail end processing steps of bleaching or fixing to improve the quality of the image. The photographic recording material may be comprised of bleach accelerator releasing couplers such as those described in EP 193,389 and 301,477 and in U.S. Pat. Nos. 4,163,669; 4,865,956, and 4,923,784. Useful placement of thiol bleach accelerating agents in a triple-coated red color recording unit are disclosed in U.S. Pat. No. 5,500,330 to Szajewski et al.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developer scavenging agent. Antistain agents (oxidized developing scavenger compounds) can be selected from among those disclosed by *Research Disclosure*, Item 38957, X. Dye image formers and modifiers, D. Hue modifiers/stabilization, paragraph (2).

In another embodiment of the present invention, the color-recording units can be applied by coating directly adjacent to one another without interceding interlayers IL1 and IL2 to separate them. Since color signal processing will be carried out electronically following scanning of the developed image, cross-unit color contamination caused by oxidized developer generated in one color unit forming image dye in another unit is not of great concern, unlike with photographic recording materials intended for optical printing or direct viewing, since such processes can be accounted for by calibrations relating to the electronic signal processing color encoding scheme. It is preferred, however, to separate the color-recording units with thin interlayers of hydrophilic colloid such as gelatin. The interlayers preferably contain oxidized developer scavenging compounds, such as stationary, ballasted hydroquinones or other useful reducing agents.

When one or more silver halide emulsions in GU and RU are high bromide emulsions and, hence have significant native sensitivity to blue light, it is common practice to incorporate a yellow filter, such as Carey Lea silver or a yellow processing solution decolorizable dye, in IL1. Suitable yellow filter dyes can be selected from among those illustrated by *Research Disclosure*, Item 38957, VIII. Absorbing and scattering materials, B. Absorbing materials. There is no requirement for a yellow filter material to be present in IL1 or IL2. In elements of the instant invention, magenta colored filter materials can be present or absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure*, Item 38957, VIII. Absorbing materials. A common alternative location for AHU is between the support S and the recording layer unit coated nearest the support. When gray metallic silver is incorporated in AHU as the chromophore, it is preferred to separate RU and AHU with an interlayer to minimize fog.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1). It can be useful to subdivide the SOC unit into two or more layers to isolate oil-containing dispersions from the surface of the photographic recording material. Silver bromide Lippmann emulsion is commonly added to SOC layer or layers to minimize contamination of processing solutions with released development inhibitors, but there is no requirement for the presence of such sols in elements of the instant invention.

Instead of the layer unit sequence of element SCN-1, alternative layer units sequences can be employed and are particularly attractive for some emulsion choices. Using high chloride emulsions and/or thin (<0.2 micrometers mean grain thickness) tabular grain emulsions, all possible interchanges of the positions of BU, GU and RU can be undertaken without appreciable blue light exposure of the minus blue records, since these emulsions exhibit negligible native sensitivity in the visible spectrum. For the same reason, it is unnecessary to incorporate blue light absorbers in the interlayers, if blue light exposure is considered undesirable in light of electronic signal processing correction capabilities.

When a layer unit is comprised of two or more emulsion layers, the units can be divided into sub-units, each containing emulsion and coupler, that are interleaved with sub-units of one or both other layer units. The following elements are illustrative:

| Element SCN-2 | |
|---|---|
| SOC | Surface Overcoat |
| BU | Blue Recording Layer Unit |
| IL1 | First Interlayer |
| FGU | Fast Green Recording Layer Sub-Unit |
| IL2 | Second Interlayer |
| FRU | Fast Red Recording Layer Sub-Unit |
| IL3 | Third Interlayer |
| SGU | Slow Green Recording Layer Sub-Unit |
| IL4 | Fourth Interlayer |
| SRU | Slow Red Recording Layer Sub-Unit |
| AHU | Antihalation Layer Unit |
| S | Support |
| SOC | Surface Overcoat |

Except for the division of the green recording layer unit into fast and slow sub-units, FGU and SGU, and the red recording layer unit into fast and slow sub-units, FRU and SRU, in color negative film structure SCN-2, the constructions and construction alternatives are essentially similar to those previously described from element SCN-1. The placement of AHU relative to S and the sensitized layers can vary depending on the decolorizing characteristics of the density forming components incorporated in AHU and on the intended use of the element, all as known in the art. Elements employing multiple AHU layers positioned on both faces of S are specifically contemplated.

Color negative film structure SCN-3 is shown below. Except for the division of the blue recording layer units into fast, and slow sub-units, and the green, and red recording layer units into fast, mid, and slow sub-units in color negative film structure SCN-3, the constructions and construction alternatives are essentially similar to those previously described from element SCN-1.

While interleaved color negative film element structures are specifically contemplated in the practice of the invention, contiguous color recording unit sub-unit layers that are not interleaved are preferred since the number of interlayers is generally reduced and the dry film thickness is lower. When interleaved sub-unit layers are employed, it is preferred that the average layer thickness is about 1.3 micrometers or lower.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density, i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

| Element SCN-3 | |
|---|---|
| SOC | Surface Overcoat |
| FBU | Fast Blue Recording Layer Sub-Unit |
| IL1 | First Interlayer |
| FGU | Fast Green Recording Layer Sub-Unit |
| IL2 | Second Interlayer |
| FRU | Fast Red Recording Layer Sub-Unit |
| IL3 | Third Interlayer |
| SBU | Slow Blue Recording |
| IL4 | Fourth Interlayer |
| MGU | Mid Green Recording Layer Sub-Unit |
| IL5 | Fifth Interlayer |
| MRU | Mid Red Recording Layer Sub-Unit |
| IL6 | Sixth Interlayer |
| SGU | Slow Green Recording Layer Sub-Unit |
| IL7 | Seventh Interlayer |
| SRU | Slow Red Recording Layer Sub-Unit |
| AHU | Antihalation Layer Unit |
| S | Support |
| SOC | Surface Overcoat |

In the foregoing discussion the blue, green, and red recording layer units are described as containing yellow, magenta, and cyan image dye-forming couplers, respectively, as is conventional practice in color negative elements used for optical printing. In the color negative elements of the invention, which are intended for scanning to produce three separate electronic color records, the actual hue of the image dye produced is of no importance. What is essential is merely that the dye image produced in each of the layer units are differentiable from that produced by each of the remaining layer units. To provide this capability of differentiation, it is contemplated that each of the layer units contains one or more dye image-forming couplers chosen to produce image dye having an absorption half-peak bandwidth lying in a different spectral region. It is immaterial whether the blue, green, or red recording layer unit forms a yellow, magenta, or cyan dye having an absorption half peak bandwidth in the blue, green, or red region of the spectrum, as is conventional in a color negative element intended for use in printing, or an absorption half peak bandwidth in any other convenient region of the spectrum, ranging from the near ultraviolet (300–400 nm) through the visible and through the near infrared (700–1200 nm), so long as the absorption half peak bandwidths of the image dye in the layer units extend non-coextensive wavelength ranges. Preferably each image dye exhibits an absorption half-peak bandwidth that extends over at least a 25 (most preferably 50) nm spectral region that is not occupied by an absorption half-peak bandwidth of another image dye. Ideally the image dyes exhibit absorption half-peak bandwidths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half peak bandwidth that lies in a different spectral region than the dye images of the other emulsion layers of the layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. Nos. 5,314,794 and 5,389,506.

Each layer unit of the color negative elements of the invention produces a dye image characteristic curve gamma of less than 1.0, which facilitates obtaining an exposure latitude of at least 2.7 log E. Minimum acceptable exposure latitude of a multicolor photographic element is that which allows accurately recording the most extreme whites (e.g., a bride's wedding gown) and the most extreme blacks (e.g., a bridegroom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer, without compromise of the quality of the image data representing scene light levels. Even larger exposure latitudes such as about 3.5 log E are especially preferred, since the ability to obtain accurate image reproduction with larger exposure errors is realized. Whereas in color negative elements intended for optical printing, the visual attractiveness of the printed scene is often lost when gamma is exceptionally low, when color negative elements are scanned to create digital records of the dye image, contrast can be increased by adjustment of the electronic signal information. When the elements of the invention are scanned using a reflected beam, the beam travels through the layer units twice. This effectively doubles gamma ($\Delta D \div \Delta \log E$) by doubling changes in density ($\Delta D$). Gamma's of less than 1.0, or even less than about 0.7 are employed in the practice of the invention and exposure latitudes of up to about 5.0 log E or higher are feasible. Gamma's of about 0.6 are preferred, and gamma's of about 0.5 are highly preferred. Gamma's of between about 0.4 and 0.5 are especially preferred. The film can exhibit a minimal gamma after development processing, unlike a film intended for optical printing or direct viewing. The use of such low image dye gamma supports an objective of the invention of producing thin color recording unit sub-unit layers and low total dry thickness. The low gamma, especially when combined with the long latitude, ensures that the image densities formed are easily scanned without the introduction of background scanner electronic noise produced by scanning through high net density (about 2.0 density above the minimum density for which the scanner illumination is presumably adjusted). Image gamma's of about 0.2 are specifically contemplated. Certain methods of scanning allow an almost imperceptible image to be rendered into electronic image-bearing signals.

Elements having excellent light sensitivity are best employed in the practice of this invention. High sensitivity facilitates capture of scene light levels under poor lighting conditions of low illumination and when the scene subject is in motion, since high sensitivity permits the use of a faster shutter time on a camera to prevent motion blurring, and it also allows a higher f-stop setting to increase depth of field regardless of light level. Useful film speed depends camera system design features such as the film frame size and the required image magnification for printing or viewing, however, film formats, proper exposure determination, and image magnification is reviewed by Ray in *Camera Systems*, Focal Press, London, 1983. The speed, or sensitivity, manifested by a color negative photographic element is inversely related to the exposure required to produce a specified density above minimum density (D-min, relating to fog, stain, tint, base density, and so forth) after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically to the average of exposure levels required to produce a density of 0. 15 above D-min ("fog density") in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma of the density vs. log E (exposure) characteristic curve to a value of 0.65 before determining the speed in the defined manner, unless noted otherwise. The elements of the invention should have a sensitivity of at least about ISO 50, preferably have a sensitivity of at least about ISO 200, and more preferably have a sensitivity of at least about ISO 400 for 35-mm film format applications. Sensitivities of about ISO 400 to 800 are especially useful in one-time-use cameras (OTUCs) based on 35-mm format film, and equivalent threshold sensitivities of up to about ISO 3200 are specifically contemplated. In 24-mm film format applications, such as the in the Advanced Photographic System™ (APS) format, the element preferably has a sensitivity of at least about ISO 100, and more preferably about ISO 200. Sensitivities of about ISO 200 to 400 are especially useful in one-time-use cameras (OTUCs) based on 24-mm format film, and equivalent threshold sensitivities of up to about ISO 1600 are specifically contemplated.

The color photographic recording material of the invention can have individual layer units each sensitive to red, green or blue light, such as the film intended for scanning described in U.S. Pat. No. 6,190,847 to Sowinski et al. Alternatively, the film can have layer units sensitive to white light and to specific subsets of white light as described in U.S. Pat. No. 5,962,205 to Arakawa et al and U.S. Pat. No. 5,053,324 to Sasaki. While the layer units of a color film intended for scanning can be sensitized using any known color sensitization scheme, they are most preferably sensitized in a manner that approximates the sensitivity of the human eye, which allows the accurate recording of scene object light reflectances and which provides scene colorimetry. Since colorimetric light recording requires linear space signal processing, it is incompatible with traditional chemical image processing practiced by color negative films intended for optical printing and color reversal films intended for direct viewing, which has a logarithmic character. Colorimetric recording is a desirable trait of films intended for scanning and electronic image processing, because image data of known high color accuracy can be manipulated and amplified to a much greater level before color recording errors become objectionable, which in turn provides a larger range of possible output image appearances and improved scene renditions. A useful sensitization method, element and image-processing scheme for colorimetric capture is described in U.S. Pat. No. 5,582,961 to Giorgianni et al. More preferred spectral sensitizing dyes and methods for colorimetric recording emulsion sensitization are disclosed in U.S. Pat. Nos. 6,225,037, 6,093,526; and 6,251,578, and 6,143,482 to Buitano et al, the disclosures of which are herein incorporated by reference. Colorimetric-recording negative films especially useful in the practice of the invention are further described in U.S. Pat. No. 6,045,983 to Buitano et al, U.S. Pat. No. 6,146,818 to Gonzalez et al, and in U.S. Pat. No. 6,296,994 to Sowinski et al, the disclosures of which are herein incorporated by reference.

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of the light levels transmitted by an illuminated sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of say a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

When radically different selections of image dyes are employed, however, the use of Status M or Status A filter sets may have no distinct meaning. For example, if three differentiable infrared image dye-forming couplers were used with the red, green, and blue color recording units, then Status M densitometry of the imagewise exposed and developed photographic film may not reveal the formation of any dye images and incorrectly indicate no dye image gamma or visible spectral response by the element. With such radical departures in image dye selections, analytical densities, or reference printing densities, scanner densities, or channel independent image-bearing electronic signals derived from scanning can be used to accurately gauge the dye image gamma, gamma ratio, ISO speed, latitude and spectral response of the photographic element.

The wavelength of maximum sensitivity of the red recording emulsion layer unit falls between about 580 and 655 nm. In preferred embodiments, the red maximum sensitivity falls between about 580 and 625 nm. In more preferred forms the maximum sensitivity falls between about 580 and 605 nm and in most preferred forms, the red maximum sensitivity is below 600 nm. The wavelength of maximum sensitivity of the green recording emulsion layer unit falls between about 520 and 565 nm. In preferred embodiments, the green maximum sensitivity falls between about 520 and 550 nm. Increased green recording unit bandwidth and short green sensitivity are desirable features in the preferred practices of the invention. Thus the normalized or relative sensitivity of the green recording unit at 50% of the maximum sensitivity spans at least 65 nm. More preferably, this half peak bandwidth extends over at least 70 nm. Improved color accuracy is attributable to high hypsochromic or short green sensitivity. The relative sensitivity of the green recording unit at 520 nm is preferably at least 60% of the maximum sensitivity exhibited by the unit, and more preferably it is at least 70%.

In preferred forms of the invention, broad red sensitivity and hypsochromic or short red maximum red recording emulsion unit spectral response accompany the green spectral responsivities described above. Red recording emulsion layer unit relative response at 560 nm exceeds 10% of the maximum unit sensitivity, and more preferably it exceeds about 20%. Such high hypsochromic red recording unit sensitivity and high breadth of red response bridge the region of the spectrum between green and red and produce substantial overlap in the responsivities of the green and red recording layer units. In preferred forms of the invention, the relative sensitivities of the red and green recording layer units overlap between about 550 and 600 nm. More preferably, overlap occurs over the region spanning about 565 to 590 nm. The overlap generally exceeds at least about 10% of the maximum relative sensitivity of the red and green recording layer unit's linear space spectral response normalized to 100%, preferably it exceeds 35%. In more preferred embodiments, the point of overlap where the spectral sensitivities are equal exceeds at least 45% of the maximum relative sensitivity. Overlap points exceeding 55% are contemplated to minimize metameric color capture failure completely during calorimetric photographic recording.

It is preferred that all light sensitive silver halide emulsions in the color-recording unit have spectral sensitivity in the same region of the visible spectrum. In this embodiment, while all silver halide emulsions incorporated in the unit have the same spectral absorptance, it is expected that there are minor differences in spectral sensitivity between them due to the effects of light shielding of underlying layers by overlying layers. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

Image noise can be reduced, where the images are obtained by scanning exposed and processed color negative film elements, to obtain an electronic record of the image pattern suitable for transformations to improve image color reproduction and spatial image structure, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known optical printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color-recording units is less than about 1.3. In a more preferred embodiment, the red, green, and blue light sensitive color forming units each exhibit gamma ratios of less than about 1.2. In an even more preferred embodiment, the red and blue light sensitive color forming units each exhibit gamma ratios of less than about 1.10. In a most preferred embodiment, the red, green, and blue light sensitive color forming units each exhibit gamma ratios of less than about 1.1. In all cases, it is preferred that the individual color unit(s) exhibit gamma ratios of less than about 1.2, more preferred that they exhibit gamma ratios of less than about 1.1 and even more preferred that they exhibit gamma ratios of less than about 1.05. The gamma ratios of the layer units need not be equal. These low values of the gamma ratio are indicative of low levels of interlayer interaction, also known as interlayer interimage effects, between the layer units and are believed to account for improved quality of the images derived from films intended for scanning after processed film scanning and electronic signal processing.

Additionally, the color purity of the layer units should be maintained. Practically, this is achieved when the gamma ratios of the red, green, and blue color units are each greater than about 0.80, preferably greater than about 0.85, more preferably greater than about 0.90, and most preferably greater than about 0.95 so as to provide for adequate color separation during the overall image forming process. The minimum gamma ratio can be adjusted by selection of image couplers to be employed such that the unwanted absorptions of the dyes formed from such couplers during a development process are minimized. Many of the dye forming couplers originally employed in color photography are incapable of achieving this level of gamma ratio since their dye absorptances are excessively broad. Likewise, selection of the specific color developing agent can be a factor in adjusting the minimum gamma ratio. Non-imagewise formation of dyes during the development process are preferably limited or eliminated as, for example, by inclusion of interlayers having adequate quantities of oxidized developer scavengers and by the minimization of solution physical development. Further, adequate removal of non-imagewise densities as from retained silver or dyes from the element during processing enhances the color purity of the layer units.

The gamma ratios described are realized by limiting or excluding colored masking couplers from the elements of the invention intended for color negative development. They are also realized by proper selection of the type and level of DIR compounds included in the photographic recording material, which would be readily apparent to one skilled in the art. It is also recognized that the gamma ratios may be attained in other ways. In one concrete example, judicious choice and balancing of light sensitive emulsion halide content may be employed to minimize the gamma ratio by minimizing the interaction of individual color records during development. Emulsion iodide content may be particularly critical in this role. Selection of the quantity of emulsion to be employed in each light sensitive layer and the sensitization conditions employed may also be critical. Further, the use of so-called barrier layers which retard the flow of development inhibitors or of development by-products, such as halide ion, between layers so as to chemically isolate individual color recording units during development may also enable one to achieve this condition. In another concrete example, fine-grained, non-light sensitive silver halide (e.g., Lippmann emulsion sols) or silver particles (e.g., gray silver sols or Carey Lea silver sols) may be employed to isolate color recording layer units. In yet another concrete example, polymer-containing layers, including those described by Pearce et al in U.S. Pat. No. 5,254,441, may also be employed to isolate color-recording layers.

In a further concrete example, couplers and or non-coupling compounds, which decrease chemical interactions between color layers, may be advantageously employed in the practice of the invention to adjust gamma ratios. For example, U.S. Pat. No. 4,912,025 to Platt et al describes the release of electron transfer agents (ETAs) for development acceleration without a concomitant granularity and fog increase. These types of compounds are commonly referred to as electron transfer agent releasing couplers or ETARCs. More recently, U.S. Pat. No. 5,605,786 to Saito et al describes a method of imagewise release of an ETA. U.S. Pat. Nos. 5,972,584 and 5,932,399 to Tsoi et al describe the use of certain electron transfer agents contained in the developer solution or coated in the film. U.S. Pat. No. 6,020,112 to Twist describes the use of electron transfer agents in shortened processing times when utilized with high chloride silver halide emulsions. U.S. Pat. No. 5,830,627 to Nakai et al describes the use of a blocked electron transfer agent and a rapid processing cycle. When processed through a rapid developer containing a special additive, the electron transfer agent is released in a non-imagewise fashion and provides improved developability in the coated layer. ETAs or ETARCs are not required in the element or the development solutions of the invention. Other addendum chemicals especially useful in the practice of the invention are derived from nitrogen-containing heterocycles as described in U.S. Pat. No. 6,140,029 to Clark et al, the disclosure of which is herein incorporated by reference, and in Allway et al EP 1 016 902 A2, published Jul. 5, 2000.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure*, Item 38957, X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's, as well as dye image transfer systems in which they are incorporated, are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in dye image transfer systems. These and other image transfer systems compatible with the practice of the invention are disclosed in *Research Disclosure*, Vol. 176, December 1978, Item 17643, XXIII. Image transfer systems.

While the photographic elements of the invention are particularly useful with traditional and accelerated chemical development it is contemplated that they may be utilized with other development methods. One of the advantages of incorporating a color negative element in an image transfer system is that processing solution handling during photographic processing is not required. A common practice is to encapsulate a developer in a pod. When the image transfer unit containing the pod is passed between pressure rollers, developing agent is released from the pod and distributed over the uppermost processing solution permeable layer of the film, followed by diffusion into the recording layer units.

Similar release of developer is possible in color negative elements according to the invention intended to form only a retained dye image. Prompt scanning at a selected stage of development can obviate the need for subsequent processing. For example, it is specifically contemplated to scan the film as it passes a fixed point after passing between a set of pressure (optionally heated) rollers to distribute developing agent for contact with the recording layer units. If silver coating coverages are low, as is feasible with low maximum density images and, particularly, dye image amplification systems [illustrated by *Research Disclosure*, Item 38957, XVIII. Chemical development systems, B. Color-specific processing systems, paragraphs (5) through (7)], the neutral density of developed silver need not pose a significant impediment to the scanning retrieval of dye image information.

It is possible to minimize or even eliminate reliance on bringing a processing agent into contact with the recording layer units for achieving development by relying on heat to accelerate or initiate processing. Color negative elements according to the invention contemplated for processing by heat can be elements, such as those containing i) an oxidation-reduction image-forming combination, such as described by Sheppard et al U.S. Pat. No. 1,976,302; Sorensen et al U.S. Pat. No. 3,152,904; Morgan et al U.S. Pat. No. 3,846,136; ii) at least one silver halide developing agent and an alkaline material and/or alkali release material, as described in Stewart et al U.S. Pat. No. 3,312,550; Yutzy et al U.S. Pat. No. 3,392,020; or iii) a stabilizer or stabilizer precursor, as described in Humphlett et al U.S. Pat. No. 3,301,678; Haist et al U.S. Pat. No. 3,531,285; and Costa et al U.S. Pat. No. 3,874,946. These and other silver halide photothermographic imaging systems that are compatible with the practice of this invention are also described in greater detail in *Research Disclosure*, Vol. 170, June 1978, Item 17029. More recent illustrations of silver halide photothermographic imaging systems that are compatible with this invention are illustrated by Levy et al UK 2,318,645, published Apr. 29, 1998, and Japanese Kokai (published application) 98/0133325, published May 22, 1998, and Ishikawa et al EP 0 800 114 A2, published Oct. 8, 1997.

A number of modifications of color negative elements have been suggested for accommodating scanning, as illustrated by *Research Disclosure*, Item 38957, XIV. Scan facilitating features. These systems to the extent compatible with the color negative element constructions described above are contemplated for use in the practice of this invention. The retained silver and reflective (including fluorescent) interlayer constructions of paragraph (1) are not preferred. The features of paragraphs (2) and (3) are generally compatible with the preferred forms of the invention.

Light sensitive elements or films useful in the practice of this invention can be supplied in standard film cartridges, or patrones, or in thrust cartridges or cassettes, all as known in the art. Thrust cartridges are disclosed by U.S. Pat. No. 5,226,613 to Kataoka et al; U.S. Pat. No. 5,200,777 to Zander; U.S. Pat. No. 5,031,852 to Dowling et al; U.S. Pat. No. 5,003,334 to Pagano et al; and U.S. Pat. No. 4,834,306 to Robertson et al. These thrust cartridges can be employed in reloadable cameras designed specifically to accept them, in cameras fitted with an adapter designed to accept such film cassettes or in one-time-use cameras designed to accept them. Narrow-bodied one-time-use cameras suitable for employing thrust cartridges are described in U.S. Pat. No. 5,692,221 to Tobioka et al. While the film can be mounted in a one-time-use camera in any manner known in the art, it is especially preferred to mount the film in the one-time-use camera such that it is taken up on exposure by a thrust cartridge. Film supplied in a thrust cartridge can be supplied in any convenient width. Widths of about 24 mm as employed in the Advanced Photo System™ (APS) are contemplated as well as wider formats, such as 35 mm or even wider.

Photographic recording materials intended for scanning that are particularly useful in the practice of the invention can be prepared by coating light sensitive silver halide emulsion units on a support with magnetic recording capability. Magnetic recording layers on film permit the encoding of information with specific images or with the entire film roll, and they are described in *Research Disclosure* Item 38957, pages 626–627 (September 1996) Section XIV Scan facilitating features paragraph (2). Information useful in the practice of the invention can be exchanged between the film and the camera, the film manufacturer and the photofinisher, the customer and the film manufacturer, and so forth, as disclosed in U.S. Pat. No. 5,229,810 to Cloutier et al; U.S. Pat. No. 4,987,439 to Cloutier; U.S. Pat. No. 5,027,140 to Cloutier; U.S. Pat. No. 5,130,745 to Cloutier et al; U.S. Pat. No. 5,021,820 to Robison et al; U.S. Pat. No. 4,965,626 to Robison et al; U.S. Pat. No. 4,974,096 to Wash; U.S. Pat. No. 5,204,708 to Whitfield et al; U.S. Pat. No. 5,029,3113 to Robison et al; U.S. Pat. No. 5,006,873 to Wash; U.S. Pat. Nos. 5,194,892 and 5,025,283 to Robison; U.S. Pat. No. 5,726,737 to Fredlund et al; and U.S. Pat. Nos. 5,276,472 and 5,609,403 to Bell et al.

The film element intended for scanning according to the invention can be employed in any one-time-use camera known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman U.S. Pat. No. 4,226,517; providing apparatus for automatic exposure control as described at Matterson et al, U S. Pat. No. 4,345,835; moisture-proofing as described at Fujimura et al U.S. Pat. No. 4,766,451; providing internal and external film casings as described at Ohmura et al U.S. Pat. No. 4,751,536; providing means for recording use conditions on the film as described at Taniguchi et al U.S. Pat. No. 4,780,735; providing lens fitted cameras as described at Arai U.S. Pat. No. 4,804,987; providing film supports with superior anti-curl properties as described at Sasaki et al U.S. Pat. No. 4,827,298; providing a viewfinder as described at Ohmura et al U.S. Pat. No. 4,812,863; providing a lens of defined focal length and lens speed as described at Ushiro et al U.S. Pat. No. 4,812,866, providing multiple film containers as described at Nakayama et al U.S. Pat. No. 4,831,398 and at Ohmura et al U.S. Pat. No. 4,833,495; providing films with improved anti-friction characteristics as described at Shiba U.S. Pat. No. 4,866,469; providing winding mechanisms, rotating spools, or resilient sleeves as described at Mochida U.S. Pat. No. 4,884,087; providing a film patrone or cartridge removable in an axial direction as described by Takei et al at U.S. Pat. Nos. 4,890,130 and 5,063,400, providing an electronic flash means as described at Ohmura et al U.S. Pat. No. 4,896,178, providing an externally operable member for effecting exposure as described at Mochida et al U.S. Pat. No. 4,954,857; providing film support with modified sprocket holes and means for advancing said film as described at Murakami U.S. Pat. No. 5,049,908, providing internal mirrors as described at Hara U.S. Pat. No. 5,084,719; and providing silver halide emulsions suitable for use on tightly wound spools as described at Yagi et al European Patent Application 0 466 417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613, by Zander U.S. Pat. No. 5,200,777, by Dowling et al U.S. Pat. No. 5,031,852, and by Robertson et al U.S. Pat. No. 4,834,306. Narrow bodied one-time-use cameras suitable for employing thrust cartridges in this way are described by Tobioka et al U.S. Pat. No. 5,692,221. More generally, the size limited cameras most useful as one-time-use cameras will be generally rectangular in shape and can meet the requirements of easy handling and transportability in, for example, a pocket, when the camera as described herein has a limited volume. The camera should have a total volume of less than about 450 cubic centimeters (cc's), preferably less than 380 cc, more preferably less than 300 cc, and most preferably less than 220 cc. The depth-to-height-to-length proportions of such a camera will generally be in an about 1:2:4 ratio, with a range in each of about 25% so as to provide comfortable handling and pocketability. Generally the minimum usable depth is set by the focal length of the incorporated lens and by the dimensions of the incorporated film spools and cartridge. The camera will preferably have the majority of corners and edges finished with a radius-of-curvature of between about 0.2 and 3 centimeters. The use of thrust cartridges allows a particular advantage in this invention by providing easy scanner access to particular scenes photographed on a roll while protecting the film from dust, scratches, and abrasion, all of which tend to degrade the quality of an image.

While any known taking lens may be employed in the cameras of this invention, the taking lens mounted on the single-use cameras of the invention are preferably single aspherical plastic lenses. The lenses will have a focal length between about 10 and 100 mm, and a lens aperture between f/2 and f/32. The focal length is preferably between about 15 and 60 mm and most preferably between about 20 and 40 mm. For pictorial applications, a focal length matching to within 25% the diagonal of the rectangular film exposure area is preferred. Lens apertures of between f/2.8 and f/22 are contemplated with a lens aperture of about f/4 to f/16 being preferred. The lens MTF can be as low as 0.6 or less at a spatial frequency of 20 lines per millimeter (1 pm) at the film plane, although values as high as 0.7 or most preferably 0.8 or more are contemplated. Higher lens MTF values generally allow sharper pictures to be produced. Multiple lens arrangements comprising two, three, or more component lens elements consistent with the functions described above are specifically contemplated.

The camera enables exposure of image areas on the film of less than about 10 $cm^2$. Even smaller exposure areas can be employed with values of less than 9, 8, or 7 $cm^2$ being preferred. Especially preferred are exposure areas of 5 $cm^2$ or less. These exposed areas will typically have an image aspect ratio of between 1:1 and 4:1. Classic aspect ratios of about 1.4:1 and 1.5:1 are preferred as are High Definition Television aspect ratios of about 1.8:1 and panoramic aspect ratios of about 2.8:1. The camera provides means for exposing more than one scene per unit of film, with arrangements enabling the exposure of 6, 10, 12, 24, 27, 36 or even more distinct scenes being especially preferred. The camera can be arranged to provide the user with mixed aspect ratio scene images on the same roll.

The shutter employed with the camera allows an exposure time of less than about 1/60 second so as to minimize sharpness losses due to shake inherent with hand held cameras. Shutter times of less than 1/100 sec are preferred, while even shorter shutter times are most preferred.

The elements of the invention are typically exposed to suitable actinic radiation to form a latent image and then processed to form a visible or scanable dye image. Processing includes the step of color development in the presence of a color developing agent to reduce developable silver halide and to oxidize the color developing agent. Oxidized color developing agent in turn reacts with an image dye-forming coupler to yield a visible or scanable dye.

Satisfactory conventional color processing methods using conventional processing components, providing both color negative and color reversal images, are well known as described, for example, in *Research Disclosure* publication 308119, December 1989; publication 17643, December 1978; and publication 38957, September 1996. Generally film elements intended for scanning according to the invention use the KODAK FLEXICOLOR™ Process or C-41 Process, as described by *The British Journal of Photography Annual* of 1988, pp. 196–198. Another description of the use of the FLEXICOLOR™ Process is provided by *Using Kodak Flexicolor Chemicals*, Kodak Publication No. Z-131, Eastman Kodak Company, Rochester, N.Y. Color developing compositions and processing conditions useful in rapid color development are disclosed, for example, in U.S. Pat. No. 5,118,591 to Koboshi et al; U.S. Pat. No. 5,344,750 to Fujimoto et al; U.S. Pat. No. 5,455,146 Nishikawa et al; U.S. Pat. No. 5,753,424 to Ishikawa et al; U.S. Pat. No. 5,827,635 to Cole; and U.S. Pat. No. 5,922,519 to Ishikawa et al. It is preferred to use a full color process with bleaching and fixing steps to provide color negatives intended for scanning that are free of retained silver metal and silver halide in order to improve scanning quality, but the invention can be practiced with any scanable, processed photographic recording material bearing an image.

In one suitable embodiment the films intended for scanning are color developed according to a method of the invention herein using a color developer solution having a pH of from about 9 to about 12.5, preferably from about 9.5 to about 11.0. The color developer includes one or more suitable color developing agents, in an amount of from about 0.01 to about 0.1 mol/l, and preferably at from about 0.03 to about 0.07 mol/l. Such color developing agents include, but are not limited to, aminophenols, p-phenylenediamines (especially N,N-dialkyl-p-phenylenediamines) and others which are well known in the art, such as EP 0 434 097 A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure*, publication 38957, pages 592–639 (September 1996). Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. An especially preferred developing agent is 4-(N-ethyl-N-β-hydroxyethylamino)-2-methylaniline sulfate (KODAK Color Developing Agent CD-4).

In order to protect color developing agents from oxidation, one or more antioxidants are generally included. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in U.S. Pat. No. 6,077,653 to McGarry et al. Mixtures of compounds from the same or different classes of antioxidants can also be used if desired. Hydroxylamine or hydroxylamine derivatives are preferred. In one preferred embodiment sulfite ion is contained in the developer at a concentration of 0.00 to 0.25 moles per liter of developer.

Especially useful antioxidants are hydroxylamine derivatives as described for example, in U.S. Pat. No. 4,892,804 to Vincent et al, U.S. Pat. No. 4,876,174 to Ishikawa et al, U.S. Pat. No. 5,354,646 to Kobayashi et al, U.S. Pat. No. 5,660,974 to Marrese et al, and U.S. Pat. No. 5,646,327 to Burns et al, the disclosures of which are incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. One useful hydroxylamine antioxidant is N,N-diethylhydroxylamine.

In other embodiments, the noted hydroxylamine derivatives can be mono- or dialkylhydroxylamines having one or more hydroxy substituents on the one or more alkyl groups. Representative compounds of this type are described, for example, in U.S. Pat. No. 5,709,982 to Marrese et al, incorporated herein by reference.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine.

Antioxidants particularly useful in the practice are represented by the formula:

R—L—N(OH)—L'—R' wherein L and L' are independently substituted or unsubstituted alkylene of 1 to 8 carbon atoms (such as methylene, ethylene, n-propylene, isopropylene, n-butylene, 1,1-dimethylethylene, n-hexylene, n-octylene, and sec-butylene), or substituted or unsubstituted alkylenephenylene of 1 to 3 carbon atoms in the alkylene portion (such as benzylene, dimethylenephenylene, and isopropylenephenylene). The organic antioxidant described herein is included in the color developer composition useful in this invention in a preferred amount of from about 0.00 to about 0.5 mol/l. A most preferred amount is from about 0.00 to about 0.05 mol/l. More than one organic antioxidant can be used in the same color developer composition if desired, but preferably only one is used.

It may be desirable to include a chemical base in the color developing composition. Particularly useful chemical bases include inorganic bases such as alkali metal or ammonium hydroxides (for example, sodium hydroxide or potassium hydroxide). Other useful chemical bases are alcoholamines (such as triethanolamine and diethanolamine).

Another component of the color developing composition can be one or more triazinylstilbene optical brightening agents. In some publications, triazinylstilbenes are identified as "triazylstilbenes". Preferably, the useful triazinylstilbenes are water-soluble or water-dispersible. Representative compounds are shown in U.S. Pat. No. 4,232,112 to Kuse, U.S. Pat. No. 4,587,195 to Ishikawa et al, U.S. Pat. No. 4,900,651 to Ishikawa et al, and U.S. Pat. No. 5,043,253 to Ishakawa, all incorporated herein by reference with respect to such compounds. The most preferred triazinylstilbene compounds (and isomers thereof) include the following Compounds A and B:

A

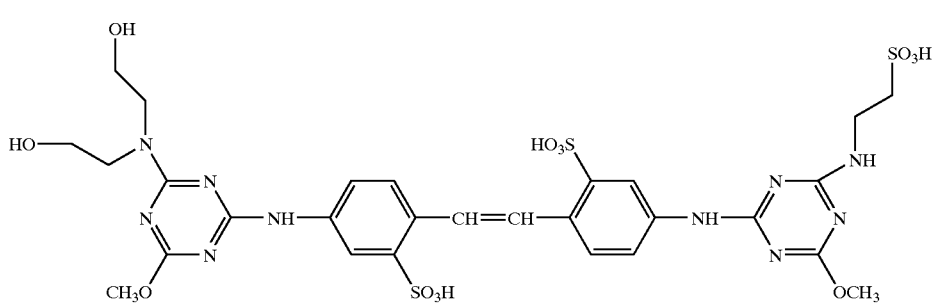

B

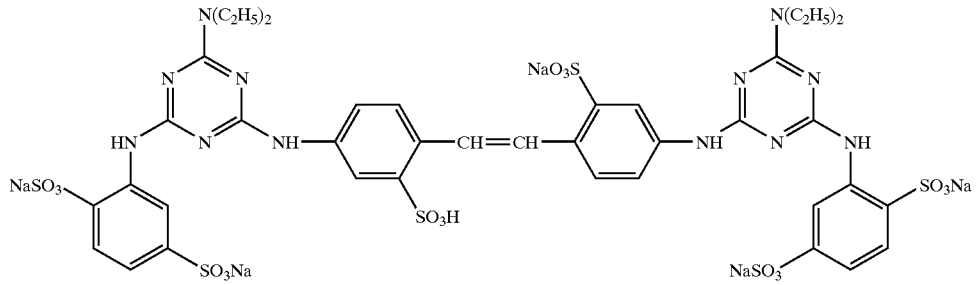

Compound A is commercially available as BLANKOPHOR REU from Bayer.

Compound B is commercially available as TINOPAL SFP from Ciba.

One or more buffering agents are generally present in the color developing compositions to provide or maintain desired alkaline pH. Normally the buffering agent is utilized at a concentration of about 0.08 to about 0.5 moles per liter of developer solution. These buffering agents generally have a pKa of from about 9 to about 13. Such useful buffering agents include, but are not limited to carbonates, borates, tetraborates, glycine salts, triethanolamine, diethanolamine, phosphates and hydroxybenzoates. Preferred are borates, carbonates and phosphates. Particularly preferred are alkali metal carbonates such as sodium carbonate, sodium bicarbonate, potassium hydrogen carbonate and potassium carbonate. Mixtures of buffering agents can be used if desired.

Polycarboxylic acid or phosphonic acid metal ion sequestering agents are useful in the color developing composition. Such materials are well known in the art and are described, for example, in U.S. Pat. No. 4,596,765 to Kurematsu et al and *Research Disclosure* publications 13410 (June 1975), 18837 (December 1979) and 20405 (April 1981). Useful sequestering agents are readily available from a number of commercial sources. Particularly useful phosphonic acids are the diphosphonic acids (and salts thereof and polyaminopolyphosphonic acids (and salts thereof). Useful diphosphonic acids include hydroxyalkylidene diphosphonic acids, aminodiphosphonic acids, amino-N,N-dimethylenephosphonic acids, and N-acyl aminodiphosphonic acids.

One useful class of diphosphonic acids includes hydroxyalkylidene diphosphonic acids (or salts thereof). Mixtures of such compounds can be used if desired. Useful salts include the ammonium and alkali metal ion salts. Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is available as DEQUEST™ 2010. Its tetrasodium salt is available as DEQUEST™ 2016D. Both materials are available from Solutia Co. Another useful disphosphonic acid is morpholinomethanediphosphonic acid or a salt thereof. A mixture of one or more diphosphonic acids can be used in the color developing composition of this invention if desired, in any desirable proportions.

Another useful sequestering agent is a polyaminopolyphosphonic acid (or salt thereof) that has at least five phosphonic acid (or salt) groups. A mixture of such compounds can be used if desired. Suitable salts include ammonium and alkali metal (for example, sodium and potassium) ion salts. A particularly useful sequestering agent of this type is diethylene-triaminepentamethylenephosphonic acid or an alkali metal salt thereof (available as DEQUEST™ 2066 from Solutia Co.).

It is also possible to include other metal ion sequestering agents (for example, for iron, copper or manganese ion sequestration) in the color developing composition. The composition can also include one or more of a variety of other addenda that are commonly used in photographic color developing compositions, including alkali metal halides (such as potassium chloride, potassium bromide, potassium iodide, sodium chloride, sodium bromide and sodium iodide), auxiliary co-developing agents (such as phenidone type compounds particularly for black and white developing compositions), antifoggants, development accelerators, wetting agents, fragrances, stain reducing agents, surfactants, defoaming agents, and water-soluble or water-dispersible color dye forming couplers, as would be readily understood by one skilled in the art (see, for example, the *Research Disclosure* publications noted above). The amounts of such additives would be well known to a skilled artisan. In one embodiment the developer contains substantially no iodide ion. In another suitable embodiment the developer may also contain a water soluble pyrrolidone polymer, preferably at a concentration of 1.0 to 10.0 grams per liter of developer solution. The pyrrolidone polymer component in the developing solution of the invention can be provided by adding to the solution any water soluble pyrrolidone polymer (which can be either a homopolymer or a co-polymer) in the required concentration. An example of such a polymer is a commercially available poly(vinyl pyrrolidone) K-15 provided by International Specialty Products Co. having a weight average molecular weight of 12,000. A more preferred concentration is 1.0 to 5.0 grams per liter for poly (vinyl pyrrolidone), in particular.

Bromide ion may be included in the color developer in a concentration of less than about 0.06 mol/l, and preferably less than about 0.015 mol/l. Bromide ion can be provided in any suitable salt such as sodium bromide, lithium bromide, potassium bromide or ammonium bromide. The above amounts are bromide ion which is intentionally added to the developer and not to bromide ion which seasons out of the photographic element.

Development according to the invention is carried out by contacting the element for up to about 90 seconds, preferably for up to about 60 seconds, more preferably for up to about 20 seconds, at a temperature about 40° C. or greater, and generally at from about 45 to 60° C., and preferably at from about 45° C. to about 50° C. with a color developing solution in suitable processing equipment, to produce the desired developed image.

Exemplary color developing compositions and components are described, for example, in U.S. application Ser. No. 09/706,006 of Arcus et al, U.S. application Ser. No. 09/706,463 of Haye et al, and U.S. application Ser. No. 09/706,474 of Arcus et al, all filed Nov. 3, 2000, all incorporated herein for their teaching about color developing compositions.

Optionally but preferably, partial or total removal of silver and/or silver halide is accomplished after color development using conventional bleaching and fixing solutions (i.e., partial or complete desilvering steps), or fixing only to yield both a dye and silver image. Alternatively, all of the silver and silver halide can be left in the color developed element. One or more conventional washing, rinsing, or stabilizing steps can also be used as is known in the art. These steps are typically carried out before scanning and digital manipulation of the density representative signals.

Color image formation in various color photographic materials require certain essential photochemicals including a color developing agent, bleaching agent and fixing agent. Other useful photochemicals may be needed for various processing methods including, but are not limited to, black-and-white developing agents, co-developing agents, dye stabilizing agents, fixing accelerators, bleaching accelerators, antifoggants, fogging agents and development accelerators. In other instances, the photochemicals may provide a physical benefit such as reduced scumming, reduced crystal growth on processing equipment, reduced sludge, reduced film residue or spotting, storage stability and reduced biogrowth. Examples of such photochemicals include, but are not limited to, surfactants, antioxidants, crystal growth inhibitors and biocides.

The overall processing time (from development to final rinse or wash) can be from about 20 seconds to about 20 minutes. Shorter overall processing times, that is, less than about 8 minutes, are desired for processing photographic color negative films according to this invention.

Processing according to the present invention can be carried out using conventional deep tanks holding processing solutions or automatic processing machines.

Alternatively, it can be carried out using what is known in the art as "low volume thin tank" processing systems, or LVTT, which have either a rack and tank or automatic tray design. Such processing methods and equipment are described, for example, by Carli et al in U.S. Pat. No. 5,436,118 and publications noted therein. Processing of the films can also be carried out using the method and apparatus designed for processing a film in a cartridge, as described, for example, by Pagano et al in U.S. Pat. No. 5,543,882. Processing can also be carried out in minilabs.

Processing according to the present invention can be carried out using less conventional processors such as those described in U. S. Pat. Nos. 5,864,729; 5,890,028; or 5,960,227; a drum processor such as the KODAK RS-11 Drum Processor; or the wave processor described in U.S. application Ser. No. 09/920,495, filed Aug. 1, 2001, the disclosure of which is incorporated herein by reference. This is a small processor that uses small volumes of processing solutions once to process photographic recording material. It processes the material with only a few milliliters of processing solution, which is then collected as waste. This processor processes a photographic material by loading the material into a chamber, introducing a metered amount of processing solution into the chamber, and rotating the chamber in a fashion which forms a wave in the solution through which the material passes, the whole volume of solution for a given stage being spread over the whole material area in a repetitive manner to enable uniform processing. The appropriate solution for each processing stage is added and removed sequentially from the processing space.

Another processor and processing method with which the current invention is particularly useful is the merged process described in U.S. application Ser. No. 10/012,673 of Twist, "Processing Photographic Material" filed on Oct. 30, 2001, the disclosure of which is incorporated herein by reference. This processing method for silver halide photographic material comprises loading the material into a chamber, introducing a metered amount of a first processing solution into the chamber, and processing the photographic material with the first processing solution. It then comprises introducing a metered amount of a second processing solution into the chamber without removing the first processing solution so that at least part of the whole volume of the second processing solution is provided by the first processing solution and processing the photographic material with the second processing solution. The merged method further comprises, after processing the photographic material with the second processing solution, introducing a metered amount of a third processing solution into the chamber without removing any processing solution remaining from the preceding processing solution or solutions so that at least part of the total volume of the third processing solution is provided by the preceding processing solution or solutions and processing the photographic material with the third processing solution.

Besides the component chemistry of the developer, the agitation and the mode of contact of the developer to the film can change the rapidity of development. Typically, increasing agitation increases the rate of development since more developer enters the swollen film to replenish material being consumed and more development by-products) are removed from the film, which would often otherwise retard development (e.g., development inhibitors, such as bromide and iodide ions). Film agitation can involve one or more of the following actions: film movement through the developer, gas bubbles, mechanical agitation, pumping, streaming, jetting, rollers, wipers, ultrasonics, pads, dip-and-dunk, etc. The developer solutions can be replenished, as in a minilab or deeptank processor, or can be single use, such as the above described rotating chamber and the small, hand-held Nicor reels and tanks.

The steps of color development, bleaching, fixing (or bleach-fixing), and optionally a dye-stabilizing step are generally understood from the conventional Process C-41 processing method for color negative films. In addition, obtaining color images from silver halide color papers can be achieved using the conventional KODAK EKTACOLOR™ RA-4 Process steps of color development and bleaching and fixing, or also bleach-fixing. For motion picture applications, the element is preferably coated on a cellulose triacetate support that employs a Remjet carbon dispersion on the opposite side of the base for its antistatic and movie camera transport properties; the antihalation undercoat layer is not required on the emulsion side of the support in that instance. The Remjet carbon dispersion is removed in the tail end processing. Such elements are conventionally processed in the KODAK ECN-2 Process, employing about 3 minutes of development time, however the rapid development method of the invention is highly suitable for use with such films. All of these steps and the conventional components of the processing compositions are well known, as described for example, in *Research Disclosure* publications 308119, December 1989; publication 17643, December 1978; and publication 38957, September 1996. Some additional details are provided below in describing such compositions, but additional details can be supplied from the many publications listed in the noted *Research Disclosure* publication.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid (EDTA), propylenediaminetetraacetic acid (PDTA), and others described in *Research Disclosure* publication 38957 noted above, U.S. Pat. No. 5,582,958 to Buchanan et al and U.S. Pat. No. 5,753,423 to Buongiorne et al. Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532 003, and ethylenediamine monosuccinic acid and similar compounds as described in U.S. Pat. No. 5,691,120 to Wilson et al. Particularly useful bleaching agents are ferric ion complexes of one or more of ethylenediaminetetraacetic acid (EDTA), ethylenediaminedisuccinic acid (EDDS, particularly the S,S-isomer), methyliminodiacetic acid (MIDA) or other iminodiacetic acids, β-alaninediacetic acid (ADA), ethylenediamine-monosuccinic acid (EDMS), 1,3-propylenediaminetetraacetic acid (PDTA), nitrilotriacetic acid (NTA), and 2,6-pyridinedicarboxylic acid (PDCA). Multiple bleaching agents can be present if desired.

These and many other such complexing ligands known in the art including those described in U.S. Pat. No. 4,839,262 (Schwartz), U.S. Pat. No. 4,921,779 (Cullinan et al), U.S. Pat. No. 5,037,725 (noted above), U.S. Pat. Nos. 5,061,608 and 5,334,491 (Foster et al), U.S. Pat. No. 5,523,195 (Darmon et al), U.S. Pat. No. 5,582,958 (Buchanan et al), U.S. Pat. No. 5,552,264 (noted above), U.S. Pat. No. 5,652, 087 (Craver et al), U.S. Pat. No. 5,928,844 (Feeney et al), U.S. Pat. No. 5,652,085 (Wilson et al), U.S. Pat. No. 5,693,456 (Foster et al), U.S. Pat. No. 5,834,170 (Craver et al), and U.S. Pat. No. 5,585,226 (Strickland et al), all incorporated herein by reference for their teaching of bleaching compositions.

Other components of the bleaching solution include buffers, halides, corrosion inhibiting agents, and metal ion sequestering agents. These and other components and conventional amounts are described in the references in the preceding paragraph. The pH of the bleaching composition is generally from about 4 to about 6.5.

Useful fixing agents for photographic fixing compositions are well known. Examples of photographic fixing agents include, but are not limited to, thiosulfates (for example, sodium thiosulfate, potassium thiosulfate and ammonium thiosulfate), thiocyanates (for example, sodium thiocyanate, potassium thiocyanate and ammonium thiocyanate), thioethers (such as ethylenebisthioglycolic acid and 3,6-dithia-1, 8-octanediol), imides and thiourea. Thiosulfates and thiocyanates are preferred, and thiosulfates are more preferred. Ammonium thiosulfate is most preferred.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al), incorporated herein for the teaching of fixing compositions. The use of thiocyanate as a fixer accelerator for promoting rapid clearing is disclosed in U.S. Pat. No. 6,022,676 (Schmittou et al) and also is herein incorporated by reference.

The fixing compositions can contain one or more monovalent or divalent cations supplied by various salts used for various purposes (for example, salts of fixing agents). It is preferred that the cations be predominantly ammonium cations, that is, at least 50% of the total cations are ammonium ions.

The fixing compositions can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art.

The desired pH of the fixing compositions is 8 or less, and can be achieved and maintained using any useful combination of acids and bases, as well as various buffers.

Other details of fixing compositions not explicitly described herein are considered well known in the art, and are described for example, in *Research Disclosure* publication 38957 (noted below), and publications noted therein in paragraph XX(B), and U.S. Pat. No. 5,424,176 (Schmittou et al), U.S. Pat. No. 4,839,262 (noted above), U.S. Pat. No. 4,921,779 (noted above), U.S. Pat. No. 5,037,725 (noted above), U.S. Pat. No. 5,523,195 (noted above), and U.S. Pat. No. 5,552,264 (noted above), all incorporated herein by reference for their teaching of fixing compositions.

Another photographic processing composition that may be useful is a dye stabilizing composition containing one or more photographic imaging dye stabilizing compounds. Such compositions can be used at the end of the processing sequence (such as for color negative films and color papers), or in another part of the processing sequence (such as between color development and bleaching as a pre-bleaching composition).

Such dye stabilizing compositions generally have a pH of from about 5.5 to about 8, and include a dye stabilization compound (such as an alkali metal formaldehyde bisulfite, hexamethylenetetramine, various benzaldehyde compounds, and various other formaldehyde releasing compounds), buffering agents, bleach-accelerating compounds, secondary amines, preservatives, and metal sequestering agents. All of these compounds and useful amounts are well known in the art, including U.S. Pat. No. 4,839,262 (Schwartz), U.S. Pat. No. 4,921,779 (noted above), U.S. Pat. No. 5,037,725 (noted above), U.S. Pat. No. 5,523,195 (noted above) and U.S. Pat. No. 5,552,264 (noted above), all incorporated herein by reference for their teaching of dye stabilizing compositions.

A preferred dye-stabilizing composition includes sodium formaldehyde bisulfite as a dye stabilizing compound, and thioglycerol as a bleach-accelerating compound. This composition can also be used as a pre-bleaching composition during the processing of color reversal photographic materials.

In some processing methods, a dye stabilizing composition or final rinsing composition is used to clean the processed photographic material as well as to stabilize the color image. Either type of composition generally includes one or more anionic, nonionic, cationic or amphoteric surfactants, and in the case of dye stabilizing compositions, one or more dye stabilizing compounds as described above. Particularly useful dye stabilizing compounds useful in these dye stabilizing compositions are described, for example, in EP-A-0 530 832 (Koma et al) and U.S. Pat. No. 5,968,716 (McGuckin et al). Other components and their amounts for both dye stabilizing and final rinsing compositions are described in U.S. Pat. No. 5,952,158 (McGuckin et al), U.S. Pat. No. 3,545,970 (Giorgianni et al), U.S. Pat. No. 3,676,136 (Mowrey), U.S. Pat. No. 4,786,583 (Schwartz), U.S. Pat. No. 5,529,890 (McGuckin et al), U.S. Pat. No. 5,578,432 (McGuckin et al), U.S. Pat. No. 5,534,396 (noted above), U.S. Pat. No. 5,645,980 (McGuckin et al), U.S. Pat. No. 5,667,948 (McGuckin et al), U.S. Pat. No. 5,750,322 (McGuckin et al) and U.S. Pat. No. 5,716,765 (McGuckin et al), all of which are incorporated herein by reference for their teaching of such compositions.

The film intended for scanning is chemically processed to produce a scanable image. In one embodiment of the invention, a complete color process is carried out to provide a normal appearing, fully processed color negative film. In another embodiment of the invention, the chemical processing can be accelerated; the omission of some or all tail-end processing steps such as washing is specifically contemplated. In yet another embodiment of the invention, the chemical processing can be limited to only a development step. In one embodiment the color developed image is at least partially fixed, and in another embodiment it is at least partially bleached. A color photographic silver halide material comprised of a blocked but releasable photochemical (such as a blocked but releasable color developing agent) can be processed and used with the present invention. Such a material is disclosed, for example, in U.S. Pat. No. 6,242,166 of Irving et al. The apparatus can be employed to process film in a freestanding customer accessible kiosk as described in EP-A-0 234 833 (published on Sep. 2, 1987), U.S. Pat. No. 5,113,351 to Bostic, U.S. Pat. No. 5,627,016 to Manico, and U.S. Pat. No. 5,664,253 to Meyers. Color processing satisfying the requirements of the invention can also be accomplished by lamination methods, such as illustrated by U.S. Pat. No. 5,756,269 to Ishikawa et al, U.S. Pat.

No. 6,022,673 to Ishikawa, U.S. Pat. No. 6,030,755 to Matsumoto et al, and U.S. Pat. No. 6,296,993 to Sowinski et al. Aerial deposition development methods associated with so-called electronic film development as described in U.S. Pat. Nos. 5,988,896 and 6,017,688 to Edgar are also specifically contemplated, since such methods can be expected to perform especially well with films intended for scanning using developer solutions suitable for accelerated development. EP-A 1 107 058 A2 to Ishikawa (published Jun. 13, 2001) discloses related suitable methods of accelerated development of photographic recording materials according to the invention, subsequently followed by scanning and image data acquisition. Where photographic recording materials of very different processing responses are processed in a digital photofinishing system, application of appropriate corrections associated with the particular film element types in that process during electronic signal processing is usefully signaled by an encodement on the film or its container, as disclosed in U.S. Pat. No. 6,222,607 to Szajewski et al.

Once distinguishable images of one or more color records have been formed in the processed photographic materials, conventional techniques can be employed for retrieving the image information for each color record and manipulating the record for subsequent creation of a color-balanced, viewable image. As the element is scanned pixel-by-pixel using an array detector, such as an array CCD, or line-by-line using a linear array detector, such as a linear array CCD, a sequence of R, G, and B picture element signals are generated that can be correlated with spatial location information provided from the scanner. Scanning can also be carried out by a microdensitometer. Signal intensity and location information can be fed to an image data processor and the information is transformed into an electronic form, which can be stored in any convenient storage device. For example, it is possible to scan a color photographic material successively within the blue, green, and red regions of the spectrum or to incorporate blue, green, and red light within a single scanning beam that is divided and passed through blue, green, and red filters to form separate scanning beams for each color record. If other colors are imagewise present in the material, then appropriately colored light beams are employed. A simple technique is to scan the photographic material point-by-point along a series of laterally offset parallel scan paths. A sensor that converts radiation received into an electrical signal quantifies the intensity of light passing through the material at a scanning point. Most generally this electronic signal is further manipulated to form a useful electronic record of the image. For example, the electrical signal can be passed through an analog-to-digital converter and sent to a digital computer together with location information required for pixel (point) location within the image. In another variation, this electronic signal is encoded with colorimetric or tonal information to form an electronic record that is suitable to allow reconstruction of the image data into viewable forms such as computer monitor displayed images, television images, printed images, and so forth.

In motion imaging technologies, a common approach is to transfer the color negative film information into a video signal using a telecine transfer device. Two types of telecine transfer devices are most common: (1) a flying spot scanner using photomultiplier tube detectors; and (2) a CCD as a sensor. These devices transform the scanning beam that has passed through the color negative film at each pixel location into a voltage. The signal processing then inverts the electrical signal in order to render a positive image. The signal is then amplified and modulated and fed into a CRT monitor to display the image, and it is recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, an optical disk, and a writing or printing device.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984; and Davis U.S. Pat. No. 5,541,645.

The image data information acquired in preceding fashion from a film intended for scanning can be transmitted to a receiving photofinisher's image processing workstation by a sending party, using any convenient method, such as a networked computer system. There is no requirement that the photofinisher scan the film in order to provide a one or more processed image reproduction appearances derived from an element according to the invention. The sender can be a customer or a photographer possessing a home scanner and a modem who transmits an image file, the sender can also be a kiosk, a retail photo specialty shop, and so forth. While there is no requirement that the sender and the receiving photofinisher be at different locations, it is envisioned that the largest benefit is obtained when file transfers occur over appreciable distances associated with different locations due to the computer infrastructure requirements in establishing a network system. It will be appreciated that the best image processing results will be obtained if the transmitted image file has a data encodement or color encodement scheme consistent with that of the image processing scheme to ensure full compatibility. It is preferred that transmitted data be compressed in order to improve throughput in network communications where available bandwidth is limited or where there is congestion due to data traffic, as is common. When file compression means are used, it is preferred that they be lossless rather than lossy. It is highly preferred that transmitted data be accompanied by metadata encoding.

Image metadata refers to any additional data or information associated with the image; it may be derivative of the image itself, or it may relate to added material that pertains to the event of photography, customer identification or preferences, or photofinisher routing information. Diverse examples of metadata and its encoding that are applicable to the invention can be found in U.S. Pat. No. 6,115,717 to Mehrotaetal, U.S. Pat. No. 5,893,101 to Balogh et al, EP-A-1 004 967 (published on May 31, 2000), and U.S. Pat. No. 6,134,315 to Galvin. Photographic capture information that is desirably encoded as metadata includes any single input or any combination of inputs regarding scene illumination type, flash parameters such as flash output and/or whether the flash was directed at the subject or bounced onto the subject and/or whether sufficient flash power was available to properly illuminate the subject, camera lens f-stop, camera exposure time, and scene orientation, all of which is helpful in color and density balancing.

It is specifically contemplated to scan a developed image to red, green and blue light to retrieve imagewise recorded information and to scan the same image to infrared light for the purpose of recording the location of non-image imperfections. When such an imperfection or "noise" scan is employed, the signals corresponding to the imperfection can be employed to provide a software correction so as to render the imperfections less noticeable or totally imperceptible in soft or hard copy form. The hardware, software and technique for achieving this type of imperfection reduction is described in U.S. Pat. No. 5,266,805 to Edgar and WO 98/31142, WO 98/34397, WO 99/40729, and WO 99/42954 (Edgar et al). An example of a preferred scanner employing such corrections is the KODAK DLS Film Scanner 1640 with an associated image data manager or image processing workstation, such as one or more dual-processor computers.

The developed image can be scanned multiple times by a combination of transmission and reflection scans, optionally in the infrared and the resultant files combined to produce a single file representative of the initial image. Such a procedure is described in U.S. Pat. Nos. 5,465,155, 5,519,510, 5,790,277, and 5,988,896 to Edgar, as well as EP-A-0 944 998, WO 99/43148, WO 99/43149 and WO 99/42954. Improvements in the scanning of films that retain silver halide following a rapid development method, such as aerial chemical deposition, are obtained by methods disclosed in U.S. Pat. No. 6,069,714 to Edgar.

Elements having reference images or calibration patches derived from one or more uniform areas exposed onto a portion of unexposed photographic material, as described in U.S. Pat. No. 5,649,260 to Wheeler et al, U.S. Pat. No. 5,563,717 to Koeng et al, U.S. Pat. No. 5,644,647 to Cosgrove et al, U.S. Pat. No. 6,280,914 to Keech et al, and U.S. Pat. No. 6,284,445 to Keech et al, can be usefully employed to overcome the effects of excessive sensitometric variation. The exposure of reference images for the purpose of better calibrating the image processing system can be performed by the photographic recording material manufacturer or by the photofinisher. Periodic system calibration events (e.g., a daily calibration) employing reference exposure patches even on a single representative material, such as those contained on a chemical process control strip, can lead to improved image processing results. It is preferred to employ a calibration reference image on every roll of film that is processed by the photofinisher. An especially suitable method for calibration and correction due to processing solution activity changes or film responsivity changes is taught in U.S. Pat. No. 5,667,944 to Reem et al, the disclosure of which is herein incorporated by reference. Other useful features of element construction for scanning and image-bearing signal manipulation can be found in *Research Disclosure*, publication 38957, pages 626–627 (September 1996) Section XIV Scan facilitating features. A preferred method for creating the image-bearing electronic signals, or carrying out image processing of a film intended for scanning, is taught in U.S. Pat. No. 6,210,870 to Brockler et al.

Once acquired, the image data in electronic signal form derived from the input capture material or device color records can be adjusted for scene exposure conditions to produce a more pleasingly color-balanced and lightness-balanced image for viewing. An example of a suitable scene balance algorithm is described by. E. Goll, D. Hill, W. Severin, "Modem Exposure Determination for Customizing Photofinishing Printer Response", *Journal of Applied Photographic Engineering*, 2, 93 (1979). Techniques for transforming image-bearing signals after scanning are disclosed in U.S. Pat. No. 5,835,627 to Higgins et al, U.S. Pat. No. 5,694,484 to Cottrell et al, and U.S. Pat. No. 5,962,205 to Arakawa et al. Techniques for color balance adjustments are disclosed in U.S. Pat. No. 5,049,984 to Moore et al, U.S. Pat. No. 5,541,645 to Davis, and U.S. Pat. No. 6,243,133 to Spaulding et al.

Further illustrations of general procedures and system considerations involved in electronic image processing are described by Giorgianni and Madden, *Digital Color Management: Encoding Solutions*, Addison-Wesley, Reading, Mass., 1998.

The photographic recording material and accelerated development process of the present invention are especially suited to a method of photofinishing including the steps of offering a plurality of possible image "looks" (i.e., multiple printing styles or output image appearances relating to different image colorfulness, contrast, hue or shade, sharpness, and so forth) and representing the selections on a display medium such as a brochure or an Internet World Wide Web site, receiving, developing and image-processing the exposed color photographic recording material intended for scanning to create intermediary image-bearing electronic signals, which are modified to provide a processed image with the appearance characteristics of the selected look to an intended recipient, as disclosed in U.S. Ser. No. 09/742,553 filed Dec. 20, 2000. This method provides a photographer with the choice of differing image looks or appearance characteristics that can be selected at any point in the photographic scene capture and image reproduction process, and which can be applied to the image at the time of photofinishing. The method allows for the use of a single photographic recording material intended for scanning to produce a selection of different image appearances, which provides convenience and simplicity over selecting from a plurality of films intended for optical printing or direct viewing at the time of photographic capture. These differing looks are produced from an origination image file resulting from scanning a photographic recording material that is intended for scanning, providing enormous flexibility in the processes of image look selection and photofinishing. The photofinishing method can effectively be offered as an interactive service with an Internet web site. In one example, the photofinisher supplies a customer with a film intended for scanning and a processing mailer. The examples of final image appearances or "looks" or printing styles are displayed on the photofinishing service Internet web site and the customer selects one or more of the image looks to be applied to his images.

In order to deliver an image reproduction that incorporates one or more photofinishing styles or appearances selected by a customer or photofinisher, electronic signal processing (i.e., image processing) is carried out. Preferred techniques for transforming image-bearing signals after scanning are taught in U.S. Pat. Nos. 5,267,030; 5,452,111; 5,956,044; and 5,609,978 to Giorgianni et al, the disclosures of which are herein incorporated by reference. Another preferred method for transforming the image-bearing electronic signals, or carrying out image processing of a film intended for scanning, is taught by U.S. Pat. Nos. 5,995,654; 6,163,389; and 6,274,299 by Buhr et al, the disclosures of which are herein incorporated by reference.

The images contained in the color photographic recording material intended for scanning in accordance with the invention are converted to digital form, manipulated, and recreated in a viewable form following any of the suitable methods described in '030 to Giorgianni et al. In one preferred embodiment, Giorgianni et al in '030 provide a method and means to convert the R, G, and B image-bearing signals from a transmission scanner to an image manipulation and/or storage metric which corresponds to the trichromatic signals of a reference image-producing device such as a film or paper writer, thermal printer, video display, etc. The metric values correspond to those, which would be required to appropriately reproduce the color image on that device. For example, if the reference image producing device was chosen to be a specific video display, and the intermediary image data metric was chosen to be the R', G', and B' intensity modulating signals (code values) for that reference video display, then for an input film, the R, G, and B image-bearing signals from a scanner would be transformed to the R', G', and B' code values corresponding to those which would be required to appropriately reproduce the input image on the reference video display. A data set is generated from which the mathematical transformations to convert R, G, and B image-bearing signals to the aforementioned code values are derived. Exposure patterns such as neutral and colored patches, chosen to adequately sample and cover the useful exposure range of the film being calibrated, are created by exposing with a pattern generator using an exposing apparatus. The exposing apparatus produces trichromatic exposures on film to create test images, which can include approximately 150 color patches, for example.

Test images may be created using a variety of methods appropriate for the application. These methods include using an exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The image-wise exposed film is chemically processed to produce a dye image. Film color patches are read by a transmission scanner, which produces R, G, and B image-bearing signals corresponding to each color patch. Signal value patterns of the code value pattern generator produce R, G, and B intensity-modulating signals, which are fed to the reference video display. The R', G', and B' code values for each test color are adjusted such that a color matching apparatus, which may correspond to an instrument or a human observer, indicates that the video display test colors match the positive film test colors or the colors of a printed negative. A transform apparatus creates a transform relating the R, G, and B image-bearing signal values for the film's test colors to the R', G', and B' code values of the corresponding test colors.

The mathematical operations required to transform R, G, and B image-bearing signals to the intermediary data may include a sequence of matrix operations and look-up tables (LUTs).

In a preferred method, input image-bearing signals R, G, and B are transformed to intermediary data values corresponding to the R', G', and B' output image-bearing signals required to appropriately reproduce the color image on the reference output device as follows:

(1) The R, G, and B image-bearing signals, which correspond to the measured transmittances of the film, are converted to corresponding densities in the computer workstation used to receive and store the signals from a film scanner by means of 1-dimensional look-up table LUT 1.

(2) The densities from step (1) are then transformed using matrix 1 derived from a transform apparatus to create intermediary image-bearing signals.

(3) The densities of step (2) are optionally modified with a 1-dimensional look-up table LUT 2 derived such that the neutral scale densities of the input film are transformed to the neutral scale densities of the reference.

(4) The densities of step (3) are transformed through a 1-dimensional look-up table LUT 3 to create corresponding R', G', and B' output image-bearing signals for the reference output device.

It will be understood that individual look-up tables are typically provided for each input color. In one embodiment, three 1-dimensional look-up tables can be employed, one for each of a red, green, and blue color record. In another embodiment, a multi-dimensional look-up table can be employed as described in U.S. Pat. No. 4,941,039 to D'Errico. It will be appreciated that the output image-bearing signals for the reference output device of step 4 above may be in the form of device-dependent code values or the output image-bearing signals may require further adjustment to become device specific code values. Such adjustment may be accomplished by further matrix transformation or 1-dimensional look-up table transformation, or a combination of such transformations to properly prepare the output image-bearing signals for any of the steps of transmitting, storing, printing, or displaying them using the specified device.

In a second preferred method suitable for film elements according to the invention, the R, G, and B image-bearing signals from a transmission scanner are converted to an image manipulation and/or storage metric, which corresponds to a measurement or description of a single reference image-recording or image-capture device and/or medium and in which the metric values for all input media correspond to the trichromatic values which would have been formed by the reference device or medium had it captured the original scene under the same conditions under which the input media captured that scene. For example, if the reference image recording medium was chosen to be a specific color negative film, and the intermediary image data metric was chosen to be the measured R, G, and B densities of that reference film, then for an input color negative film, the R, G, and B image-bearing signals from a scanner would be transformed to the R', G', and B' density values corresponding to those of an image which would have been formed by the reference color negative film had it been exposed under the same conditions under which the color negative recording material was exposed.

Exposure patterns, chosen to adequately sample and cover the useful exposure range of the film being calibrated, are created by exposing with a pattern generator using an exposing apparatus. The exposing apparatus produces trichromatic exposures on the photographic recording material to create test images, which can include approximately 150 color patches, for example. Test images may be created using a variety of methods appropriate for the application, including using an exposing apparatus such as a sensitometer, using the output device of a color imaging apparatus, recording images of test objects of known reflectances illuminated by known light sources, or calculating trichromatic exposure values using methods known in the photographic art. If input films of different speeds are used, the overall red, green, and blue exposures must be properly adjusted for each film in order to compensate for the relative speed differences among the films. Each film thus receives equivalent exposures, appropriate for its red, green, and blue speeds. The imagewise exposed film is chemically processed to produce a dye image. Film color patches are read by a transmission scanner, which produces R, G, and B image-bearing signals corresponding to each color patch and by a transmission densitometer which produces R', G', and B' density values corresponding to each patch. A transform apparatus creates a transform relating the R, G, and B image-bearing signal values for the film's test colors to the measured R', G', and B' densities of the corresponding test colors of the reference color negative film. In another preferred variation, if the reference image recording medium was chosen to be a specific color negative film, and the intermediary image data metric was chosen to be the predetermined R', G', and B' intermediary densities of step 2 of that reference film, then for an input color negative film intended for scanning according to the invention, the R, G, and B image-bearing signals from a scanner would be transformed to the R', G', and B' intermediary density values corresponding to those of an image which would have been formed by the reference color negative film had it been exposed under the same conditions under which the color negative recording material according to the invention was exposed. One example of useful intermediary densities is reference printing densities.

Thus, each input film calibrated according to the present method would yield, insofar as possible, identical intermediary data values corresponding to the R', G', and B' code values required to appropriately reproduce the color image which would have been formed by the reference color negative film on the reference output device. Uncalibrated films may also be used with transformations derived for similar types of films, and the results would be similar to those described.

The mathematical operations required to transform R, G, and B image-bearing signals to the intermediary data metric of this preferred embodiment may include a sequence of matrix operations and 1-dimensional LUTs. Three tables are typically provided for the three input colors. It is appreciated that such transformations can also be accomplished in other embodiments by employing a single mathematical operation or a combination of mathematical operations in the computational steps produced by the host computer including, but not limited to, matrix algebra, algebraic expressions dependent on one or more of the image-bearing signals, and n-dimensional LUTs.

In one embodiment, matrix 1 of step 2 is a 3×3 matrix. In a more preferred embodiment, matrix 1 of step 2 is a 3×10 matrix. In a preferred embodiment, the 1-dimensional LUT 3 in step 4 transforms the intermediary image-bearing signals according to a color photographic paper characteristic curve, thereby reproducing normal color print image tone scale as one form of image look. In another preferred embodiment, LUT 3 of step 4 transforms the intermediary image-bearing signals according to a modified viewing tone scale that is more pleasing, such as possessing lower image contrast, as a second form of image look.

Buhr et al in '389 provide a related and even more preferred method of digital photofinishing comprising the steps of: producing a digital color image in printing or other densities of a color image captured on alternative capture photographic media (e.g., a color negative film intended for scanning); first mapping the printing or other densities of the alternative capture media to the printing densities that would have been obtained for reference color photographic media; processing the mapped digital color image with a scene balance algorithm to produce a processed digital color image; second mapping the processed digital color image through a hard copy media characteristic curve to produce the mapped digital color image mapped to print densities of the hard copy media; sharpening the mapped digital color image with a sharpening algorithm optimized to avoid unacceptable artifacts; and digitally printing the sharpened digital color image onto hard copy media. Information accompanying the captured original scene parameters that describes the camera parameters responsible for capturing the scene can provide useful input for the signal processing algorithms. Useful information includes any single input or any combination of inputs which includes scene illumination type, whether or not a flash unit discharged, flash parameters such as flash output and/or whether the flash was directed at the subject or bounced onto the subject and/or whether sufficient flash power was available to properly illuminate the subject, camera lens f-stop, camera exposure time, and scene orientation. Further features in scene balance algorithms useful in the practice of the invention can include mixed illuminant detection and subject detection.

Thus, the scanner densities, the printing densities, or other film density-representative, image-bearing signals of the input film intended for scanning are transformed to image printing instructions or image display instructions based on the properties of a reference film. The reference film can be an existing film intended for the required output operation, or it can be another kind of film intended for a different imaging application if appropriate modifications are added to the image processing chain to account for the current application. It is preferred, in one use of film elements of the invention, to transform the image-bearing signals of the scan film to known output printing or display instructions for existing color negative films. In this manner, the output derived from a scan film is simply predicted and conveniently image-processed. For example, the scanner densities or the printing densities from the imagewise-exposed and processed scan film can be transformed to the printing densities of a plurality of existing color negative films and then written to an output medium such as silver halide color paper. The printing densities of the film intended for scanning can be transformed to the printing densities of one or more of the following representative example still films, including, but not limited to: KODAK MAX™ Versatility Film, KODAK MAX™ Versatility Plus Film, KODAK SELECT™ Films, KODAK ROYAL GOLD™ films, KODAK GOLD MAX™ films, KODAK GOLD™ films, KODAK SUPRA™ films, KODAK VERICOLOR™ films, KODAK PORTRA™ films, KODAK PRO GOLD™ films, KODAK FUNTIME™, KODAK VR™ films, KODAK EKTAPRESS PLUS™ films, films, and KODAK ADVANTIX™ films. Motion imaging films, such as KODAK VISION™ and EASTMAN EXR™ films, are useful reference films for moving picture film applications to preserve the look of present movies. Alternatively, the scan film printing densities can be transformed to those of any other selected reference image capture device or medium, as described in '030 to Giorgianni et al. In a preferred embodiment, the reference image capture device is a digital still camera, more preferably one with spectral sensitivities that approximate color matching functions or the human visual system responsivities.

In the general cases previously described, image recording media and devices, and scanning devices, will not directly record the scene parameters in the way human observers perceive them. However, all of these media and devices can be characterized by a spectral response function, by a function that maps scene intensity ratios to device code values and by a multidimensional function or matrix that characterizes the interdependence or cross talk between the at least three color channels. Therefore, obtaining the original scene parameters directly relating to the light levels of the photographed scene (i.e., scene space exposures, or scene radiometry, or scene colorimetry) involves applying transformations that are the inverses of these functions. It is desirable to make the captured scene parameters independent of the particular input device and/or medium and to make the resulting pixel values represent accurate estimates of the scene colorimetry. Scene colorimetry is a preferred intermediary data encoding metric, since a very wide variety of desirable image appearances can be derived by the proper manipulation of the image-bearing electronic signals. A most preferred method of providing scene exposures is also described in '030 to Giorgianni et al., wherein a digital image that was created by scanning a film is transformed into a device-independent color space by a mathematical transformation. A data set from which the mathematical transformation can be derived is produced by exposing a sample of the film with a pattern of approximately 400 test color stimuli, for example, which are chosen to adequately sample and cover the useful exposure range of the film. Red, green, and blue (R, G, B) trichromatic exposures for a reference calorimetric image-capturing device or medium are then computed for the test stimuli, using standard calorimetric computational methods. The imagewise exposed film is chemically processed producing a dye image, and the color patches are read by a transmission scanner, which produces R, G, and B image-bearing signals corresponding to each color patch. A transformation is then created relating the R, G, and B image-bearing signal values for the film's test colors to the known R, G, and B trichromatic exposures of the corresponding test colors. This transformation is then used to convert digital image values that were produced by scanning a film of the type that was used to generate the transform using the following procedures:

1) converting the R, G, B image-bearing signals, which correspond to the measured transmittances of the input film, to R, G, and B densities by using appropriate 1-dimensional look-up-tables (LUTs);
2) adjusting the R, G, and B density-representative signals of step 1 by using a 3×3 matrix, to correct for differences among scanners in systems where multiple input scanners are used;
3) adjusting the R, G, and B density-representative signals of step 2 by using another matrix operation or 3-dimensional LUT, to remove the chromatic interdependence (i.e., cross talk) of the image-bearing signals produced by any unwanted absorptions of the imaging dyes and chemical interlayer interimage interactions in the input photographic recording medium, to produce channel independent, density-representative signals;
4) individually transforming the R, G, and B density-representative signals of step 3 through appropriate 1-dimensional LUTS, derived such that the neutral scale densities of the input film are transformed to the neutral scale linear exposure-representative signals of that film; and
5) further transforming the R, G, and B exposure-representative signals of step 4 by another matrix operation to arrive at the R, G, B scene exposure-representative signals corresponding to those which a reference image-capturing device or medium would have received if it had recorded the same original scene (i.e., scene space colorimetry).

Test color patch sets having fewer than 400 colors can be employed to enable more efficient generation of the transformation matrices and LUTs and improved use of computational resources. In some embodiments, the mathematical operations represented by sequential application of individual matrices and LUTs can be numerically concatenated to afford improved computational speed and to reduce the necessary computational power. Analogous procedures can be employed to generate transformation matrices and LUTs appropriate for use with the other photographic or electronic image capture, image acquisition, and image processing paths described herein.

It will be appreciated that the scene space exposures determined in the aforementioned manner are limited in accuracy by the accuracy of the spectral sensitivities of the photographic recording medium or device whose input recorded image data was transformed. Hence, the earlier noted preference for colorimetric capture by the film intended for scanning, in order to provide the most accurate encoded scene data which in turn affords broadest range of useful image reproduction appearances as output, whether in still photography or motion photography applications.

Instead of direct capture of the original scene parameters, it is also possible to access a representation of the original scene parameters, captured and stored at some prior time. These representations may be two-dimensional or three-dimensional and may be of still or moving scenes. The only requirement for this means of generating a preferred viewed reproduction of the original scene is that the relationship between the original scene parameters and those in the accessed original scene representation be known or that it be possible to make an accurate assumption about this relationship. The accessed scene representation was at some point captured preferably using the methods described above for direct original scene parameter capture.

It is preferred to encode the scene exposures derived in the above manner, or by another method, in a device-independent color space for further manipulation and for eventual transmission to a device-dependent color space for display, printing, transmission, storage and so forth. Device-independent color spaces are often based on a system of colorimetry developed by the Commission International de l'Eclairage (CIE), and representative examples are CIE XYZ and CIELAB color spaces. A comprehensive discussion of colorimetry and color standards can be found in R. W. G. Hunt, *The Reproduction of Color in Photography,*

*Printing and Television, Fifth Edition*, Fountain Press, Kingston, upon-Thames, England, pp. 136–176 (1995). A specification for its well-known color spaces can be found in CIE Publication 15.2-1986, *Colorimetry, Second Edition*. Output device-dependent color spaces can also be used for storage, interchange, and manipulation of digital images, but they frequently produce a compromise in color storage due to a limited functional range or color gamut that necessitates truncation of the colors or luminance ranges that can be reproduced by the system. An example of such a suitable, contemporary device-dependent color space is sRGB. If a limited gamut color-encoding medium is used, the possible loss of recorded scene data may be ameliorated by the use of the method involving image metadata described in EP-A-0 991 019 (published Apr. 5, 2000) and the use of the apparatus described in EP-A-0 991 020 (published Apr. 5, 2000). A preferred interchange space comprised of a device-independent color encoding specification for the practice of the invention is Profile Connection Space (PCS) as defined by the International Color Consortium® (ICC), a group of participating corporations that has set open specifications for electronic device color management. The PCS interface represents color appearances by specifying the CIE colorimetry of colors viewed on a reference medium in a reference viewing environment. A device profile (often called an ICC profile) is used to relate the device-dependent code values of an input or output image data set to the corresponding color encodement scheme values in PCS. ICC has published a description of both PCS and device profiles in *File Format for Color Profiles*, Specification ICC.1:1998-09, and in *Addendum 2 to Spec. ICC*.1:1998-09, Document ICC.1A:1999-04, which are quite readily obtained by downloading from the ICC website, www.color.org. However, it is preferred to store the intermediary image-bearing electronic signals representing scene exposures or manipulated scene colorimetry in a large-gamut color-encoding scheme suitable for image manipulation operations. Preferred input and output color encoding schemes and interchange methods are described by K. Spaulding, G. Woolfe, and E. Giorgianni in *IS& T PICS Conference Proceedings*, pp. 155–163 (2000). An especially preferred device-independent color encoding space described therein is termed Extended Reference Input Medium Metric (ERIMM).

Additional illustrative systems for manipulation of digital signals including techniques for maximizing the quality of image records are disclosed by U.S. Pat. No. 4,553,156 to Bayer; U.S. Pat. No. 4,591,923 to Urabe et al; U.S. Pat. No. 4,631,578 to Sasaki et al; U.S. Pat. No. 4,654,722 to Alkofer; U.S. Pat. No. 4,670,793 to Yamada et al; U.S. Pat. No. 4,694,342 to Klees; U.S. Pat. No. 4,962,542 to Klees; U.S. Pat. No. 4,805,031 to Powell; U.S. Pat. No. 4,829,370 to Mayne et al; U.S. Pat. No. 4,839,721 to Abdulwahab; U.S. Pat. Nos. 4,841,361 and 4,937,662 to Matsunawa et al; U.S. Pat. No. 4,891,713 to Mizukoshi et al; U.S. Pat. No. 4,912,569 to Petilli; U.S. Pat. Nos. 4,920,501 and 5,070,413 to Sullivan et al; U.S. Pat. No. 4,929,979 to Kimoto et al; U.S. Pat. No. 4,972,256 to Hirosawa et al; U.S. Pat. No. 4,977,521 to Kaplan et al; U.S. Pat. No. 4,979,027 to Sakai et al; U.S. Pat. No. 5,003,494 to Ng; U.S. Pat. No. 5,008,950 to Katayama et al; U.S. Pat. No. 5,065,255 to Kimura et al; U.S. Pat. No. 5,051,842 to Osamu et al; U.S. Pat. No. 5,012,333 to Lee et al; U.S. Pat. No. 5,107,346 to Bowers et al; U.S. Pat. No. 5,105,266 to Telle; U.S. Pat. No. 5,105,469 to MacDonald et al; U.S. Pat. No. 5,081,692 to Kwon et al; U.S. Pat. No. 5,579,132 to Takahashi et al, and U.S. Pat. No. 6,167,165 Gallagher et al.

It is appreciated by those skilled in the art that scene colorimetry does not produce a pleasing image when directly rendered as a reproduction, such as a color print. Furthermore, it is desirable to manipulate the encoded scene exposures or scene colorimetry, or other form of image data, in a plurality of ways in order to allow a selection and provision of at least two or more looks. Individuals differ in their preference for appearance characteristics of image reproductions. An image "look" can be defined by characterizing the appearance of the reproduction relative to the appearance of the original scene. For example, the reproduction tone scale quantifies the mapping of the tones in the original scene to the tones in the reproduction. A three-dimensional color space mapping can be used to quantify the modification of the hues, saturations, and lightnesses of the colors in the original scene necessary to produce the image reproduction of the scene. Additional global characteristics of the reproduction that define the look include sharpness and graininess, pertaining to image spatial frequency reproduction and noise content, respectively. In addition to global image characteristics, object- or region-specific image adjustments may be made to produce the desired "look". An example of an object-specific adjustment is to transform all non-skin tones into B&W tones. An example of a region-specific image adjustment is to darken the edges of an image to produce a vignetting effect.

It is well understood by those skilled in the art that image colorimetry can be purposefully manipulated in a variety of ways to achieve changes in image luminance, chroma, and hue, which then can be rendered in the image reproduction by means of subsequent well-known transformations. In this manner, the scene can be reproduced with higher or lower contrast and brightness (which equates to higher or lower scene luminance reproduction, i.e., lightness), with higher or lower colorfulness (i.e., chroma), and with more accurate or less accurate color shades (i.e., hue). It is the aggregate of the specific hue reproduction, chroma reproduction, lightness reproduction or rendering contrast (tonal reproduction) in a particular pictorial reproduction that defines a distinguishable image look. A highly preferred method for transforming the intermediary image-bearing electronic signals representing scene exposures is by calorimetric manipulations that can take the form of consistently and smoothly shifting colors within a region of color space, so as to deliver an image that incorporates the look selected by a customer or a photofinisher, which is disclosed in EP 1 139 653 (published Oct. 4, 2001) and EP 1 139 656 (published Oct. 4, 2001).

By using the above methods of image processing taught by Buhr et al and Woolfe et al in the aforementioned references, the image-bearing electronic signals representing the captured scene can be purposefully manipulated by a photofinisher to achieve a very wide variety of visual reproductions. Thus, it is possible to make the pictorial reproduction more or less colorful, or to remove color entirely and reproduce color image data as a black-and-white reproduction. The method of Buhr et al allows specific colors to be manipulated with minimal or no effect at all on other colors in the reproduction. The chroma of green relating to grass and blue relating to sky can be increased, while the chroma, hue and lightness of skin colors can remain unaffected. Such discretion in color reproduction manipulation is beyond the capability of the conventional optical print system, which relies on film chemical interlayer interimage effects to produce system wide color correction and color management. A variety of tonal mappings can be applied, to manipulate visual reproduction contrast in ways also not feasible in the optical print system. Specific colors hues can be shifted, for example by adding blue to the green of foliage to produce a more pleasing color reproduction. It is preferred to render mid-tone neutrals with lower contrast than normally used in the color negative optical print system, especially with high-key scenes. It is preferred to increase the chroma of highly saturated scene colors in the reproduction without affecting skin colors, and without resorting to overall high contrast. It is preferred to smoothly and consistently shift the hue of foliage colors by a desirable hue angle rotation.

In addition to the hue and chroma manipulations listed above, a tone scale has to be applied to map the relative luminance values of scene colors to relative luminance values of the reproduced colors. It is well known to those skilled in the art that this is rarely a one-to-one mapping. The selection of a tone scale that produces the most preferred images depends on a variety of factors, including the discrepancy between viewing conditions of the scene and the reproduction, anticipated subject matter (e.g., portrait photography, nature photography, landscape photography, candid shots, etc.), the dynamic range of the scene in relation to the dynamic range that can be reproduced, and viewer preferences.

A family of tone scales that produce preferred reproductions in combination with hue and chroma manipulations, are disclosed in U.S. Pat. Nos. 5,300,381 and 5,447,811 to Buhr et al; and in the previously cited U.S. Pat. No. 5,528,339 to Buhr et al. However, the selection is not limited to these tone scales which are characterized by a linear relationship between scene lightness and lightness as perceived by the viewer. Traditional S-shaped tone scales, which are mostly used in conventional silver halide photography, produce preferred images within the framework of this invention compared with optical printing systems, because of the large improvements in hue reproduction possible following purposeful manipulation of scene exposure data derived in the manner of U.S. Pat. No. 5,267,030 in an appropriate color space prior to outputting. It is more preferred to adopt a rendering contrast with reduced gradient in the important midscale densities corresponding to flesh colors compared with the usual tonal mapping of optical print-through systems to color paper. Another useful method of tone scale adjustment is disclosed in U.S. Pat. No. 6,275,605 to Gallagher et al.

When adjusting the contrast of an image in the form of electronic signals, it is preferred to preserve image detail by the application of spatial filtering as described in EP-A-0 971 314 (published Jan. 12, 2000). Preferred methods of reducing image noise by neighboring pixel adjustment are disclosed in EP-A-1 093 088 (published Apr. 18, 2001) to Gindele. Another preferred method of processing a digital image channel to remove noise includes the steps of: identifying a pixel of interest; calculating a noise reduced pixel value from a single weighted average of the pixels in a sparsely sampled local region including the pixel of interest, replacing the original value of the pixel of interest with the noise reduced pixel value and repeating these operations for all of the pixels in the digital image channel, as disclosed in EP-A-1 135 747 (published Apr. 12, 2001) to Gindele. A preferred method for enhancing the edge contrast of a digital image independently from the texture is disclosed in EP-A-1 111 906 (published Jun. 27, 2001) to Gallagher et al and in EP-A-1 111 907 (published Jun. 27, 2001) to Gallagher et al. Additionally, global image sharpening may be performed as desired by unsharp masking techniques well known to those skilled in the art.

The best results are obtained if a particular tone scale, or a family of tone scales, is combined with a classification algorithm that selects the most appropriate tone scale according to the dynamic range of the scene or if a dynamic range adjustment is applied prior to tone scaling. Successful classification algorithms will take many forms, including but not limited to histograms, ranges, parameters based on the distribution, or transformations of the distribution of all or a subset of the recorded or transformed image pixel values. In digital imaging printing systems, classification algorithms can be implemented to select slightly different tone mappings to create the most preferred images. The input for the classification can be scene parameters or capture conditions. Information accompanying the captured original scene parameters that describes the camera parameters responsible for capturing the scene can provide useful input for the signal processing algorithms. Useful information includes any single instance of or any combination of scene illumination type, flash parameters such as flash output, if any, and/or whether the flash was directed at the subject or bounced onto the subject and/or whether the sufficient flash power was available to properly illuminate the subject, camera lens f-stop, camera exposure time, scene orientation and zoom lens status. Such classification algorithms are also useful in automating the selection of optimal image looks by a photofinisher to provide to a customer in an automated method of photofinishing, in another application of the films of the invention. In combination with the hue and chroma manipulations, lightness manipulations can take any of the following forms: applying a scene-dependent tone scale transformation, applying a global scene-independent tone scale transformation, or applying a global scene-dependent or scene-independent tone scale transformation. In one specific application, it is desirable to provide a selection of image looks suitable for viewing a scene reproduction in a variety of viewing illumination environments. A method for producing color-appearance matching for an image viewed in different surround conditions by the application of appropriate image luminance contrast factors is described by U.S. Pat. No. 6,046,723 to Daniels et al.

Thus, for the provision of one printed image look, or a plurality of printed image looks to a customer by a photofinisher, either of the two previously described methods is suitable to produce differentiable image appearances in the output image files: (1) the method of Buhr et al in U.S. Pat. Nos. 6,163,389 and 6,274,299 involving the use of printing density transformations wherein scanning and image processing spectral responsivities generally match those of a particular optical photographic printer and photographic output medium (e.g., densitometric encoding, especially involving reference printing densities), or (2) the method of Giorgianni in U.S. Pat. No. 5,267,030, wherein density-representative signals are rendered channel independent and converted to scene exposure-representative signals prior to colorimetric manipulation of hue, chroma, and lightness (e.g., colorimetric encoding).

It is generally desired to render a visual reproduction of the recorded image or to transmit a modified image file to a recipient that was processed according to the aforementioned methods. The image can be reproduced on any transparent or reflective material (hard copy) or on a self-luminous display (soft copy) that produces images by additively mixing at least three suitably chosen primary colors or by subtractively mixing at least three suitably chosen dyes. A digital, electronic representation of the manipulated image is transformed into an analog signal of the correct intensity and spectral distribution in order to generate the desired visual reproduction of the manipulated image. Reproduced images may be displayed in two- or three-dimensional form. Examples of this procedure include the display of an image on a color monitor or an electronic printing process whereby a color photographic paper receives an image-wise exposure by a CRT or laser printing device and the material is subsequently chemically processed, for example, by EKTACOLOR™ RA-4 Process, to produce a reflection print. The current method and element are also well suited for use with digital motion imaging projection applications.

The electronic signals representing the selected image reproduction resulting must be transformed into a corresponding set of device code values to account for the scene parameter manipulation characteristics of the output device and media. The transformation between device code values and the colorimetry of the colors reproduced by a particular device/media combination can be obtained by a device characterization. An example of a device characterization is a procedure that involves generating and printing or displaying a suitable array of device code values in the form of color patches of a size large enough for subsequent measurement. These patches can be measured using a colorimeter, a spectrophotometer or a telespectroradiometer, depending on the nature of the output, such as for example, a silver halide color paper reflection print, or an inkjet reflection print. If monitor display output spectra are measured, CIE XYZ tristimulus values and other related quantities such as CIELAB or CIELUV color space coordinates can be calculated for the display illuminant using standard calorimetric procedures. This data set can be used to construct the appropriate sequence of one-dimensional look-up tables, multidimensional look-up tables, matrices, polynomials and scalars that accomplish that transformation of the image-bearing electronic signals into a set of device code values that produces the desired visual reproduction of the scene. A preferred example of the implementation of this transformation is an ICC-type profile that maps the specifications of the desired visual reproduction, encoded in a color interchange space such as PCS, to device code values, the actual machine printing or monitor display instructions.

This operation may also include gamut mapping. The color gamut of the scene representation is determined by the set of primaries that was used for encoding the data. Examples include the primaries corresponding to the color-matching functions of the CIE 1931 Standard Colorimetric Observer or any linear combinations thereof. Gamut mapping is performed between the gamut defined by this encoding and the gamut of the combination of the output device and the output media, in the case of a reflection print it is preferred to use gamut-mapping algorithms that maintain color hue.

The image data transformation can be combined with one or more of the preceding transformations to form a single set of one-dimensional look-up tables, multidimensional look-up tables, matrices, polynomials and scalars in any sequence. Scene reproductions can be produced by a variety of technologies. Reproductions can be obtained on silver halide or other light-sensitive materials. The light-sensitive material can be transparent film, reflection print paper, or semitransparent film. These materials are exposed by visible or infrared light derived from many different sources. The materials may be designed for typical photofinishing applications or they may be specially designed for digital printing applications. The photosensitive materials respond primarily to three different spectral regions of incident light. Typically, these are red (600–720 nm), green (500–600 nm), and blue (400–500 nm) light. However, any combination of three different spectral sensitivities can be used. These could include green, red, and infrared light or red, infrared 1, and infrared 2 light, or 3 infrared lights of different wavelengths. Or a material sensitive to the three primary wavelengths of visible light may be false sensitized so that the color of the exposing light does not produce image dye of the complementary hue, such as red, green, and blue sensitivity producing magenta, yellow, and cyan dye, respectively. Printing can be carried out by exposing all pixels sequentially, by exposing a small array of pixels at the same time, or by exposing all the pixels in the image at the same time.

Devices, which can be used to print on light-sensitive materials, include CRT, light emitting diode (LED), light valve technology (LVT), LCD, laser, as well as any other controlled optical light generating device. All these devices have the ability to expose three or more light-sensitive layers in a light-sensitive material to produce a colored image; they differ mainly in the technology on which the devices are based. A suitable embodiment of a CRT printer is the KODAK PROFESSIONAL Digital Multiprinter, which can be used in combination with KODAK PROFESSIONAL Digital III Color Paper.

Electronic printing processes to produce high-quality reproductions also conveniently use non-light-sensitive imaging materials. The method of image formation can be half-tone, continuous tone, or complete material transfer. The image reproduction material can be transparent film, reflective paper, or semi-transparent film. The media can be written on to produce pictorial images by thermal dye transfer, inkjet, wax, electrophotographic, or other pixelwise writing techniques. These processes use three or more colorants to create colored pictorial representations of pictorial scenes. The colorants may be dyes, toner, inks, or any other permanent or semi-permanent colored material. A suitable example of a dye transfer thermal printer is the KODAK PROFESSIONAL XLS 8650R Thermal Printer. Both non-impact and impact printing methods, such as traditional press methods, are specifically contemplated.

In addition to hard copy viewed images, it is also possible to create projected images, which have the differentiable image looks in accordance with the invention. Many technologies are appropriate for this kind of image generation. All these techniques rely on producing color images with two or more colored lights. These are typically red, green, and blue in nature although they can be any set of primaries. Devices, which can be used to create the preferred viewed reproduction, include CRT, LCD, electro-luminescence (EL), LED, OLED, light bulbs, lasers, plasma display panels, or any other three or more colored lighting apparatus capable of pixel wise illumination. The images can be created by display within the device, projection, or back-lighting. Many devices create an image on a screen or display area, which is physically a part of the mechanical unit. However, images can also be created by optically projecting the image in the form of light rays from behind or in front of the viewer toward a screen, which is in front of a viewer, or by projecting a reversed image toward the viewer onto a screen between the viewer and the projecting device.

It is possible to transmit processed image-bearing signals derived from a film element according to the invention to an intended recipient or to a device to enable digital motion imaging projection. A motion imaging data file (e.g., a digital electronic movie) can be constructed by scene capture and reproduction from a film intended for scanning with multiple characteristic appearances applied on a frame-by-frame or on a scene-by-scene basis to create associated multiple preferred scene reproductions suitable for broadcast and wide-format display as in a movie theater or home display, as on a television set.

Image data storage can be accomplished in a variety of ways, including magnetic, optical, magneto-optical, RAM, biological, solid state, or other materials, which permanently or semi-permanently record information in a retrievable manner. Examples of suitable storage media and devices include computer hard drives, floppy disks, writable optical disks such as KODAK PHOTO CD™ Discs, KODAK PICTURE CD Discs, KODAK Picture Disk Media, and flash EEPROM (Erasable Electrically Programmable Read-only Memory) PCMCIA cards. Image data transmission can be accomplished most effectively by high throughput means including the use of optical and electromagnetic transmission technologies.

The following examples are intended to illustrate but not limit this invention.

EXAMPLES

The invention can be better appreciated by reference to the following specific embodiments. The suffix (C) designates control or comparative color negative films, while the suffix (E) indicates example color negative films.

All coating coverages are reported in parenthesis in terms of $g/m^2$, except as otherwise indicated. Silver halide coating coverages are reported in terms of silver. The symbol "M %" indicates mole percent. ECD and t are reported as mean grain values. Halides in mixed halide grains and emulsions are named in order of ascending concentrations.

| Glossary of Acronyms and Key | |
|---|---|
| HBS-1 | Tritoluoyl phosphate |
| HBS-2 | Di-n-butyl phthalate |
| HBS-3 | N-n-Butyl acetanilide |
| HBS-4 | Tris(2-ethylhexyl)phosphate |
| HBS-5 | N,N-Diethyl lauramide |
| HBS-6 | Di-n-butyl sebacate |
| HBS-7 | 1,4-Cyclohexylenedimethylene bis(2-ethylhexanoate) |
| H-1 | Bis(vinylsulfonyl)methane |
| TAI | 4-Hydroxy-6-methyl-1,3,3a,7-tetraazaindene, sodium salt |

ST-1

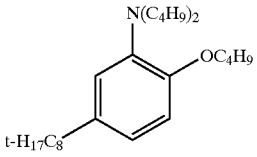

C-1

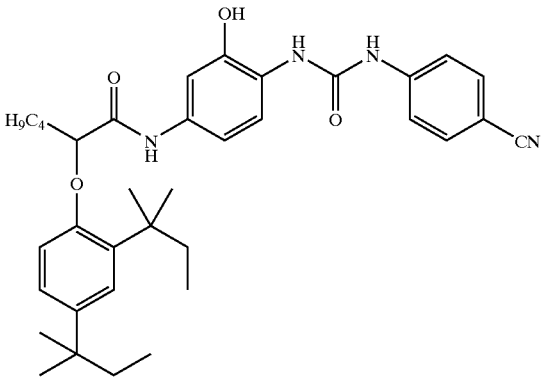

C-2

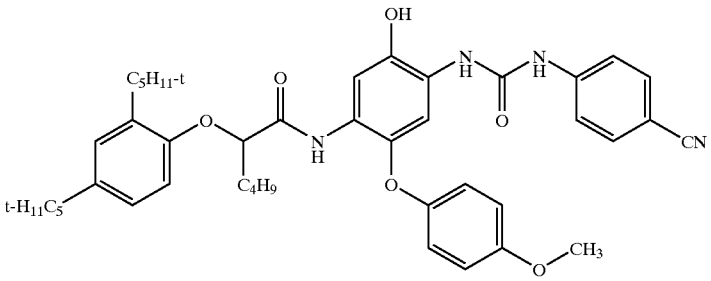

-continued
| Glossary of Acronyms and Key |
|---|
| M-1 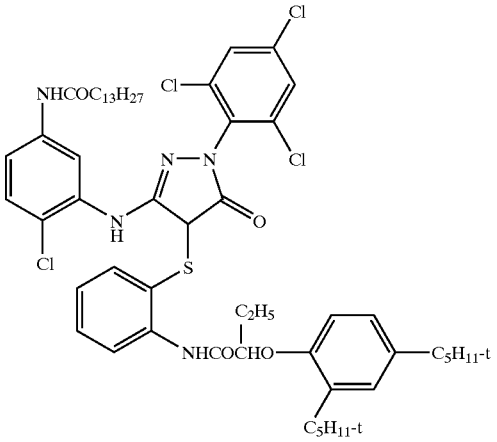 |
| M-2 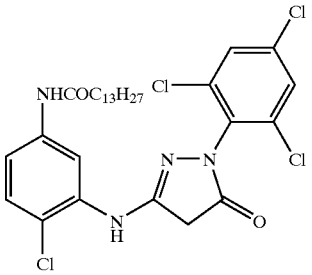 |
| Y-1 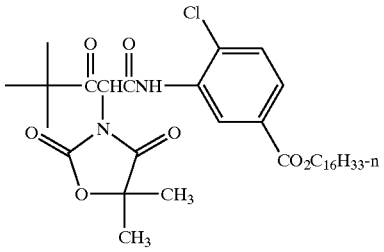 |
| DIR-1 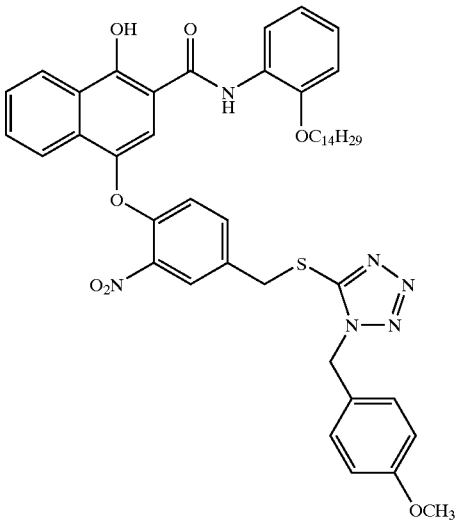 |

-continued
| Glossary of Acronyms and Key |
| --- |
DIR-2
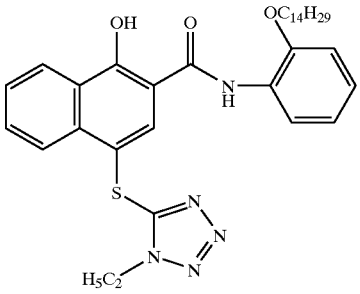
DIR-3
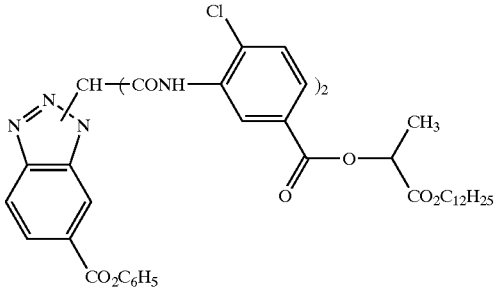
DIR-4
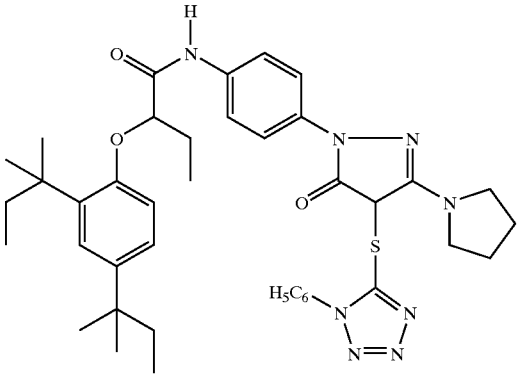
DIR-5
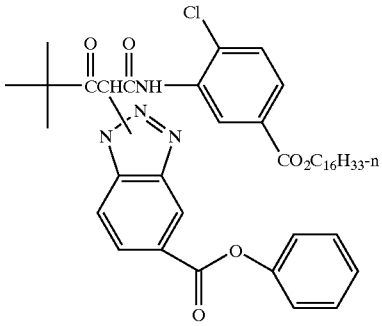

-continued
| Glossary of Acronyms and Key |
| --- |
DIR-6
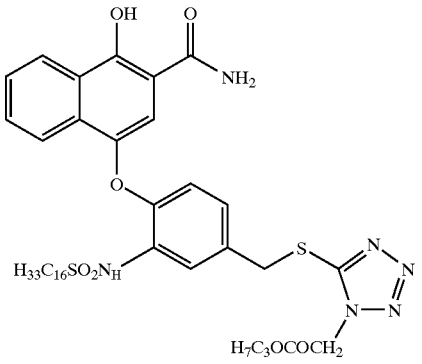
DIR-7
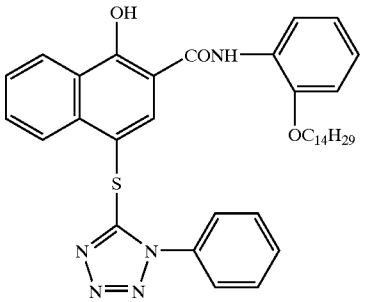
CM-1
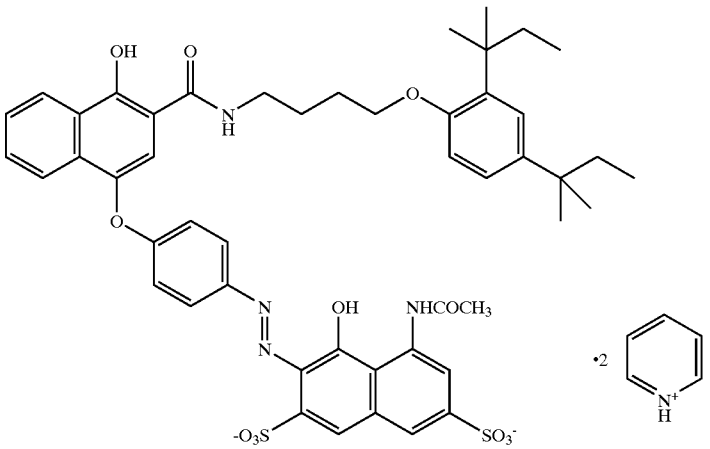

-continued
| Glossary of Acronyms and Key |
|---|
| MM-1 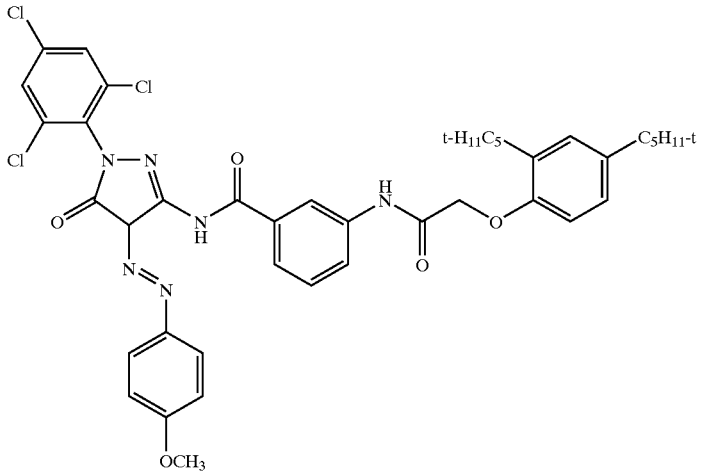 |
| MM-2 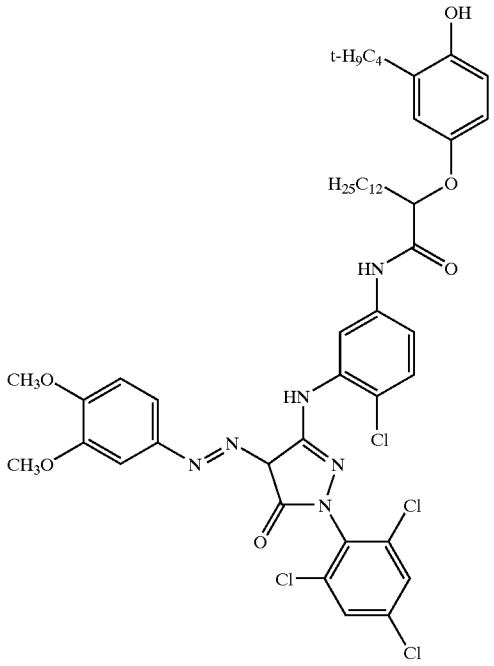 |
| MD-1 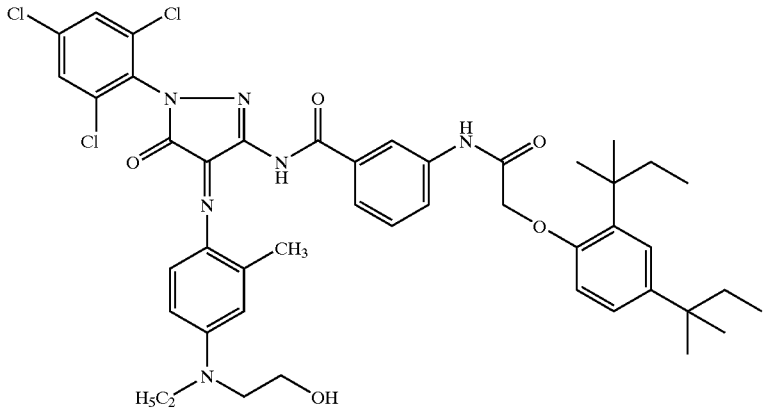 |

-continued
| Glossary of Acronyms and Key |
|---|
| MD-2 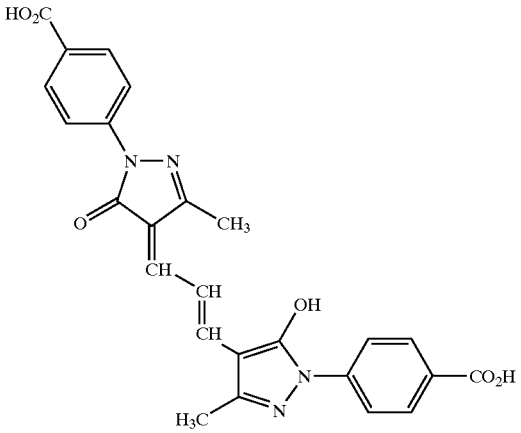 |
| CD-1 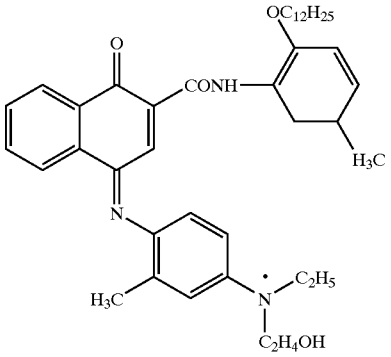 |
| CD-2 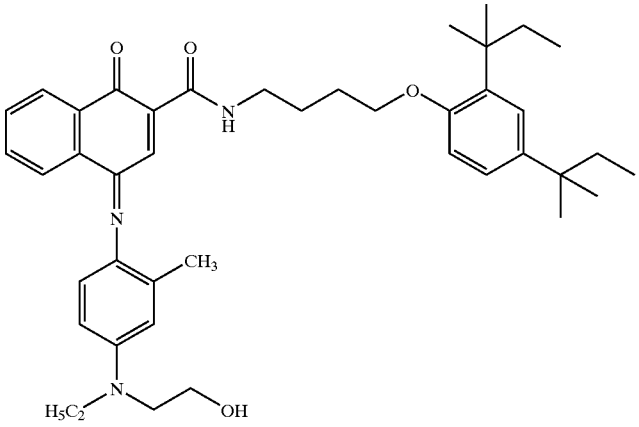 |
| B-1 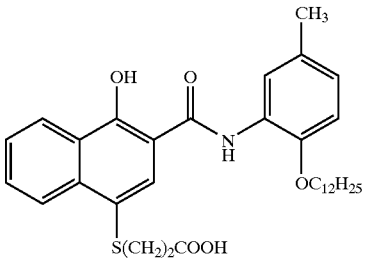 |

-continued
| Glossary of Acronyms and Key |
|---|
YD-1
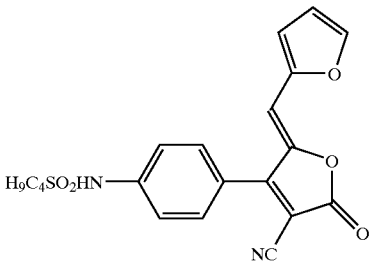
UV-1
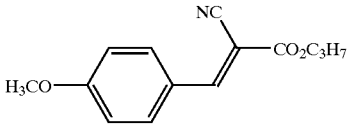
UV-2
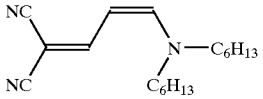
S-1
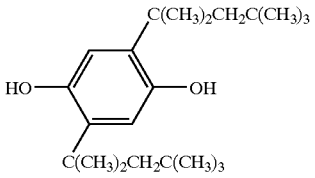
S-2
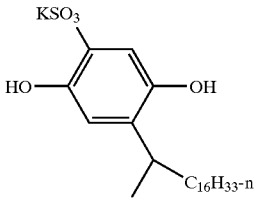
S-3
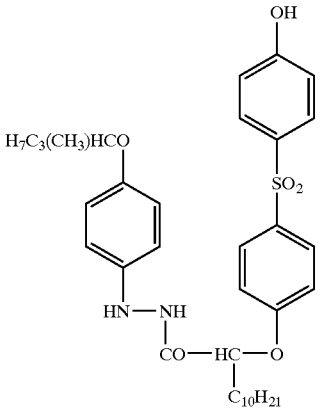

-continued
| Glossary of Acronyms and Key |
| --- |
SOLD-1
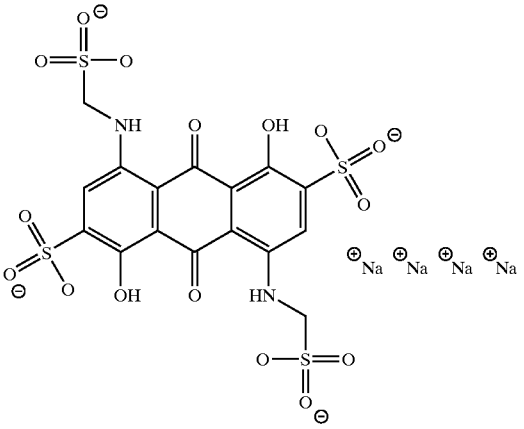
SOLD-2
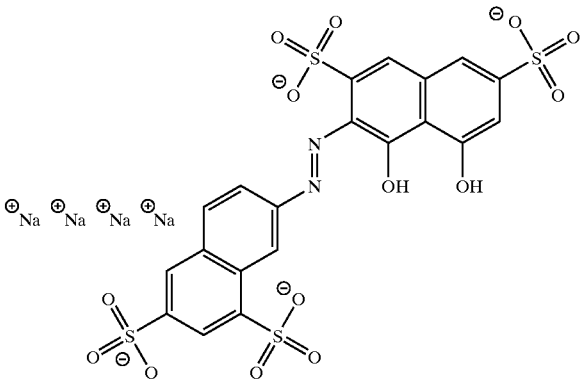
SOLD-3
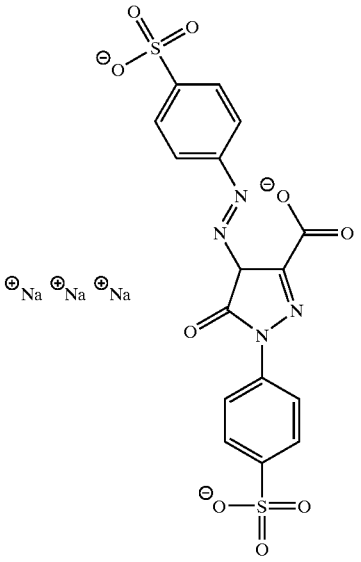

-continued
| Glossary of Acronyms and Key |
|---|
| SD-1 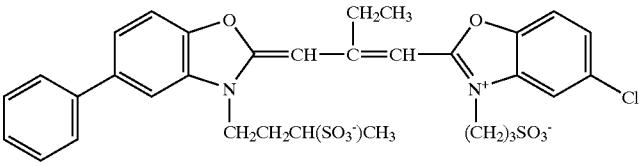 $NH(Et)_3^+$ |
| SD-2 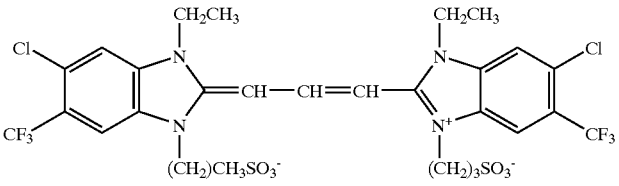 $Na^+$ |
| SD-3 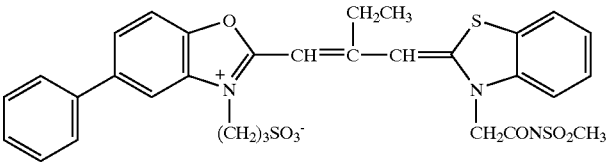 $NEt_3H^+$ |
| SD-4 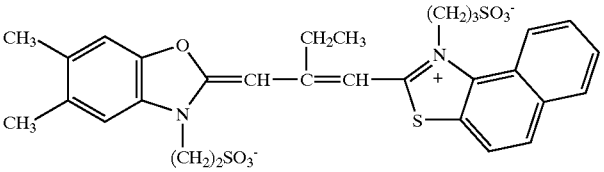 $NMe_2)_2CNH_2^+$ |
| SD-5 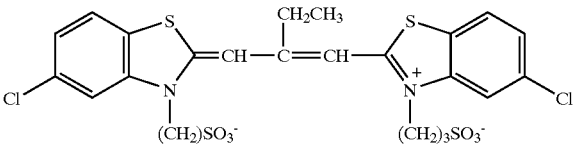 $NEtH^+$ |
| SD-6 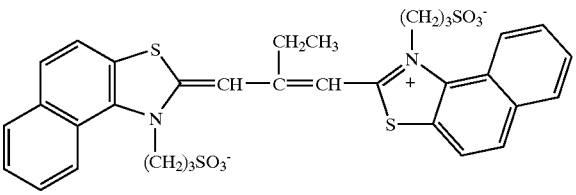 $NEtH^+$ |

-continued

Glossary of Acronyms and Key

SD-7

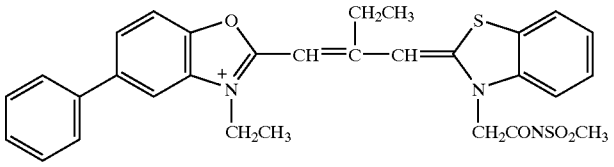

$NEt_3H^+$

SD-8

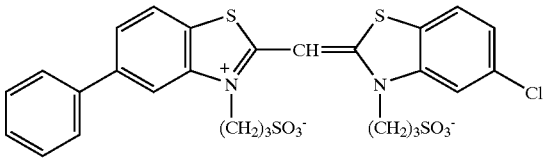

$NEtH^+$

SD-9

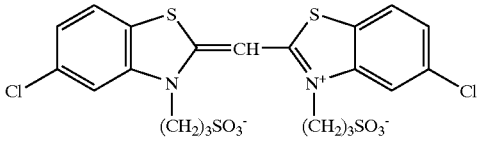

$NEtH^+$

SD-10

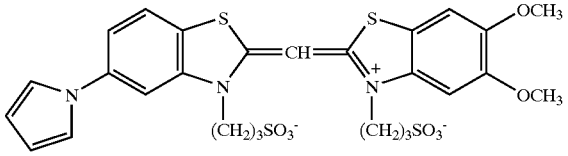

$NEt_3H^+$

Bathochromic Red light-sensitive Emulsions

Silver iodobromide tabular grain emulsions EC-01, EC-02, EC-03, and EC-04 were provided having the significant grain characteristics set out in Table I below. Tabular grains accounted for greater than 70 percent of total grain projected area in all instances. Each of the emulsions EC-01 through EC-04 was optimally sulfur and gold sensitized. In addition, these emulsions were optimally spectrally sensitized with SD-04 and SD-05 in a 2:1 molar ratio. The wavelength of peak light absorption for all emulsions was around 628 nm, and the half-peak absorption bandwidth was around 44 nm.

TABLE I

Bathochromic Red Light-Sensitive Emulsion Size And Iodide Content

| Emulsion | Average grain ECD (μm) | Average grain thickness, (μm) | Average Aspect Ratio | Average Iodide Content (M %) |
|---|---|---|---|---|
| EC-01 | 2.60 | 0.12 | 21.7 | 3.7 |
| EC-02 | 1.30 | 0.12 | 10.8 | 4.1 |
| EC-03 | 0.66 | 0.12 | 5.5 | 4.1 |
| EC-04 | 0.55 | 0.08 | 6.9 | 1.5 |

Hypsochromic Red Light-sensitive Emulsions

Silver iodobromide tabular grain emulsions EC-05, EC-06, EC-07, and EC-08 were provided having the significant grain characteristics set out in Table II below. Tabular grains accounted for greater than 70 percent of total grain projected area in all instances. Each of the emulsions EC-05 through EC-08 was optimally sulfur and gold sensitized. In addition, the emulsions were optimally spectrally sensitized with SD-06 dye at 0.75 mole percent of the total sensitizing dye, followed by a blend of SD-01, SD-02, SD-03, SD-04, SD-05 and SD-06 at 9.93, 54.59, 14.89, 7.94, 7.94, and 3.97 mole percent of the total sensitizing dye. The wavelength of peak light absorption for all emulsions was around 567 nm, and the half-peak dye absorption bandwidth was around 70 nm.

TABLE II

Hypsochromic Red Light-Sensitive Emulsion Size And Iodide Content

| Emulsion | Average grain ECD (μm) | Average grain thickness, (μm) | Average Aspect Ratio | Average Iodide Content (M %) |
|---|---|---|---|---|
| EC-05 | 2.80 | 0.13 | 21.5 | 4.0 |
| EC-06 | 1.20 | 0.13 | 9.2 | 4.0 |
| EC-07 | 0.70 | 0.11 | 6.4 | 4.0 |
| EC-08 | 0.55 | 0.08 | 6.9 | 1.3 |

Green Light-sensitive Emulsions

Silver iodobromide tabular grain emulsions EM-01, EM-02, EM-03, EM-04, EM-05, EM-06, EM-07, EM-08, and EM-09 were provided having the significant grain characteristics set out in Table III below. Tabular grains accounted for greater than 70 percent of total grain projected area in all instances. Each of the emulsions EM-01 through EM-09 was optimally sulfur and gold sensitized. In addition, the emulsions EM-01 through EM-08 were optimally spectrally sensitized with SD-01 and SD-07 at 81.8 and 18.2 mole percent, respectively; the emulsion EM-09 was optimally spectrally sensitized with SD-01 and SD-02 at 85.7 and 14.3 mole percent, respectively. The wavelength of peak light absorption for the emulsions was around 545 nm, and the half-peak dye absorption bandwidth was around 48 nm for all emulsions.

TABLE III

Green Light-Sensitive Emulsion Size And Iodide Content

| Emulsion | Average grain ECD (μm) | Average grain thickness, (μm) | Average Aspect Ratio | Average Iodide Content (M %) |
|---|---|---|---|---|
| EM-01 | 2.49 | 0.14 | 17.8 | 4.1 |
| EM-02 | 1.20 | 0.11 | 10.9 | 4.1 |
| EM-03 | 0.92 | 0.12 | 7.7 | 4.1 |
| EM-04 | 0.81 | 0.12 | 6.8 | 2.6 |
| EM-05 | 2.20 | 0.13 | 16.9 | 4.1 |
| EM-06 | 1.10 | 0.11 | 10.0 | 4.1 |
| EM-07 | 0.87 | 0.11 | 7.9 | 4.1 |
| EM-08 | 0.55 | 0.08 | 6.9 | 1.5 |
| EM-09 | 0.55 | 0.08 | 6.9 | 1.5 |

Bathochromic Blue Light-sensitive Emulsions

Silver iodobromide tabular grain emulsions EY-01, EY-02, and EY-03 were provided having the significant grain characteristics set out in Table IV below. Tabular grains accounted for greater than 70 percent of total grain projected area in all instances. Each of the emulsions EY-01 through EY-03 was optimally sulfur and gold sensitized. In addition, these emulsions were optimally spectrally sensitized with SD-08 and SD-09, in a one-to-one molar ratio. The wavelength of peak light dye absorption for all emulsions was around 462 nm, and a second peak was present at around 442 nm. The half-peak dye absorption bandwidth was around 45 nm for these emulsions. Emulsion EY-04, a thick conventional grain was also provided. It was optimally sulfur and gold sensitized, and spectrally sensitized using SD-09.

TABLE IV

Bathochromic Blue Light-Sensitive Emulsion Size And Iodide Content

| Emulsion | Average grain ECD (μm) | Average grain thickness, (μm) | Average Aspect Ratio | Average Iodide Content (M %) |
|---|---|---|---|---|
| EY-01 | 1.20 | 0.13 | 9.2 | 4.0 |
| EY-02 | 0.75 | 0.14 | 5.4 | 1.4 |
| EY-03 | 0.55 | 0.08 | 6.9 | 1.3 |
| EY-04 | 1.04 | Not applicable | Not applicable | 9.0 |

Hypsochromic Blue Light-sensitive Emulsions

Silver iodobromide tabular grain emulsions EY-05, EY-06, EY-07, and EY-08 were provided having the significant grain characteristics set out in Table V below. Tabular grains accounted for greater than 70 percent of total grain projected area in all instances. Each of the emulsions EY-05 through EY-08 was optimally sulfur and gold sensitized. In addition, these emulsions were optimally spectrally sensitized with SD-08, SD-09, and SD-10 at a molar ratio of 49:31:20. The wavelength of peak light absorption for all emulsions was around 456 nm, and the half-peak dye absorption bandwidth was around 50 nm.

TABLE V

Hypsochromic Blue Light-Sensitive Emulsion Size And Iodide Content

| Emulsion | Average grain ECD (μm) | Average grain thickness, (μm) | Average Aspect Ratio | Average Iodide Content (M %) |
|---|---|---|---|---|
| EY-05 | 3.60 | 0.13 | 27.7 | 4.0 |
| EY-06 | 1.20 | 0.13 | 9.2 | 4.0 |
| EY-07 | 0.75 | 0.14 | 5.4 | 1.4 |
| EY-08 | 0.55 | 0.08 | 6.9 | 1.3 |

Color Negative Film (CNF) Elements

Samples 101 Through 106

Sample 101 (C)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| | |
|---|---|
| **Layer 1: AHU** | |
| Black colloidal silver sol | (0.107) |
| UV-1 | (0.075) |
| UV-2 | (0.075) |
| Oxidized developer scavenger S-1 | (0.161) |
| Compensatory printing density cyan dye CD-2 | (0.027) |
| Compensatory printing density magenta dye MD-1 | (0.012) |
| Compensatory printing density yellow dye MM-1 | (0.091) |
| HBS-1 | (0.105) |
| HBS-2 | (0.398) |
| HBS-4 | (0.013) |
| Disodium salt of 3,5-disulfocatechol | (0.215) |
| Gelatin | (2.152) |
| **Layer 2: SRU** | |
| EC-03 | (0.457) |
| EC-04 | (0.265) |
| Bleach accelerator coupler B-1 | (0.075) |
| DIR-1 | (0.015) |
| Cyan dye forming coupler C-1 | (0.375) |
| HBS-2 | (0.421) |
| HBS-5 | (0.098) |
| TAI | (0.012) |
| Gelatin | (1.646) |
| **Layer 3: MRU** | |
| EC-02 | (0.960) |
| Bleach accelerator coupler B-1 | (0.005) |
| DIR-1 | (0.016) |
| Cyan dye forming magenta colored coupler CM-1 | (0.059) |
| Cyan dye forming coupler C-1 | (0.199) |
| HBS-2 | (0.245) |
| HBS-5 | (0.007) |
| TAI | (0.016) |
| Gelatin | (1.280) |
| **Layer 4: FRU** | |
| EC-01 | (1.040) |
| Bleach accelerator coupler B-1 | (0.005) |
| DIR-1 | (0.027) |
| DIR-2 | (0.048) |
| Cyan dye forming magenta colored coupler CM-1 | (0.021) |
| Cyan dye forming coupler C-1 | (0.277) |
| HBS-1 | (0.194) |
| HBS-2 | (0.229) |
| HBS-5 | (0.007) |
| TAI | (0.010) |
| Gelatin | (1.277) |

-continued

| Layer 5: Interlayer | |
|---|---|
| Oxidized developer scavenger S-1 | (0.063) |
| HBS-4 | (0.095) |
| Gelatin | (0.527) |
| **Layer 6: SGU** | |
| EM-03 | (0.114) |
| EM-04 | (0.203) |
| Magenta dye forming yellow colored coupler MM-2 | (0.053) |
| Magenta dye forming coupler M-1 | (0.346) |
| Stabilizer ST-1 | (0.035) |
| HBS-1 | (0.411) |
| TAI | (0.005) |
| Gelatin | (1.168) |
| **Layer 7: MGU** | |
| EM-02 | (1.285) |
| EM-03 | (0.127) |
| DIR-3 | (0.032) |
| Magenta dye forming yellow colored coupler MM-2 | (0.118) |
| Magenta dye forming coupler M-1 | (0.120) |
| Oxidized developer scavenger S-2 | (0.015) |
| HBS-1 | (0.345) |
| HBS-2 | (0.032) |
| Stabilizer ST-1 | (0.012) |
| TAI | (0.022) |
| Gelatin | (1.621) |
| **Layer 8: FGU** | |
| EM-01 | (0.900) |
| DIR-4 | (0.003) |
| DIR-6 | (0.032) |
| Oxidized developer scavenger S-2 | (0.014) |
| Magenta dye forming yellow colored coupler MM-2 | (0.053) |
| Magenta dye forming coupler M-1 | (0.111) |
| HBS-1 | (0.212) |
| HBS-2 | (0.064) |
| Stabilizer ST-1 | (0.011) |
| TAI | (0.011) |
| Gelatin | (1.157) |
| **Layer 9: Yellow Filter Layer** | |
| Yellow filter dye YD-1 | (0.032) |
| Oxidized developer scavenger S-1 | (0.063) |
| HBS-4 | (0.095) |
| Gelatin | (0.635) |
| **Layer 10: SBU** | |
| EY-01 | (0.318) |
| EY-02 | (0.182) |
| EY-03 | (0.148) |
| DIR-1 | (0.027) |
| DIR-5 | (0.043) |
| Yellow dye forming coupler Y-1 | (0.965) |
| Cyan dye forming coupler C-1 | (0.027) |
| Bleach accelerator coupler B-1 | (0.011) |
| HBS-1 | (0.558) |
| HBS-2 | (0.108) |
| HBS-5 | (0.014) |
| TAI | (0.011) |
| Gelatin | (2.030) |
| **Layer 11: FBU** | |
| EY-04 | (0.711) |
| Unsensitized silver bromide Lippmann emulsion | (0.054) |
| Yellow dye forming coupler Y-1 | (0.448) |
| DIR-5 | (0.086) |
| Bleach accelerator coupler B-1 | (0.005) |
| HBS-1 | (0.268) |
| HBS-5 | (0.007) |
| TAI | (0.012) |
| Gelatin | (1.174) |
| **Layer 12: Ultraviolet Filter Layer** | |
| Dye UV-1 | (0.096) |
| Dye UV-2 | (0.096) |
| Unsensitized silver bromide Lippmann emulsion | (0.212) |

-continued

| | |
|---|---|
| HBS-1 | (0.134) |
| Gelatin | (0.690) |
| **Layer 13: Protective Overcoat Layer** | |
| Polymethylmethacrylate matte beads | (0.005) |
| Soluble polymethylmethacrylate matte beads | (0.106) |
| Silicone lubricant | (0.038) |
| Gelatin | (0.867) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 102 (E)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing. The silver halide emulsions contained in Sample 101 are also used in Sample 102.

| Layer 1: AHU | |
|---|---|
| Black colloidal silver sol | (0.151) |
| UV-1 | (0.075) |
| UV-2 | (0.075) |
| Compensatory printing density cyan dye CD-1 | (0.005) |
| Compensatory printing density magenta dye MD-1 | (0.048) |
| Compensatory printing density yellow dye MM-1 | (0.280) |
| HBS-1 | (0.126) |
| HBS-4 | (0.048) |
| Disodium salt of 3,5-disulfocatechol | (0.269) |
| Gelatin | (1.399) |
| **Layer 2: Interlayer** | |
| Oxidized developer scavenger S-1 | (0.072) |
| HBS-4 | (0.108) |
| Gelatin | (0.538) |
| **Layer 3: SRU** | |
| EC-02 | (0.108) |
| EC-03 | (0.215) |
| EC-04 | (0.430) |
| Bleach accelerator coupler B-1 | (0.075) |
| DIR-7 | (0.032) |
| Cyan dye forming coupler C-1 | (0.344) |
| HBS-1 | (0.129) |
| HBS-5 | (0.098) |
| HBS-6 | (0.118) |
| TAI | (0.012) |
| Gelatin | (1.516) |
| **Layer 4: MRU** | |
| EC-02 | (0.807) |
| DIR-2 | (0.005) |
| DIR-7 | (0.014) |
| Oxidized Developer Scavenger S-1 | (0.011) |
| Cyan dye forming coupler C-1 | (0.108) |
| HBS-1 | (0.077) |
| HBS-4 | (0.016) |
| TAI | (0.013) |
| Gelatin | (1.076) |
| **Layer 5: FRU** | |
| EC-01 | (0.915) |
| Bleach accelerator coupler B-1 | (0.003) |
| DIR-2 | (0.005) |
| DIR-7 | (0.022) |
| Oxidized Developer Scavenger S-1 | (0.014) |

-continued

| | |
|---|---|
| Cyan dye forming coupler C-1 | (0.086) |
| HBS-1 | (0.108) |
| HBS-4 | (0.021) |
| HBS-5 | (0.004) |
| TAI | (0.015) |
| Gelatin | (1.022) |
| **Layer 6: Interlayer** | |
| Magenta filter dye MD-2 | (0.056) |
| Oxidized developer scavenger S-1 | (0.108) |
| HBS-4 | (0.161) |
| Gelatin | (0.538) |
| **Layer 7: SGU** | |
| EM-03 | (0.161) |
| EM-04 | (0.194) |
| EM-09 | (0.355) |
| DIR-4 | (0.036) |
| Oxidized Developer Scavenger S-1 | (0.083) |
| Magenta dye forming coupler M-1 | (0.118) |
| Magenta dye forming coupler M-2 | (0.272) |
| Stabilizer ST-1 | (0.024) |
| HBS-1 | (0.166) |
| HBS-4 | (0.125) |
| TAI | (0.012) |
| Gelatin | (1.076) |
| **Layer 8: MGU** | |
| EM-02 | (0.699) |
| DIR-2 | (0.005) |
| DIR-4 | (0.017) |
| Oxidized Developer Scavenger S-1 | (0.075) |
| Magenta dye forming coupler M-1 | (0.051) |
| HBS-1 | (0.097) |
| HBS-4 | (0.113) |
| Stabilizer ST-1 | (0.010) |
| TAI | (0.011) |
| Gelatin | (0.968) |
| **Layer 9: FGU** | |
| EM-01 | (0.753) |
| DIR-2 | (0.005) |
| DIR-4 | (0.013) |
| Oxidized Developer Scavenger S-1 | (0.011) |
| Magenta dye forming coupler M-1 | (0.054) |
| HBS-1 | (0.090) |
| HBS-4 | (0.016) |
| Stabilizer ST-1 | (0.011) |
| TAI | (0.013) |
| Gelatin | (0.861) |
| **Layer 10: Yellow Filter Layer** | |
| Yellow filter dye YD-1 | (0.161) |
| Oxidized developer scavenger S-1 | (0.075) |
| HBS-4 | (0.113) |
| Gelatin | (1.184) |
| **Layer 11: SBU** | |
| EY-01 | (0.215) |
| EY-02 | (0.215) |
| EY-03 | (0.366) |
| Bleach accelerator coupler B-1 | (0.003) |
| DIR-4 | (0.032) |
| Yellow dye forming coupler Y-1 | (0.710) |
| HBS-1 | (0.065) |
| HBS-5 | (0.004) |
| TAI | (0.013) |
| Gelatin | (1.076) |
| **Layer 12: MBU** | |
| EY-01 | (0.108) |
| DIR-4 | (0.011) |
| Yellow dye forming coupler Y-1 | (0.032) |
| HBS-1 | (0.022) |
| TAI | (0.002) |
| Gelatin | (0.807) |

-continued

| | |
|---|---|
| **Layer 13: FBU** | |
| EY-04 | (0.538) |
| Bleach accelerator coupler B-1 | (0.004) |
| Yellow dye forming coupler Y-1 | (0.172) |
| HBS-5 | (0.006) |
| HBS-6 | (0.086) |
| TAI | (0.009) |
| Gelatin | (0.807) |
| **Layer 14: Ultraviolet Filter Layer** | |
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |
| **Layer 15: Protective Overcoat Layer** | |
| Polymethylmethacrylate matte beads | (0.005) |
| Soluble polymethylmethacrylate matte beads | (0.108) |
| Silicone lubricant | (0.039) |
| Gelatin | (0.888) |

This film was hardened at the time of coating with 1.50% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 103 (E)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| | |
|---|---|
| **Layer 1: AHU** | |
| Black colloidal silver sol | (0.151) |
| UV-1 | (0.075) |
| UV-2 | (0.075) |
| Compensatory printing density cyan dye CD-1 | (0.038) |
| Compensatory printing density magenta dye MD-1 | (0.081) |
| Compensatory printing density yellow dye MM-1 | (0.280) |
| HBS-1 | (0.256) |
| HBS-4 | (0.081) |
| Disodium salt of 3,5-disulfocatechol | (0.269) |
| SOLD-1 cyan soluble absorber dye | (0.008) |
| SOLD-2 magenta soluble absorber dye | (0.004) |
| SOLD-3 yellow soluble absorber dye | (0.026) |
| Gelatin | (1.614) |
| **Layer 2: Interlayer** | |
| Oxidized developer scavenger S-1 | (0.075) |
| HBS-4 | (0.113) |
| Gelatin | (0.538) |
| **Layer 3: SRU** | |
| EC-04 | (0.323) |
| Bleach accelerator coupler B-1 | (0.075) |
| DIR-7 | (0.022) |
| Cyan dye forming coupler C-1 | (0.194) |
| HBS-1 | (0.088) |
| HBS-5 | (0.098) |
| HBS-6 | (0.097) |
| TAI | (0.006) |
| Gelatin | (1.237) |
| **Layer 4: MSRU** | |
| EC-02 | (0.215) |
| EC-03 | (0.430) |

-continued

| | |
|---|---|
| DIR-2 | (0.005) |
| DIR-7 | (0.005) |
| Oxidized Developer Scavenger S-1 | (0.011) |
| Cyan dye forming coupler C-1 | (0.140) |
| HBS-1 | (0.043) |
| HBS-4 | (0.016) |
| HBS-6 | (0.054) |
| TAI | (0.011) |
| Gelatin | (0.861) |
| Layer 5: MRU | |
| EC-02 | (0.807) |
| DIR-2 | (0.005) |
| DIR-7 | (0.014) |
| Oxidized Developer Scavenger S-1 | (0.011) |
| Cyan dye forming coupler C-1 | (0.108) |
| HBS-1 | (0.077) |
| HBS-4 | (0.016) |
| TAI | (0.014) |
| Gelatin | (0.861) |
| Layer 6: FRU | |
| EC-01 | (0.915) |
| Bleach accelerator coupler B-1 | (0.003) |
| DIR-2 | (0.005) |
| DIR-7 | (0.022) |
| Oxidized Developer Scavenger S-1 | (0.014) |
| Cyan dye forming coupler C-1 | (0.086) |
| HBS-1 | (0.108) |
| HBS-4 | (0.021) |
| HBS-5 | (0.004) |
| TAI | (0.016) |
| Gelatin | (1.022) |
| Layer 7: Interlayer | |
| Magenta filter dye MD-2 | (0.065) |
| Oxidized developer scavenger S-1 | (0.075) |
| HBS-4 | (0.113) |
| Gelatin | (0.538) |
| Layer 8: SGU | |
| EM-07 | (0.086) |
| EM-08 | (0.280) |
| DIR-4 | (0.022) |
| Oxidized Developer Scavenger S-1 | (0.011) |
| Bleach accelerator coupler B-1 | (0.005) |
| Magenta dye forming coupler M-1 | (0.215) |
| Stabilizer ST-1 | (0.022) |
| HBS-1 | (0.129) |
| HBS-4 | (0.016) |
| HBS-5 | (0.007) |
| TAI | (0.006) |
| Gelatin | (1.076) |
| Layer 9: MSGU | |
| EM-07 | (0.258) |
| DIR-4 | (0.020) |
| Oxidized Developer Scavenger S-1 | (0.011) |
| Magenta dye forming coupler M-1 | (0.031) |
| HBS-1 | (0.053) |
| HBS-4 | (0.016) |
| Stabilizer ST-1 | (0.003) |
| TAI | (0.004) |
| Gelatin | (0.968) |
| Layer 10: MGU | |
| EM-02 | (0.118) |
| EM-06 | (0.527) |
| DIR-2 | (0.005) |
| DIR-4 | (0.016) |
| Oxidized Developer Scavenger S-1 | (0.011) |
| Magenta dye forming coupler M-1 | (0.043) |
| HBS-1 | (0.071) |
| HBS-4 | (0.016) |
| Stabilizer ST-1 | (0.004) |
| TAI | (0.011) |
| Gelatin | (1.184) |

-continued

| | |
|---|---|
| Layer 11: FGU | |
| EM-05 | (0.753) |
| DIR-2 | (0.005) |
| DIR-4 | (0.022) |
| Oxidized Developer Scavenger S-1 | (0.011) |
| Magenta dye forming coupler M-1 | (0.032) |
| HBS-1 | (0.077) |
| HBS-4 | (0.016) |
| Stabilizer ST-1 | (0.003) |
| TAI | (0.013) |
| Gelatin | (0.861) |
| Layer 12: Yellow Filter Layer | |
| Yellow filter dye YD-1 | (0.161) |
| Oxidized developer scavenger S-1 | (0.075) |
| HBS-4 | (0.113) |
| Gelatin | (0.699) |
| Layer 13: SBU | |
| EY-01 | (0.237) |
| EY-02 | (0.237) |
| EY-03 | (0.409) |
| Bleach accelerator coupler B-1 | (0.004) |
| DIR-4 | (0.032) |
| Yellow dye forming coupler Y-1 | (0.710) |
| HBS-1 | (0.065) |
| HBS-5 | (0.006) |
| TAI | (0.015) |
| Gelatin | (1.453) |
| Layer 14: MBU | |
| EY-01 | (0.108) |
| DIR-4 | (0.011) |
| Yellow dye forming coupler Y-1 | (0.032) |
| HBS-1 | (0.022) |
| TAI | (0.002) |
| Gelatin | (0.807) |
| Layer 15: FBU | |
| EY-04 | (0.538) |
| Bleach accelerator coupler B-1 | (0.004) |
| Yellow dye forming coupler Y-1 | (0.172) |
| HBS-5 | (0.006) |
| HBS-6 | (0.086) |
| TAI | (0.009) |
| Gelatin | (1.022) |
| Layer 16: Ultraviolet Filter Layer | |
| Dye UV-1 | (0.108) |
| Dye UV-2 | (0.108) |
| Unsensitized silver bromide Lippmann emulsion | (0.215) |
| HBS-1 | (0.151) |
| Gelatin | (1.076) |
| Layer 17: Protective Overcoat Layer | |
| Polymethylmethacrylate matte beads | (0.005) |
| Soluble polymethylmethacrylate matte beads | (0.108) |
| Silicone lubricant | (0.039) |
| Gelatin | (0.888) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 104A (E)

Sample 104A color photographic recording material for color negative development was prepared exactly as above in Sample 103, except where noted.

| Layer 1: AHU Changes | |
|---|---|
| Compensatory printing density cyan dye CD-1 | (0.000) |
| Compensatory printing density magenta dye MD-1 | (0.000) |
| Compensatory printing density yellow dye MM-1 | (0.000) |
| HBS-1 | (0.105) |
| HBS-4 | (0.000) |
| SOLD-1 cyan soluble absorber dye | (0.005) |
| SOLD-2 magenta soluble absorber dye | (0.014) |
| SOLD-3 yellow soluble absorber dye | (0.000) |
| **Layer 3: SRU Changes** | |
| Emulsion EC-04, silver content | (0.000) |
| Emulsion EC-07, silver content | (0.097) |
| Emulsion EC-08, silver content | (0.387) |
| DIR-7 | (0.011) |
| Cyan dye forming coupler C-1 | (0.258) |
| HBS-1 | (0.044) |
| HBS-6 | (0.129) |
| TAI | (0.004) |
| **Layer 4: MSRU Changes** | |
| Emulsion EC-02, silver content | (0.000) |
| Emulsion EC-03, silver content | (0.000) |
| Emulsion EC-07, silver content | (0.355) |
| DIR-7 | (0.024) |
| Cyan dye forming coupler C-1 | (0.065) |
| HBS-1 | (0.095) |
| TAI | (0.003) |
| **Layer 5: MRU Changes** | |
| Emulsion EC-02, silver content | (0.000) |
| Emulsion EC-06, silver content | (0.807) |
| DIR-7 | (0.012) |
| HBS-1 | (0.047) |
| TAI | (0.006) |
| **Layer 6: FRU Changes** | |
| Emulsion EC-01, silver content | (0.000) |
| Emulsion EC-05, silver content | (0.915) |
| DIR-7 | (0.012) |
| Cyan dye forming coupler C-1 | (0.088) |
| HBS-1 | (0.047) |
| TAI | (0.007) |
| **Layer 7: Interlayer Changes** | |
| Magenta filter dye MD-2 | (0.000) |
| Compensatory printing density yellow dye MM-1 | (0.129) |
| **Layer 12: Yellow Filter Layer Changes** | |
| Yellow filter dye YD-1 | (0.091) |
| **Layer 13: SBU Changes** | |
| Emulsion EY-01, silver content | (0.000) |
| Emulsion EY-02, silver content | (0.000) |
| Emulsion EY-03, silver content | (0.000) |
| Emulsion EY-06, silver content | (0.366) |
| Emulsion EY-07, silver content | (0.183) |
| Emulsion EY-08, silver content | (0.258) |
| DIR-4 | (0.022) |
| Yellow dye forming coupler Y-1 | (0.732) |
| HBS-1 | (0.086) |
| TAI | (0.014) |
| **Layer 14: MBU Changes** | |
| Emulsion EY-01, silver content | (0.000) |
| Emulsion EY-06, silver content | (0.215) |
| Yellow dye forming coupler Y-1 | (0.091) |
| TAI | (0.004) |
| **Layer 15: FBU Changes** | |
| Emulsion EY-04, silver content | (0.000) |
| Emulsion EY-05, silver content | (0.646) |
| DIR-4 | (0.005) |
| Yellow dye forming coupler Y-1 | (0.140) |
| HBS-1 | (0.022) |
| HBS-6 | (0.000) |
| TAI | (0.006) |

-continued

| Layer 16: Ultraviolet Filter Layer Changes | |
|---|---|
| Dye UV-2 | (0.216) |
| HBS-7 | (0.108) |

This film was hardened at the time of coating with 1.75% by weight of total gelatin of hardener H-1. Surfactants, coating aids, antifoggants, stabilizers, antistatic agents, biostats, biocides, and other addenda chemicals were added to the various layers of this sample, as is commonly practiced in the art.

Sample 104B (E)

Sample 104B color photographic recording material for color negative development was prepared exactly as above in Sample 104A, except where noted.

| Layer 1: AHU Changes | |
|---|---|
| SOLD-1 cyan soluble absorber dye | (0.000) |
| SOLD-2 magenta soluble absorber dye | (0.000) |
| **Layer 8: SGU Changes** | |
| Magenta dye forming coupler M-1 | (0.260) |
| DIR-4 | (0.026) |
| Stabilizer ST-1 | (0.026) |
| HBS-1 | (0.177) |
| **Layer 10: MGU Changes** | |
| DIR-4 | (0.011) |
| HBS-1 | (0.060) |
| **Layer 14: MBU Changes** | |
| Yellow dye forming coupler Y-1 | (0.108) |
| DIR-4 | (0.008) |
| HBS-1 | (0.016) |
| **Layer 15: FBU Changes** | |
| DIR-4 | (0.000) |
| Yellow dye forming coupler Y-1 | (0.173) |
| HBS-1 | (0.000) |

This film was hardened at the time of coating with 1.75% by weight of total gelatin of hardener H-1. Surfactants, coating aids, antifoggants, stabilizers, antistatic agents, biostats, biocides, and other addenda chemicals were added to the various layers of this sample, as is commonly practiced in the art.

Sample 105 (C)

Sample 105 color photographic recording material for color negative development was KODAK ADVANTIX™ 400 Film, Generation 2, finished in 35 mm width.

Sample 106 (C)

This sample was prepared by applying the following layers in the sequence recited to a transparent film support of annealed polyethylene-2,6-naphthalate with conventional subbing layers, with the red recording layer unit coated nearest the support. The side of the support to be coated had been prepared by the application of gelatin subbing.

| Layer 1: AHU | |
|---|---|
| Black colloidal silver sol | (0.151) |
| Compensatory printing density cyan dye CD-1 | (0.006) |
| Compensatory printing density magenta dye MD-1 | (0.034) |
| Compensatory printing density yellow dye MM-1 | (0.238) |

-continued

| | |
|---|---|
| HBS-1 | (0.024) |
| HBS-4 | (0.034) |
| Disodium salt of 3,5-disulfocatechol | (0.269) |
| Gelatin | (3.248) |
| **Layer 2: Interlayer** | |
| Oxidized developer scavenger S-1 | (0.072) |
| HBS-4 | (0.108) |
| Gelatin | (0.538) |
| **Layer 3: SRU** | |
| EC-03 | (0.430) |
| EC-04 | (0.484) |
| Bleach accelerator coupler B-1 | (0.054) |
| Oxidized Developer Scavenger S-3 | (0.183) |
| DIR-6 | (0.013) |
| Cyan dye forming coupler C-1 | (0.344) |
| Cyan dye forming coupler C-2 | (0.038) |
| HBS-2 | (0.026) |
| HBS-5 | (0.116) |
| HBS-6 | (0.118) |
| TAI | (0.015) |
| Gelatin | (1.797) |
| **Layer 4: MRU** | |
| EC-02 | (1.184) |
| Bleach accelerator coupler B-1 | (0.022) |
| DIR-2 | (0.011) |
| DIR-6 | (0.011) |
| Oxidized Developer Scavenger S-1 | (0.011) |
| Oxidized Developer Scavenger S-3 | (0.183) |
| Cyan dye forming coupler C-1 | (0.086) |
| Cyan dye forming coupler C-2 | (0.086) |
| HBS-1 | (0.044) |
| HBS-2 | (0.022) |
| HBS-4 | (0.017) |
| HBS-5 | (0.074) |
| HBS-6 | (0.097) |
| TAI | (0.019) |
| Gelatin | (1.560) |
| **Layer 5: FRU** | |
| EC-01 | (1.291) |
| Bleach accelerator coupler B-1 | (0.003) |
| DIR-2 | (0.011) |
| DIR-6 | (0.011) |
| Oxidized Developer Scavenger S-1 | (0.014) |
| Cyan dye forming coupler C-1 | (0.065) |
| Cyan dye forming coupler C-2 | (0.075) |
| HBS-1 | (0.044) |
| HBS-2 | (0.022) |
| HBS-4 | (0.018) |
| HBS-5 | (0.004) |
| HBS-6 | (0.161) |
| TAI | (0.020) |
| Gelatin | (1.829) |
| **Layer 6: Interlayer** | |
| Magenta filter dye MD-2 | (0.065) |
| Oxidized developer scavenger S-1 | (0.108) |
| HBS-4 | (0.161) |
| Gelatin | (1.076) |
| **Layer 7: SGU** | |
| EM-04 | (0.260) |
| EM-03 | (0.141) |
| Bleach accelerator coupler B-1 | (0.012) |
| DIR-6 | (0.012) |
| Oxidized Developer Scavenger S-1 | (0.022) |
| Oxidized Developer Scavenger S-3 | (0.183) |
| Magenta dye forming coupler M-1 | (0.301) |
| Stabilizer ST-1 | (0.062) |
| HBS-1 | (0.241) |
| HBS-2 | (0.024) |
| HBS-4 | (0.033) |
| HBS-5 | (0.061) |
| TAI | (0.006) |
| Gelatin | (1.184) |

-continued

| | |
|---|---|
| **Layer 8: MGU** | |
| EM-02 | (1.184) |
| Bleach accelerator coupler B-1 | (0.005) |
| DIR-2 | (0.009) |
| DIR-6 | (0.011) |
| Oxidized Developer Scavenger S-1 | (0.011) |
| Oxidized Developer Scavenger S-3 | (0.120) |
| Magenta dye forming coupler M-1 | (0.113) |
| HBS-1 | (0.125) |
| HBS-2 | (0.022) |
| HBS-4 | (0.016) |
| HBS-5 | (0.037) |
| Stabilizer ST-1 | (0.022) |
| TAI | (0.020) |
| Gelatin | (1.560) |
| **Layer 9: FGU** | |
| EM-01 | (0.968) |
| DIR-2 | (0.009) |
| DIR-6 | (0.011) |
| Oxidized Developer Scavenger S-1 | (0.011) |
| Magenta dye forming coupler M-1 | (0.103) |
| HBS-1 | (0.118) |
| HBS-2 | (0.022) |
| HBS-4 | (0.016) |
| Stabilizer ST-1 | (0.022) |
| TAI | (0.012) |
| Gelatin | (1.560) |
| **Layer 10: Yellow Filter Layer** | |
| Yellow filter dye YD-1 | (0.162) |
| Oxidized developer scavenger S-1 | (0.075) |
| HBS-4 | (0.113) |
| Gelatin | (1.076) |
| **Layer 11: SBU** | |
| EY-01 | (0.355) |
| EY-02 | (0.226) |
| EY-03 | (0.301) |
| Bleach accelerator coupler B-1 | (0.003) |
| DIR-6 | (0.011) |
| Oxidized Developer Scavenger S-3 | (0.183) |
| Yellow dye forming coupler Y-1 | (0.715) |
| HBS-2 | (0.022) |
| HBS-5 | (0.050) |
| HBS-6 | (0.151) |
| TAI | (0.014) |
| Gelatin | (1.516) |
| **Layer 12: FBU** | |
| EY-04 | (0.699) |
| Bleach accelerator coupler B-1 | (0.004) |
| DIR-6 | (0.013) |
| Yellow dye forming coupler Y-1 | (0.140) |
| HBS-2 | (0.026) |
| HBS-5 | (0.005) |
| HBS-6 | (0.118) |
| TAI | (0.011) |
| Gelatin | (1.506) |
| **Layer 13: Ultraviolet Filter Layer** | |
| Dye UV-1 | (0.108) |
| Dye UV-2 | (0.108) |
| Compensatory printing density cyan dye CD-1 | (0.004) |
| Unsensitized silver bromide Lippmann emulsion | (0.215) |
| HBS-1 | (0.168) |
| Gelatin | (0.699) |
| **Layer 14: Protective Overcoat Layer** | |
| Polymethylmethacrylate matte beads | (0.005) |
| Soluble polymethylmethacrylate matte beads | (0.108) |
| Silicone lubricant | (0.039) |
| Gelatin | (0.888) |

This film was hardened at the time of coating with 1.75% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

In order to establish the utility of the photographic recording materials, each of the Sample 101–106 color negative films was exposed to white light from a tungsten source filtered by a Daylight Va filter to 5500K at $1/500^{th}$ of a second through 1.2 inconel neutral density and a 0–4 log E graduated tablet with 0.20 density increment steps. The exposed film samples were processed through the KODAK FLEMCOLOR™ or C-41 Process, as described by *The British Journal of Photography Annual* of 1988, pp. 196–198. A second description of the use of the KODAK FLEXICOLOR™ C-41 process is provided by *Using Kodak Flexicolor Chemicals*, Kodak Publication No. Z-131, Eastman Kodak Company, Rochester, N.Y. The film samples were then subjected to Status M densitometry and the characteristic curves and photographic performance metrics were determined, the granularity of the samples was determined using a microdensitometer with a 48 micrometer aperture at an exposure of about −1.5 log E, corresponding approximately to a midscale exposure on a color negative of ISO 400 speed. Additional similar sensitometric determinations were carried out using a carefully calibrated sensitometer to determine absolute ISO speed of the photographic recording materials.

The gamma for a Sample's characteristic curve color records was determined using a KODAK MODEL G Gradient Meter between a first characteristic curve reference point lying at density of about 0.15 above minimum density and a second reference point separated from the first reference point by about 0.9 log E. The minimum exposure latitude obtainable with a representative digital printing system was also determined for the limiting color record of the RGB color records, indicating the exposure range of a characteristic curve segment over which the instantaneous gamma was at least about 70% of the gamma as defined above. The observed values of gamma and latitude are reported in Table VI. Speed values that relate to ISO speed were determined in a similar fashion as described above by metering the exposure required to produce a density of 0.15 above the minimum density of an unexposed region of processed film sample. The method of determination of ISO (ASA) speed of color negative films for still photography is reported in ANSI PH2.27-1981. The raw speed values reported in Table VII were not adjusted for film gamma, as can be sensibly done given the large differences in gamma, as described earlier. All of the film samples produced useful imaging characteristics, as illustrated by the performance values reported in Table VI, VII, and VIIIA. Film samples representative of the known art are additionally labeled as "(C)" and examples of the invention "(E)" for clarity.

TABLE VI

Color Recording Material Gamma and Minimum Latitude

| Sample | Status M Gamma R | G | B | Latitude (log lux-s) |
|---|---|---|---|---|
| 1. 101 (C) | 0.58 | 0.64 | 0.70 | 3.0 |
| 2. 102 (E) | 0.43 | 0.48 | 0.49 | 2.8 |
| 3. 103 (E) | 0.39 | 0.43 | 0.45 | 3.0 |
| 4. 104A (E) | 0.39 | 0.43 | 0.49 | 3.0 |
| 5. 105 (C) | 0.61 | 0.59 | 0.74 | 3.1< |
| 6. 106 (C) | 0.52 | 0.58 | 0.58 | 2.7 |

TABLE VII

Color Recording Material Fixed Density Above D-min and ISO Speeds

| Sample | 0.15 Density Speed R | G | B | Raw ISO Speed |
|---|---|---|---|---|
| 1. 101 (C) | 349 | 356 | 352 | 472 |
| 2. 102 (E) | 339 | 352 | 349 | 403 |
| 3. 103 (E) | 341 | 350 | 358 | 404 |
| 4. 104A (E) | 340 | 351 | 347 | 406 |
| 5. 104B (E) | 349 | 357 | 363 | 482 |
| 6. 105 (C) | 350 | 351 | 355 | 449 |
| 7. 106 (C) | 349 | 355 | 353 | 448 |

It was observed that all of the samples provided minimum exposure latitude of at least 2.7 log E and a minimum, raw absolute ISO speed of 400. Samples 102 and 103 yielded lower apparent sensitivities than Sample 101 despite being comprised of the same silver halide emulsions at about the same coverages as Sample 101. The gamma produced by Samples 102 and 103 was lower than that of 101, and the speed metric relating to a fixed density change over minimum density underestimated the photographic recording material's true threshold sensitivity. As electronic signal amplification following scanning will normalize the image-bearing signals to the correct output contrast relationships, the spurious ISO speed difference was not material. The differences in speed between Samples 104A and 104B resulted from the effect of soluble exposure light absorbing dyes added to Sample 104A, commonly added to adjust the white light speed of the individual color recording units to improve color balance. The granularity of Samples 101 and 105, representative of color negative films intended for optical printing, was significantly greater than that of the remaining samples with gammas suitable for scanning and electronic signal processing, especially in the green and blue channel densities, as reported for roughly midscale exposure values providing the indicated densities in Table VIIIA.

The spectral sensitivities over the visible light spectrum of the individual color units of the photographic recording materials, Samples 101, 103–105, were determined in 5-nm increments using nearly monochromatic light of carefully calibrated output from 360 to 715 nm. Photographic recording materials Samples 101, 103–105 were individually exposed for 1/100 of a second to white light from a tungsten light source of 3000K color temperature that was filtered by a Daylight Va filter to 5500K and by a monochromator with a 4-nm band pass resolution through a graduated 0–4.0 density step tablet with 0.3-density step increments to determine their spectral speed. The samples were then developed using the C-41 Process.

Following processing and drying, Samples 101, 103–105 were subjected to Status M densitometry. A set of speeds was generated by taking the Status M densitometry and transforming it to analytical densities using a 3×3 matrix treatment appropriate for the image dye set according to methods well known in the art as cited earlier. The exposure required to produce an analytical density increase of 0.20 above D-min was determined for each of the color-recording units at each 5-nm increment exposed. The individual exposures at each wavelength increment for each of the red, green and blue responsivities were normalized by the red, green and blue maximum sensitivity, respectively, to convert each of the 5-nm sample sensitivities to relative sensitivities for linear space plotting and performance parameter determination when normalized to relative sensitivities of 0–100%.

It was observed by examining the results in Table VIIIB that Samples 101 and 103 produced essentially the same spectral responsivities, and sample 105 produced fairly similar responsivities, with the principle exception of a more bathochromic red wavelength of maximum red color recording unit response. The spectral sensitivities of these photographic recording materials were representative of conventional color negative films of the art intended for optical printing. Samples 104A and 104B showed completely atypical and extraordinary overlap between the green and red recording channels. The red wavelength of maximum red color recording unit response was observed to shift about 31 nm hypsochromic from Sample 104A to sample 104B, to about 692 nm, upon the omission of soluble absorber dyes, which represented the intrinsic spectral responsivity of the green-red light sensitive silver halide tabular grains contained in these Samples within the red recording layer unit. The spectral responsivity of Samples 104A and 104B were observed by the increased green-red channel overlap and wavelength of maximum red sensitivity (particularly Sample 104B) to provide calorimetric recording resembling human visual responsivity and dissimilar to the conventional film responsivities of Samples 101, 103, and 105. The soluble absorber dyes did not detectably affect film color development properties.

TABLE VIIIA

Multicolor Recording Material Density and Granularity

| Sample | R density | G density | B density | R $\sigma_D$ | G $\sigma_D$ | B $\sigma_D$ |
|---|---|---|---|---|---|---|
| 101 (C) | 0.99 | 1.50 | 1.82 | 0.012 | 0.013 | 0.026 |
| 102 (E) | 0.76 | 1.30 | 1.55 | 0.008 | 0.007 | 0.011 |
| 103 (E) | 0.82 | 1.33 | 1.53 | 0.007 | 0.006 | 0.010 |
| 104A (E) | 0.71 | 0.89 | 1.12 | 0.006 | 0.006 | 0.010 |
| 105 (C) | 1.13 | 1.52 | 1.87 | 0.008 | 0.010 | 0.027 |
| 106 (C) | 0.95 | 1.49 | 1.67 | 0.008 | 0.007 | 0.014 |

TABLE VIIIB

Multicolor Recording Material Spectral Sensitivity

| Sample | BU sensitivity λmax (nm) | GU sensitivity λmax (nm) | RU sensitivity λmax (nm) | BU relative sensitivity half-peak bandwidth (nm) | GU relative sensitivity half-peak bandwidth (nm) | RU relative sensitivity half-peak bandwidth (nm) | RU and GU equal relative emulsion sensitivity λmax (nm) | RU and GU equal relative emulsion sensitivity as fraction of maximum (%) |
|---|---|---|---|---|---|---|---|---|
| 101 (C) | 472 | 545 | 627 | 73 | 48 | 46 | 582 | 17 |
| 103 (E) | 473 | 545 | 625 | 72 | 54 | 48 | 583 | 17 |
| 104A (E) | 455 | 546 | 623 | 67 | 54 | 68 | 574 | 50 |
| 104B (E) | 455 | 545 | 592 | 67 | 63 | 67 | 572 | 57 |
| 105 (C) | 472 | 546 | 654 | 25 | 58 | 45 | 583 | 15 |

Color Developer Solutions

Developers for accelerated and conventional color negative film processing were prepared according to the formulations in Table IX. Ingredient levels are expressed in moles per liter (moles/L) of solution, except for poly(vinyl pyrrolidone), which is expressed in grams per liter of solution, time is expressed in seconds.

TABLE IX

Developer Solution Compositions

| Condition/Ingredient Name | Developer 101 (E) | Developer 201 (E) | Conventional Developer (C) |
|---|---|---|---|
| pH | 10.1 | 10.4 | 10.1 |
| Temperature | 48° C. | 54.6° C. | 37.8C |
| Time | 60 | 30 | 195 |
| Hydroxylamine sulfate | 0.018 | 0.018 | 0.012 |
| Diethylenetriamine pentaacetic acid, pentasodium salt | 0.005 | 0.0052 | 0.005 |
| Potassium iodide | 0.000024 | 0.000012 | 0.000007 |
| Poly(vinyl pyrrolidone) | 3.0 g/L | 3.0 g/L | 0.0 |
| Sodium bromide | 0.0 | 0.0 | 0.013 |
| Potassium bromide | 0.017 | 0.022 | none |
| Potassium carbonate | 0.289 | 0.289 | 0.271 |
| 4-(N-ethyl-N-2-hydroxy-ethyl)-2-methylphenylene-diamine sulfate (CD-4) | 0.048 | 0.055 | 0.015 |
| Potassium sulfite | 0.057 | 0.049 | none |
| Sodium sulfite | none | none | 0.032 |

Color Development Example I

Replicate samples of Samples 101, 102, 103 and 104A color negative photographic recording materials were imagewise exposed individually for 1/100 of a second to white light from a tungsten light source of 2850K color temperature that was filtered by a Daylight Va filter to 5500K through a 0–4 log E graduated tablet with 0.20-density increment steps. The films were developed as follows using a rapid development treatment and a comparative conventional development treatment: one set of exposed films samples was processed in an 8-L tank using fine gas bubble agitation released at the tank bottom using Developer 101 and a second set was processed in precisely the same way using the comparative Conventional Developer as noted in Tables IX and X. Development time was 50 seconds in the 8-liter deep tank containing Developer 101 Solution with a 10-second drain and hold above the tank, before dropping the film rack into the next tank as indicated; the development time was 185 seconds for the reference Conventional Developer with a 10-second drain and hold above the tank, before dropping the film rack into the next tank as indicated. Conventional tail-end processing solution steps of bleaching through final rinse were used subsequently following either development condition as indicated in Table X, using solutions for bleaching and fixing described in Tables XI and XII.

TABLE X

Processing Steps and Agitation Method

| Solution | Agitation | Process Time (s) |
|---|---|---|
| 1. Development | Nitrogen burst; 2 s on, 2 s off (E) | 50 (10 s drain) (E) |
| | Nitrogen burst; 2 s on, 8 s off (C) | 185 (10 s drain) (C) |
| 2. Bleach | Continuous air | 170 (10 s drain) (E) |
| | | 230 (10 s drain) (C) |
| 3. Wash | Continuous air | 170 (10 s drain) |
| 4. Fix | Continuous air | 170 (10 s drain) (E) |
| | | 230 (10 s drain) (C) |
| 5. Wash | Continuous air | 170 (10 s drain) |
| 6. Rinse | None | 50 (10 s drain) |

TABLE XI

Example I Bleach Composition

| Condition/Ingredient | Concentration (g/L) |
|---|---|
| pH | 4.75 |
| Temperature | 38° C. |
| 1,3-PDTA | 27.1 |
| 2-Hydroxy-1,3-diaminopropane tetraacetic acid | 0.6 |
| Glacial acetic acid | 60.0 |
| Ammonium bromide | 20.0 |
| Ferric nitrate nonahydrate | 32.5 |

TABLE XII

Example I Fixer Composition

| Condition/Ingredient | Concentration (g/L) |
|---|---|
| pH | 6.5 |
| Temperature | 38° C. |
| Ammonium thiosulfate (anhydrous) | 121.5 |
| Sodium sulfite | 12.0 |
| $Na_2EDTA\text{-}2H_2O$ | 1.29 |

The processed strips were dried with warm circulating air in a commercial film dryer, and the Samples were subjected to Status M densitometry in order to determine the sensitometric response of the Samples to the two development conditions. The effect of development treatment on gamma response is detailed in Table XIII. The films intended for scanning (Samples 102, 103, 104A) showed excellent maintenance of color balance and overall quite similar gammas following rapid development compared with the gammas resulting from the standard development treatment of the commercial trade, unlike a representative color negative film intended for optical printing-Sample 101-comprised of generally the same silver halide emulsions as Samples 102 and 103.

Color Development Example II

Replicate samples of Samples 101, 102, 103 and 105 color negative photographic recording materials imagewise exposed individually for 1/100 of a second to white light from a tungsten light source of 2850K color temperature that was filtered by a Daylight Va filter to 5500K through a 0–4 log E graduated tablet with 0.20-density increment steps. The films were developed as follows using a rapid development treatment and a comparative development treatment: one set of exposed films samples was processed in an 8-L tank with agitation from fine gas bubbles released at the tank bottom using Developer 201 solution and a second set was fully processed in a roller transport film processor (Allen Products Company Film Processor Model C-41-35-10) using C-41 developer solution with a representative composition as noted in Table IX. Development time was 25 seconds in the 8-liter deep tank containing Developer 201 Solution with a 5-second drain and hold above the tank, before dropping the film rack into the next 8-liter tank as indicated; the development time was 195 seconds for the C-41 developer in the reference flooded machine process followed by introduction of the continuous film strand into the next processing tank, with completion of the full commercial sequence of Process C-41 to clear and wash the film samples. The tail-end clearing steps of bleaching through final wash and rinse were used also subsequently in 8-liter deep tank application for the samples following the rapid development condition, using bleaching and fixing solution compositions as noted in Tables XV and XVI.

TABLE XIV

Rapid Processing Steps and Agitation Method (E)

| Solution | Agitation | Process Time(s) |
|---|---|---|
| 1. Development | Nitrogen burst; 2 s on, 4 s off | 25 (5 s drain) |
| 2. Bleach | Continuous air | 40 (5 s drain) |
| 3. Wash | Continuous air | 25 (5 s drain) |
| 4. Fix | Continuous air | 85 (5 s drain) |
| 5. Wash | Continuous air | 25 (5 s drain) |
| 6. Rinse | None | 55 (5 s drain) |

TABLE XV

Example II Bleach Composition

| Condition/Ingredient | Concentration (g/L) |
|---|---|
| pH | 4.50 |
| Temperature | 38° C. |
| 1,3-PDTA | 108.6 |
| 2-Hydroxy-1,3-diaminopropane tetraacetic acid | 1.0 |
| Succinic acid | 80.0 |
| Ammonium bromide | 60.0 |
| Ferric nitrate nonahydrate | 130.9 |

TABLE XVI

Example II Fixer Composition

| Condition/Ingredient | Concentration (g/L) |
|---|---|
| pH | 6.50 |
| Temperature | 38° C. |
| Ammonium thiosulfate | 112.5 |
| Sodium sulfite | 14.0 |
| Ammonium thiocyanate | 69.5 |
| $Na_2EDTA\text{-}2H_2O$ | 1.2 |
| Glacial acetic acid | 5.0 |

The processed strips were dried with warm moving air in a commercial film dryer, and the Samples were subjected to Status M densitometry in order to determine the sensitometric response of the Samples to the two development conditions. The effect of development treatment on gamma response is detailed in Table XVII. The films intended for scanning (Samples 102, 103) showed significantly more similar gammas following rapid development to the gammas resulting from the standard development treatment of the commercial trade than did a representative color negative film intended for optical printing comprised of generally the same silver halide emulsions as Samples 102 and 103—Sample 101—or an additional comparative control—Sample 105—particularly in the red record.

Color Development Example III

A first testing group comprised of replicate films strips of Sample 101 and 106 color negative films was imagewise exposed to white light from a tungsten source filtered by a Daylight Va filter and a graduated step tablet. One set of the exposed film samples was processed through the C-41 Process. A second set of the above samples was processed in a rapid process of the trade art, which was commercially available under the name KONICA QD-21 Plus Digital Minilab, film process cycle "ECOJET HQA-N." The nominal processing specifications are compared in Table XVIII. The film samples were then subjected to Status M densitometry and the characteristic curves and photographic performance metrics were determined. A second testing group comprised of replicate film strips of Samples 101–105 was imagewise exposed to white light from a tungsten source filtered by a Daylight Va filter and a graduated step tablet at a different time. One set of the exposed film samples was processed through the C-41 Process on a different occasion than the first set above. A second set of the second testing group samples was contemporaneously processed in the KONICA QD-21 process, these film samples were collected and all subjected to Status M densitometry, and the characteristic curves and photographic performance metrics were likewise determined.

TABLE XVIII

Comparison of Process QD-21 and Process C-41 Steps

| Solution | QD-21 Process Time(s) | C-41 Process Time(s) |
|---|---|---|
| 1. Development | 100 | 195 |
| 2. Bleach | 24 | 180 |
| 3. Wash | — | 60 |
| 4. Fix | 48 | 260 |
| 3. Wash | — | 195 |
| 5. Stabilize | 48 | 65 |
| Total Time | 3 min 40 s | 15 min 55 s |

It was observed earlier that the red record gamma of the comparative control films of the art was significantly diminished in the accelerated development processes. The percentage change of the red record gamma for the Samples processed in the QD-21 process relative to the normal C-41 process is tabulated in Table XIX.

In order to characterize the chemical signal processing properties of the color negative recording materials, the gamma ratio of the light recording units was determined. The Samples were exposed for $1/50^{th}$ of a second to white light from a tungsten source filtered to 5500K over a 0–3 log E range in 21 stepped increments, and then they were exposed to that white light source sequentially filtered by narrow band pass red, green, and blue dichroic filters to produce separation red, green and blue light exposures. The exposed samples were processed in the C-41 process, and the dried samples were subjected to Status M densitometry. The gamma ratios for each color unit were determined individually by dividing the separation exposure gamma by the respective neutral white light exposure gamma; these results are also reported in Table XIX.

The unprocessed, raw unswollen film Samples equilibrated to ambient humidity after preparation by coating were cross-sectioned, and the total coated film thickness was determined by calibrated optical and electron microscopic techniques. The total coated thickness of Samples 101–106 is reported also in Table XIX. The total number of coated layers was tabulated as reported in the description of the film elements, and the average layer thickness was determined in Table XIX by dividing the total coated thickness by the number of coated layers.

It was observed by reference to Table XIX that QD-21 development of comparative control Samples 101 and 106 in the first testing group, comprised of the same silver halide emulsions but differing gamma ratios, resulted in similar, worsened accelerated development performance indicative of reduced compatibility with the conventional trade process and less satisfactory maintenance of color balance between the two processes.

In the experimentation involving the second testing group conducted on a different occasion, it was readily apparent that examples of the invention, Samples 102, 103, and 104A, showed virtually no effect of accelerated development on red recording unit gamma, quite unlike the comparative controls Samples 101 and 105. Samples 102 and 103, examples of the invention, and 101 and 106, comparative controls, were comprised of generally the same silver halide emulsions. Samples 102, 103, and 104A, examples of the invention, and Sample 106, comparative control, all showed gamma ratio values between 0.8 and 1.3; conventional color negative films intended for optical printing showed gamma ratio values between 1.3 and 2.2, however. As seen in Table XIX, only when low gamma ratios of less than 1.3 and low average layer thickness of less than about 1.5 micrometers were simultaneously provided, did the photographic recording material exhibit excellent red record rapid developability in accord with the present invention.

TABLE XIII

Comparative Rapid Processability of Multicolor Photographic Recording Materials

| | Neutral Gammas following 195 s FLEXICOLOR-type Development (C) | | | Neutral Gammas following 60 s Developer 101 Development (E) | | | Percent Change in Neutral Gamma Produced by 60 s Developer 101 Development (E) | | |
|---|---|---|---|---|---|---|---|---|---|
| Sample | R | G | B | R | G | B | R | G | B |
| 101 (C) | 0.63 | 0.61 | 0.74 | 0.47 | 0.55 | 0.87 | −25.0 | −9.8 | 18.0 |
| 102 (E) | 0.44 | 0.43 | 0.49 | 0.40 | 0.42 | 0.53 | −9.1 | −2.3 | 8.2 |
| 103 (E) | 0.43 | 0.43 | 0.46 | 0.44 | 0.43 | 0.52 | 2.3 | 0.0 | 13.0 |
| 104A (E) | 0.43 | 0.45 | 0.52 | 0.42 | 0.42 | 0.58 | −2.3 | −6.7 | 11.5 |

TABLE XVII

Comparative Rapid Processability of Multicolor Photographic Recording Materials

| | Neutral Gammas following 195 s C-41 Development (C) | | | Neutral Gammas following 30 s Developer 201 Development (E) | | | Percent Change in Neutral Gamma Produced by 30 s Developer 201 Development (E) | | |
|---|---|---|---|---|---|---|---|---|---|
| Sample | R | G | B | R | G | B | R | G | B |
| 101 (C) | 0.60 | 0.61 | 0.71 | 0.30 | 0.53 | 0.68 | −50.0 | −13.1 | −4.2 |
| 102 (E) | 0.42 | 0.46 | 0.47 | 0.31 | 0.42 | 0.54 | −26.2 | −8.7 | 14.9 |
| 103 (E) | 0.40 | 0.39 | 0.45 | 0.33 | 0.40 | 0.50 | −17.5 | 2.6 | 11.1 |
| 105 (C) | 0.64 | 0.65 | 0.69 | 0.41 | 0.47 | 0.73 | −35.9 | −27.7 | 5.8 |

TABLE XIX

Effect of Gamma Ratio and Thickness on Comparative Rapid Processability of Multicolor Photographic Recording Materials

| | Ratio of Separation-to-Neutral Gamma, 195 s C-41 Development (Gamma Ratio) | | | Total Film Thickness | Coated | Average Layer | Percent Change in Neutral Red Gamma Produced by 100 s QD-21 Development (C) |
|---|---|---|---|---|---|---|---|
| Sample | R | G | B | (μm) | Layers | Thickness (μm) | R |
| Test Group I | | | | | | | |
| 101 (C) | 1.34 | 1.80 | 1.45 | 22.9 | 13 | 1.8 | −19.6 |
| 106 (C) | 1.09 | 0.97 | 1.07 | 26.1 | 14 | 1.9 | −21.3 |
| Test Group II | | | | | | | |
| 101 (C) | 1.41 | 1.77 | 1.44 | 24.2 | 13 | 1.9 | −14.3 |
| 102 (E) | 1.14 | 0.94 | 1.22 | 19.4 | 15 | 1.3 | −2.3 |
| 103 (E) | 1.19 | 0.87 | 1.03 | — | 17 | — | 0.0 |
| 104A (E) | 1.18 | 0.94 | 1.28 | 21.2 | 17 | 1.3 | 2.6 |
| 105 (C) | 1.36 | 2.18 | 1.44 | 24.2 | 13 | 1.9 | −14.1 |

The invention has been described in detail with particular reference to preferred embodiments thereof, but it will be understood that variations and modifications can be effected within the spirit and scope of the invention.

What is claimed is:

1. A color negative photographic film element for producing a color image suited for conversion to an electronic form and subsequent reconversion into a viewable form:

said element comprising a support and, coated on the support, a plurality of hydrophilic colloid layers, including radiation-sensitive silver halide emulsion layers, forming layer units for separately recording blue, green, and red exposures, each of the layer units containing dye image-forming coupler chosen to produce image dye having an absorption half-peak bandwidth lying in a different spectral region in each layer unit, WHEREIN the element comprises a development inhibitor releasing compound in at least one layer unit, at least one of the layer units contains two or more emulsion layers differing in sensitivity, the layer units each exhibit a dye image gamma of less than 1.0, the element exhibits an exposure latitude of at least 2.7 log E, where E is exposure measured in lux-seconds, and a light sensitivity of at least ISO 50, the gamma ratio of each of the red, green and blue light recording layer units is between about 0.80 and 1.30, the average layer thickness is about 1.5 micrometers or less, and at least one of the red light recording and the green light recording layer units is divided into four or more sub-unit layers and the radiation-sensitive silver halide emulsions contained in different sub-units of the same layer unit differ in sensitivity.

2. An element according to claim 1 wherein the red recording layer unit contains a cyan dye image-forming coupler, the green recording layer unit contains a magenta dye image-forming coupler, and the blue recording layer unit contains a yellow dye image-forming coupler.

3. An element according to claim 1 wherein the radiation-sensitive silver halide emulsions are silver iodobromide emulsions.

4. An element according to claim 1 wherein each said layer unit comprises a tabular grain emulsion having an average aspect ratio of greater than 2.

5. An element according to claim 1, said element further comprising a development inhibitor-releasing compound in each of layer units.

6. An element according to claim 1 wherein each of the red recording and green recording layer units is divided into two or more sub-unit layers and radiation-sensitive silver halide emulsions contained in different sub-unit layers of the same layer unit differ in sensitivity.

7. An element according to claim 1 wherein each of the red recording and green recording layer units is divided into three or more sub-unit layers and the radiation-sensitive silver halide emulsions contained in different sub-unit layers of the same layer unit differ in sensitivity.

8. An element according to claim 1 wherein the total coated thickness is less than about 22 micrometers.

9. An element according to claim 1 wherein photographic recording mate al has contiguous blue, green, and red light recording unit sub-unit layers that are not interleaved.

10. An element according to claim 1 wherein the average layer thickness is about 1.3 micrometers or less.

11. An element according to claim 1 wherein the photographic recording material is substantially free of colored masking couplers.

12. An element according to claim 1 wherein the photographic recording element comprises at least 13 coated layers, including sub-unit layers.

13. An element according to claim 1 wherein the photographic recording element comprises at least 15 coated layers, including sub-unit layers.

14. An element according to claim 1 wherein the photographic recording element comprises at least 17 coated layers, including sub-unit layers.

15. An element according to claim 1 wherein the photographic recording element contains less than 7 $g/m^2$ of total silver.

16. An element according to claim 1 wherein the total coated thickness is less than about 20 micrometers.

17. An element according to claim 1 wherein the wavelength of maximum sensitivity of the red light recording unit is between about 580 and 625 nm.

18. An element according to claim 1 wherein the relative sensitivity half-peak bandwidth of the red light recording unit exceeds 50 nm.

* * * * *